US010231059B2

(12) United States Patent
Ozasa et al.

(10) Patent No.: US 10,231,059 B2
(45) **Date of Patent: *Mar. 12, 2019**

(54) SOUND GENERATOR

(71) Applicant: KYOCERA Corporation, Kyoto (JP)

(72) Inventors: Kenichi Ozasa, Yokohama (JP); Kosuke Teruyama, Yokohama (JP); Masahiro Shinya, Kawasaki (JP); Talchi Kim, Yokohama (JP); Seiji Horii, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,755

(22) Filed: Dec. 1, 2017

(65) Prior Publication Data

US 2018/0084348 A1 Mar. 22, 2018

Related U.S. Application Data

(63) Continuation of application No. 14/499,723, filed on Sep. 29, 2014, now Pat. No. 9,843,865.

(30) Foreign Application Priority Data

Oct. 30, 2013 (JP) ..... 2013-225411
Oct. 30, 2013 (JP) ..... 2013-225415
(Continued)

(51) Int. Cl.
*H04R 17/00* (2006.01)
*B06B 1/06* (2006.01)
(Continued)

(52) U.S. Cl.
CPC ..... *H04R 17/00* (2013.01); *B06B 1/0603* (2013.01); *B06B 1/0611* (2013.01); *H04R 3/04* (2013.01);
(Continued)

(58) Field of Classification Search
CPC combination set(s) only.
See application file for complete search history.

(56) References Cited

U.S. PATENT DOCUMENTS 8,139,762 B2 3/2012 Kuroda et al.
8,536,766 B2 9/2013 Uetani et al.
(Continued)

FOREIGN PATENT DOCUMENTS

JP H05-85192 U 11/1993
JP H09-252496 A 9/1997
(Continued)

OTHER PUBLICATIONS

An Office Action; "Notice of Reasons for Rejection," issued by the Japanese Patent Office dated Nov. 7, 2017, which corresponds to Japanese Patent Application No. 2016-206198 and is related to U.S. Appl. No. 15/829,755; with English language concise explanation.
(Continued)

*Primary Examiner* — Amir H Etesam
(74) *Attorney, Agent, or Firm* — Studebaker & Brackett PC

(57) ABSTRACT

A sound generator includes a housing and a vibrator. The vibrator includes at least one piezoelectric element and has at least of a part thereof inside the housing. A contact portion on the at least one piezoelectric element is configured to transmit generated vibration to an object outside of the sound generator. The at least one piezoelectric element generates vibration in response to a signal from outside the vibrator, and causes the object to vibrate and generate a sound to emit from the object.

6 Claims, 43 Drawing Sheets

(30) Foreign Application Priority Data

Dec. 24, 2013 (JP) ..... 2013-265927
Mar. 27, 2014 (JP) ..... 2014-066653

(51) Int. Cl.
*H04R 3/04* (2006.01)
*H04R 3/12* (2006.01)

(52) U.S. Cl.
CPC ..... *H04R 3/12* (2013.01); *H04R 2420/01* (2013.01); *H04R 2420/03* (2013.01); *H04R 2420/05* (2013.01); *H04R 2499/11* (2013.01); *H04R 2499/15* (2013.01)

(56) References Cited

U.S. PATENT DOCUMENTS

| | | | | |
|---|---|---|---|---|
| 9,478,725 | B2 | 10/2016 | Kato | |
| 9,615,178 | B2 | 4/2017 | Fukami et al. | |
| 9,756,749 | B2 * | 9/2017 | Kanemaki | H04R 7/045 |
| 2002/0067841 | A1 | 6/2002 | Bank et al. | |
| 2006/0239479 | A1 | 10/2006 | Schobben et al. | |
| 2007/0041595 | A1 | 2/2007 | Carazo et al. | |
| 2007/0057601 | A1 | 3/2007 | Kawase et al. | |
| 2009/0003630 | A1 | 1/2009 | Kuroda et al. | |
| 2011/0266926 | A1 | 11/2011 | Uetani et al. | |
| 2012/0281345 | A1 | 11/2012 | Masaki et al. | |
| 2014/0020659 | A1 | 1/2014 | Kato | |
| 2014/0342783 | A1 | 11/2014 | Suzuki et al. | |

FOREIGN PATENT DOCUMENTS

| | | | |
|---|---|---|---|
| JP | 2002-119074 | A | 4/2002 |
| JP | 2002-369290 | A | 12/2002 |
| JP | 2005-130149 | A | 5/2005 |
| JP | 2006-140740 | A | 6/2006 |
| JP | 2006-253735 | A | 9/2006 |
| JP | 2006-525734 | A | 11/2006 |
| JP | 2007-074663 | A | 3/2007 |
| JP | 2008-263080 | A | 10/2008 |
| JP | 2009-027320 | A | 2/2009 |
| JP | 2009-027413 | A | 2/2009 |
| JP | 2009-053502 | A | 3/2009 |
| JP | 2011-071691 | A | 4/2011 |
| JP | 2011-141330 | A | 7/2011 |
| JP | 2011-175127 | A | 9/2011 |
| JP | 2011-182368 | A | 9/2011 |
| JP | 2012-103520 | A | 5/2012 |
| JP | 2013-009236 | A | 1/2013 |
| JP | 2013-077002 | A | 4/2013 |
| JP | 2013-223213 | A | 10/2013 |
| JP | 2014-27569 | A | 2/2014 |
| JP | 2014-127794 | A | 7/2014 |
| JP | 2015088902 | A | 5/2015 |
| WO | 2007/086524 | A1 | 8/2007 |
| WO | 2011/122416 | A1 | 10/2011 |
| WO | 2012-115230 | A1 | 8/2012 |

OTHER PUBLICATIONS

JP Office Action dated Nov. 28, 2017, from corresponding JP Appl No. 2014-067089, with English statement of relevance, 3 pp.
An Office Action; "Notice of Reasons for Rejection," issued by the Japanese Patent Office dated Sep. 20, 2016, which corresponds to Japanese Patent Application No. 2013-225411 and is related to U.S. Appl. No. 14/499,723; with English language concise explanation.
An Office Action; "Notice of Reasons for Rejection," issued by the Japanese Patent Office dated Sep. 20, 2016, which corresponds to Japanese Patent Application No. 2013-225413 and is related to U.S. Appl. No. 14/499,723; with English language concise explanation.
An Office Action; "Notice of Reasons for Rejection," issued by the Japanese Patent Office dated Sep. 20, 2016, which corresponds to Japanese Patent Application No. 2013-225415 and is related to U.S. Appl. No. 14/499,723; with English language concise explanation.
JP Office Action dated Dec. 20, 2016 from corresponding JP Appl No. 2013-265928, with concise statement of relevance, 4 pp.
An Office Action; "Notice of Reasons for Rejection" issued by the Japanese Patent Office dated Apr. 25, 2017, which corresponds to Japanese Patent Application No. 2014-067089 and is related to U.S. Appl. No. 14/499,723; with English language concise explanation.
An Office Action issued by the Japanese Patent Office dated Jun. 6, 2017, which corresponds to Japanese Patent Application No. 2014-066653 and is related to U.S. Appl. No. 14/499,723; with English language concise explanation.
An Office Action issued by the U.S. Patent Office dated Jun. 29, 2017, which corresponds to U.S. Appl. No. 15/386,352 and is related to U.S. Appl. No. 14/499,723.

* cited by examiner

SOUND GENERATOR

CROSS-REFERENCE TO RELATED APPLICATIONS

This application is a Continuation of U.S. application Ser. No. 14/499,723 filed Sep. 29, 2014, and claims priority to and the benefit of Japanese Patent Application No. 2013-225411 filed Oct. 30, 2013, Japanese Patent Application No. 2013-225415 filed Oct. 30, 2013, Japanese Patent Application No. 2013-265927 filed Dec. 24, 2013, and Japanese Patent Application No. 2014-066653 filed Mar. 27, 2014, the entire contents of which are incorporated herein by reference.

TECHNICAL FIELD

The present disclosure relates to a sound generator that vibrates a mounting surface on which the sound generator is mounted, causing sound to be emitted from the mounting surface.

BACKGROUND

Patent Literature 1, for example, discloses a vibration generating device. The vibration generating device disclosed in Patent Literature 1 has a dynamic speaker configuration provided with a magnet, a voice coil, and a diaphragm, as well as a case housing these elements. Patent Literature 2 discloses a vibration generating device that includes an anchor formed from an elastic body and that causes the anchor to deform, such as by flexing, due to vibration of a piezoelectric vibrator, with a vibrated body being vibrated by this deformation. Patent Literature 3 discloses a vibration generating device in which an elastic body that receives the load of an anchor deforms, such as by flexing, due to vibration of a piezoelectric vibrator, with a vibrated body being vibrated by this deformation. Patent Literature 4 discloses a vibration generating device in which an elastic body deforms, such as by flexing, due to vibration of a piezoelectric vibrator, with a vibrated body being vibrated by this deformation.

CITATION LIST

Patent Literature 1: JP H05-085192 U
Patent Literature 2: JP 2007-074663 A
Patent Literature 3: JP 2009-027413 A
Patent Literature 4: JP 2009-027320 A

SUMMARY

Since the vibration generating device disclosed in Patent Literature 1 has a dynamic speaker configuration and uses a variety of components, such as a magnet, a voice coil, a diaphragm, and a case housing these elements, the number of components in the device necessarily increases. The devices disclosed in Patent Literature 2 through Patent Literature 4 use a piezoelectric element as the vibrating body, and it is necessary to provide space sufficient for the elastic body to flex within these devices in order to ensure a certain degree of freedom for deformation of the elastic body. An increase in size in these devices is thus unavoidable.

The present disclosure has been conceived in light of the above considerations and provides a sound generator that has a simple structure and can generate a good sound.

A sound generator according to the present disclosure includes: a housing; at least one stand supporting the housing; a piezoelectric vibrator including a piezoelectric element; and an anchor applying a load to the piezoelectric vibrator, such that while the load from the anchor is being applied to the piezoelectric vibrator, the piezoelectric vibrator deforms in response to a sound signal, and deformation of the piezoelectric vibrator vibrates a mounting surface on which the sound generator is mounted, causing sound to be emitted from the mounting surface.

The stand may include an attaching portion attached to the housing and a leg abutting the mounting surface, and the stand may be openable and closable with respect to the housing, with the attaching portion acting as a pivot.

An axis of rotation of the attaching portion may be substantially parallel to a bottom side of the housing facing the mounting surface.

An axis of rotation of the attaching portion may be substantially perpendicular to a bottom side of the housing facing the mounting surface.

The at least one stand may include a plurality of stands.

The piezoelectric element may be a laminated piezoelectric element that deforms by expanding and contracting along a lamination direction.

The piezoelectric vibrator may include a cover member that vibrates the mounting surface by transmitting vibration due to deformation of the piezoelectric element to the mounting surface.

A sound generator according to the present disclosure includes: a housing; a piezoelectric vibrator including a piezoelectric element; and an anchor applying a load to the piezoelectric vibrator, such that when the sound generator is mounted on a horizontal mounting surface, the piezoelectric vibrator is disposed on a bottom side of the housing, the bottom side facing the mounting surface, such that the bottom side intersects a line that traverses a center of gravity of the sound generator and that is perpendicular to the mounting surface, and such that while the load from the anchor is being applied to the piezoelectric vibrator, the piezoelectric vibrator deforms in response to a sound signal, and deformation of the piezoelectric vibrator vibrates the mounting surface to cause sound to be emitted from the mounting surface.

The center of gravity of the sound generator may be positioned towards the bottom side from an intermediate position between the bottom side and a top side opposite the bottom side.

The housing may include at least one battery therein, and a center of gravity of the battery may be positioned towards the bottom side from the intermediate position between the bottom side and the top side.

The at least one battery may include a plurality of batteries, and the piezoelectric vibrator may be disposed between the plurality of batteries.

The housing may include a display unit, and when the sound generator is mounted on the mounting surface, the display unit may face diagonally upward.

A thickness of the bottom side may be greater than a thickness of a top side opposite the bottom side.

The housing may have a predetermined thickness in a first region at the bottom side and have a thickness less than the predetermined thickness in a second region at a top side opposite the bottom side.

The predetermined thickness may be 50 mm or less.

A width of the first region may be 150 mm or less.

The piezoelectric element may be a laminated piezoelectric element that deforms by expanding and contracting along a lamination direction.

The piezoelectric vibrator may include a cover member that vibrates the mounting surface by transmitting vibration due to deformation of the piezoelectric element to the mounting surface.

A sound generator according to the present disclosure includes: a housing; a piezoelectric vibrator including a piezoelectric element disposed within the housing; a regulating unit at an edge of the piezoelectric vibrator opposite a bottom side of the housing, the bottom side facing a mounting surface when the sound generator is mounted on the mounting surface, the regulating unit capable of placing the piezoelectric vibrator in a regulated state by regulating a support state of the piezoelectric vibrator and a non-regulated state by not regulating the support state; and an anchor applying a load to the piezoelectric vibrator, such that while the load from the anchor is being applied to the piezoelectric vibrator, the piezoelectric element is driven and the piezoelectric vibrator deforms in response to a sound signal, and deformation of the piezoelectric vibrator vibrates the mounting surface contacted by the sound generator to cause sound to be emitted from the mounting surface.

At a first position, the regulating unit may place the piezoelectric vibrator in the non-regulated state, and at a second position, the regulating unit may place the piezoelectric vibrator in the regulated state.

When the piezoelectric vibrator is in the non-regulating state, the piezoelectric element need not be driven.

The sound generator may further include a stand attached to the housing so as to be openable and closable, such that when the stand is open, the piezoelectric vibrator is in the regulated state, and when the stand is closed, the piezoelectric vibrator is in the non-regulated state.

The piezoelectric vibrator may include a cover member that vibrates the mounting surface by transmitting vibration due to deformation of the piezoelectric element to the mounting surface.

The sound generator may further include a vibration unit positioned at an opposite edge of the piezoelectric vibrator from the regulating unit so as to be between the piezoelectric vibrator and the mounting surface when the sound generator is mounted on the mounting surface, such that while the load from the anchor is being applied to the vibration unit via the piezoelectric vibrator, the piezoelectric element is driven and the piezoelectric vibrator deforms in response to a sound signal, and deformation of the piezoelectric vibrator vibrates the mounting surface contacted by the sound generator to cause sound to be emitted from the mounting surface.

The vibration unit may include a cover member that vibrates the mounting surface by transmitting vibration due to deformation of the piezoelectric vibrator to the mounting surface.

The piezoelectric vibrator may be held in the housing in a watertight manner.

The piezoelectric element may be a laminated piezoelectric element that deforms by expanding and contracting along a lamination direction.

A sound generator according to the present disclosure includes: a plurality of piezoelectric vibrators each including a piezoelectric element; and an anchor applying a load to the piezoelectric vibrators, such that while the load from the anchor is being applied to the piezoelectric vibrators, upon application of a sound signal to each piezoelectric element, each piezoelectric element deforms and the piezoelectric vibrators deform, and deformation of the piezoelectric vibrators vibrates a contact surface contacted by the sound generator, causing sound to be emitted from the contact surface.

The piezoelectric vibrators may be disposed on a virtual plane perpendicular to an expansion and contraction direction of each piezoelectric element.

The piezoelectric vibrators may be disposed along a virtual line parallel to an expansion and contraction direction of each piezoelectric element.

Stereo audio may be input into the piezoelectric vibrators.

The plurality of piezoelectric vibrators may include three piezoelectric vibrators disposed on a bottom face.

The sound generator may further include a loudspeaker driven simultaneously with the piezoelectric vibrators.

According to the present disclosure with the above structure, it is possible to provide a sound generator that has a simple structure and can generate a good sound.

A sound generator according to the present disclosure includes a housing comprising first and second surfaces opposite to each other, and a vibrator. The vibrator comprises at least one piezoelectric element configured to generate vibration, where at least a part of the at least one piezoelectric element is inside of the housing, and a contact portion on the at least one piezoelectric element and configured to transmit the vibration to an object outside of the sound generator. At least a part of the first surface faces a third surface of the object while the contact portion is in contact with the object, the first surface intersects a line that is perpendicular to the third surface and that passes through a center of gravity of the sound generator that is located closer to the first surface than the second surface, and the at least one piezoelectric element generates vibration in response to a signal from outside the vibrator and causes the third surface to vibrate and generate a sound to emit from the third surface.

The housing may include at least one battery therein, and a center of gravity of the battery may be positioned towards the first surface from an intermediate position between the first surface and the second surface.

The housing may include a display unit, and when the contact portion is in contact with the object, the display unit may faces diagonally upward.

The vibrator may further include a cover member that vibrates the third surface by transmitting vibration due to deformation of the at least one piezoelectric element to the third surface.

A sound generator according to the present disclosure includes a housing comprising a first surface, a display, and a vibrator. The vibrator comprises at least one piezoelectric element configured to generate vibration, and at least a part of the at least one piezoelectric element is inside of the housing. A contact portion on the piezoelectric element is configured to transmit the vibration to an object outside of the sound generator. The at least one piezoelectric element generates vibration in response to a signal from outside the vibrator and causes the object to vibrate and generate a sound to emit from the object. When the contact portion is in contact with the object, the display faces diagonally upward.

At least a part of the first surface may faces a second surface of the object while the contact portion is in contact with the object, and the first surface may intersect a line that is perpendicular to the second surface and that passes through a center of gravity of the sound generator.

BRIEF DESCRIPTION OF DRAWINGS

The present disclosure will be further described below with reference to the accompanying drawings, wherein.

DESCRIPTION OF EMBODIMENTS

The following describes embodiments of the present disclosure with reference to the drawings.

Embodiment 1

Figure 1:
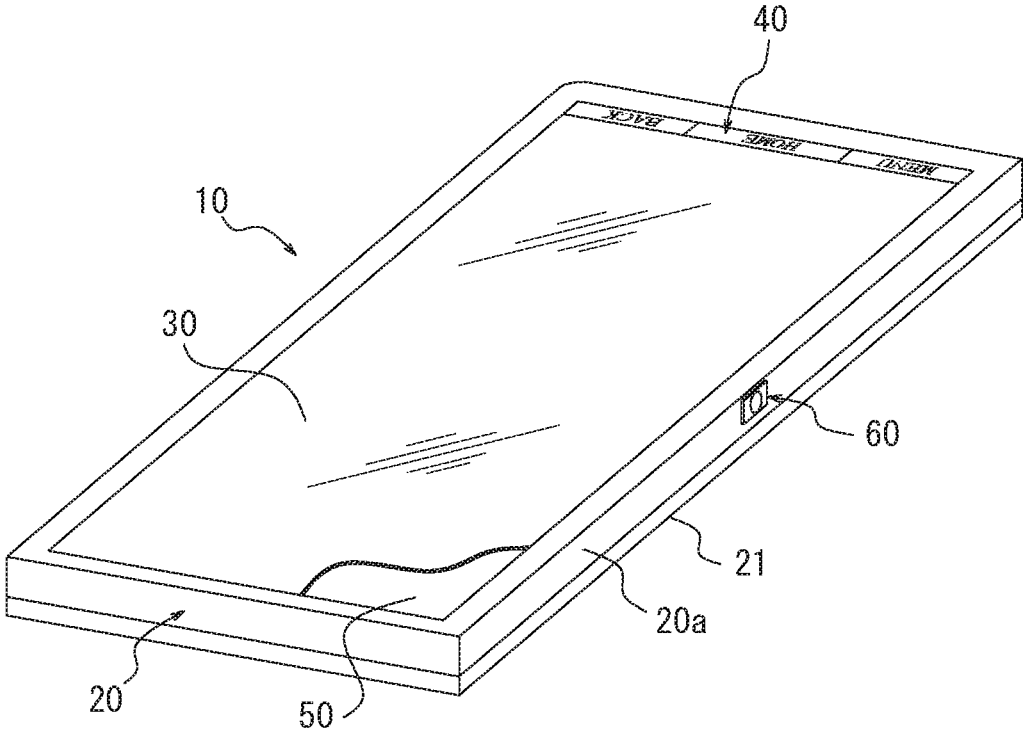
FIG. 1 is an external perspective view schematically illustrating the structure of a sound generator according to Embodiment 1 of the present disclosure.

FIG. 1 is an external perspective view of a sound generator according to Embodiment 1 of the present disclosure. The sound generator according to the present embodiment includes a mobile phone 10, such as a smartphone, and a piezoelectric vibrator 60. As described below, the mobile phone 10 acts as an anchor (the anchor in the sound generator) providing a load to the piezoelectric vibrator 60. The mobile phone 10 includes a housing 20 having an approximately rectangular external shape. In the housing 20, a panel 30 and an input unit 40 are provided at the front side of the mobile phone 10, and as illustrated by the partial cutout of the panel 30 in FIG. 1, a display unit 50 is held below the panel 30. A battery pack, camera unit, and the like are installed at the back side of the housing 20 and covered by a battery lid 21.

The panel 30 is configured using a touch panel that detects contact, a cover panel that protects the display unit 50, or the like and is, for example, made from glass or a synthetic resin such as acrylic or the like. The panel 30 is, for example, rectangular. The panel 30 may be a flat plate or may be a curved panel, the surface of which is smoothly inclined. When the panel 30 is a touch panel, the panel 30 detects contact by the user's finger, a pen, a stylus pen, or the like. Any detection system may be used in the touch panel, such as a capacitive system, a resistive film system, a surface acoustic wave system (or an ultrasonic wave system), an infrared system, an electromagnetic induction system, a load detection system, or the like. In the present embodiment, to simplify explanation, the panel 30 is a touch panel.

The input unit 40 accepts operation input from the user and may be configured, for example, using operation buttons (operation keys). Note that the panel 30 can also accept operation input from the user by detecting contact by the user on a softkey or the like displayed on the display unit 50.

The display unit 50 is a display device such as a liquid crystal display, an organic EL display, an inorganic EL display, or the like.

The sound generator according to the present embodiment includes the piezoelectric vibrator 60 for a sound generator on a bottom side 20*a*, which is one of the long sides of the housing 20 in the mobile phone 10. The bottom side 20*a* faces a mounting surface, such as a desk, when the mobile phone 10 is mounted horizontally on the mounting surface.

Figure 2:
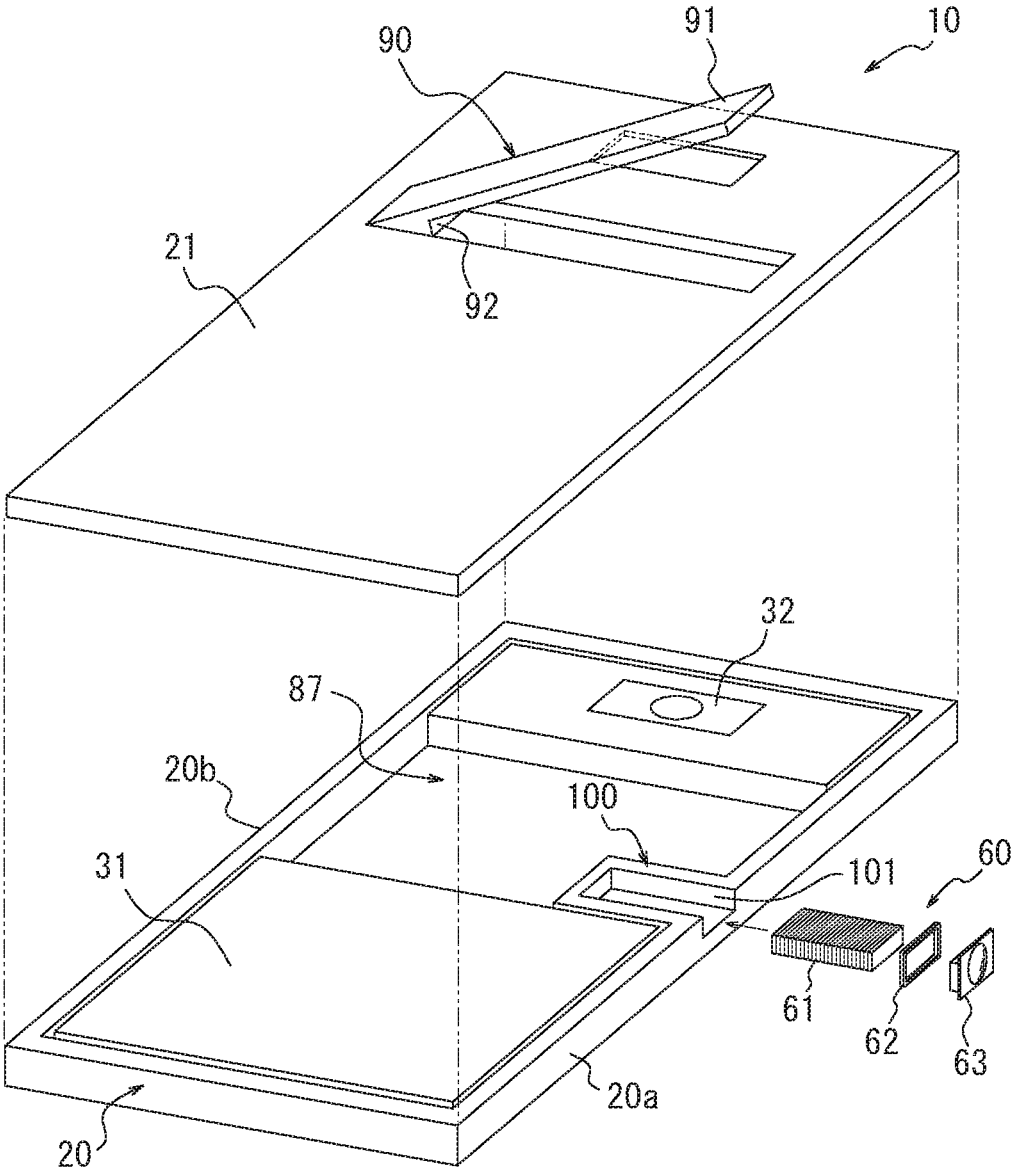
FIG. 2 is an external, exploded perspective view of the main parts at the back side of the mobile phone in FIG. 1.

FIG. 2 is an exploded perspective view schematically illustrating the main parts at the back side of the mobile phone 10 in FIG. 1. A battery pack 31, a camera unit 32, and the like are installed at the back side of the housing 20. At the back side of the housing 20, the mobile phone 10 includes a holding unit 100 that houses and holds the piezoelectric vibrator 60. The holding unit 100 includes a slit 101, with a uniform width, that extends along the transverse direction of the housing 20 and opens to the bottom side 20*a*.

The piezoelectric vibrator 60 includes a piezoelectric element 61, an O-ring 62, and an insulating cap 63 that is a cover member. The piezoelectric element is formed by elements that, upon application of an electric signal (voltage), either expand and contract or bend in accordance with the electromechanical coupling coefficient of their constituent material. Ceramic or crystal elements, for example, may be used. The piezoelectric element may be a unimorph, bimorph, or laminated piezoelectric element. Examples of a laminated piezoelectric element include a laminated bimorph element with layers of bimorph (for example, 8 to 40 layers) and a stack-type element configured with a laminated structure formed by a plurality of dielectric layers composed of, for example, lead zirconate titanate (PZT) and electrode layers disposed between the dielectric layers. Unimorph expands and contracts upon the application of an electric signal, bimorph bends upon the application of an electric signal, and a stack-type laminated piezoelectric element expands and contracts along the lamination direction upon the application of an electric signal.

In the present embodiment, the piezoelectric element 61 is a stack-type laminated piezoelectric element. For example as illustrated in the expanded cross-sectional view and plan view in FIG. 3A and FIG. 3B, the laminated piezoelectric element 61 is configured with alternately layered dielectric materials 61*a*, for example formed from ceramic such as PZT or the like, and internal electrodes 61*b* with a cross-sectional comb shape. Internal electrodes 61*b* connecting to a first lateral electrode 61*c* and internal electrodes 61*b* connecting to a second lateral electrode 61*d* are alternately layered and respectively connect to the first lateral electrode 61*c* and the second lateral electrode 61*d* electrically.

Figure 3A:
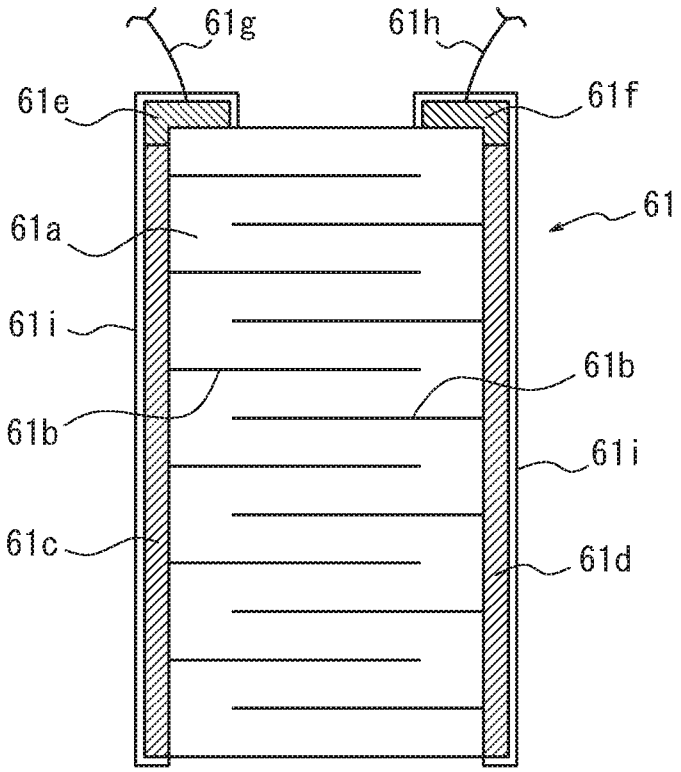
FIG. 3A is an enlarged cross-sectional view illustrating the structure of the laminated piezoelectric element in FIG. 2.
Figure 3B:
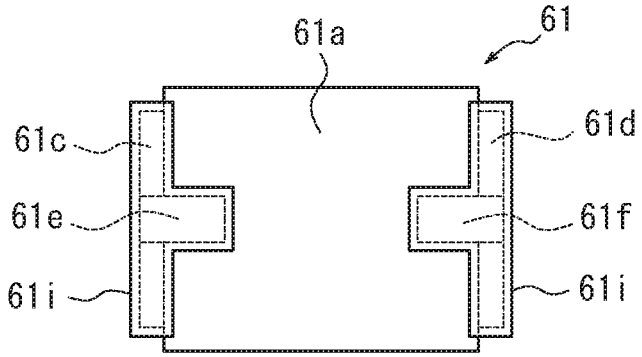
FIG. 3B is an enlarged plan view illustrating the structure of the laminated piezoelectric element in FIG. 2.

The laminated piezoelectric element 61 illustrated in FIG. 3A and FIG. 3B has formed, at one end face, a first lead connector 61*e* electrically connected to the first lateral electrode 61*c* and a second lead connector 61*f* electrically connected to the second lateral electrode 61*d*. A first lead wire 61*g* and a second lead wire 61*h* respectively connect to the first lead connector 61*e* and the second lead connector 61*f*. The first lateral electrode 61*c*, second lateral electrode 61*d*, first lead connector 61*e*, and second lead connector 61*f* are covered by an insulating layer 61*i* in a state with the first lead wire 61*g* and the second lead wire 61*h* respectively connected to the first lead connector 61*e* and the second lead connector 61*f*.

The laminated piezoelectric element 61 has a length of, for example, 5 mm to 120 mm in the lamination direction. The cross-sectional shape of the laminated piezoelectric element 61 in a direction perpendicular to the lamination direction may, for example, be an approximate square between 2 mm square and 10 mm square or may be any shape other than a square. Note that the number of layers and the cross-sectional area of the laminated piezoelectric element 61 are determined appropriately in accordance with the weight of the mobile phone 10 (in the case of a portable electronic device, for example 80 g to 800 g) that serves as an anchor, so as to ensure sufficient pressure or quality of the sound emitted from the mounting surface, such as a desk, with which the piezoelectric vibrator 60 is in contact.

As described below with reference to FIG. 7, the laminated piezoelectric element 61 is supplied with a sound signal (playback sound signal) from a control unit 130 via a piezoelectric element drive unit 120. In other words, voltage corresponding to a sound signal is applied to the laminated piezoelectric element 61 from the control unit 130 via the piezoelectric element drive unit 120. If the voltage applied from the control unit 130 is AC voltage, negative voltage is applied to the second lateral electrode 61*d* when positive voltage is applied to the first lateral electrode 61*c*. Conversely, positive voltage is applied to the second lateral electrode 61*d* when negative voltage is applied to the first lateral electrode 61*c*. Upon voltage being applied to the first lateral electrode 61*c* and the second lateral electrode 61*d*, polarization occurs in the dielectric materials 61*a*, and the laminated piezoelectric element 61 expands and contracts from the state in which no voltage is applied. The laminated piezoelectric element 61 expands and contracts in a direction substantially along the lamination direction of the dielectric materials 61*a* and the internal electrodes 61*b*. Alternatively, the laminated piezoelectric element 61 may expand and contract in a direction substantially matching the lamination direction of the dielectric materials 61*a* and the internal electrodes 61*b*. Having the laminated piezoelectric element 61 expand and contract substantially along the lamination direction yields the advantage of good vibration transmission efficiency in the expansion and contraction direction.

Figure 4:
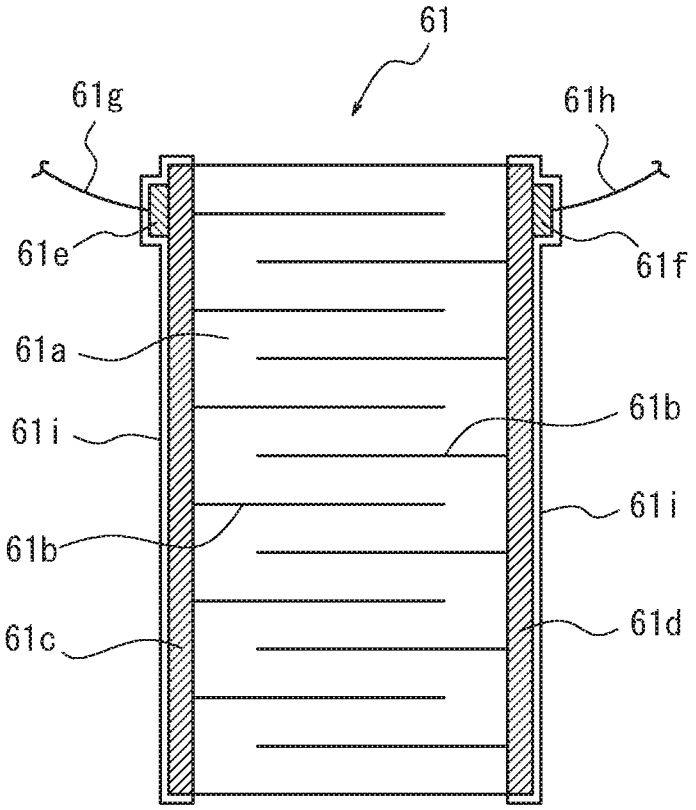
FIG. 4 illustrates a modification to the laminated piezoelectric element.

Note that in FIG. 3A and FIG. 3B, the first lateral electrode 61*c* and the second lateral electrode 61*d* may be through holes that are alternately connected to the internal electrodes 61*b* and respectively connected to the first lead connector 61*e* and second lead connector 61*f*. Furthermore, in FIG. 3A and FIG. 3B, the first lead connector 61*e* and the second lead connector 61*f* may, as illustrated in FIG. 4, be formed on the first lateral electrode 61*c* and the second lateral electrode 61*d* at one edge of the laminated piezoelectric element 61.

Figure 5:
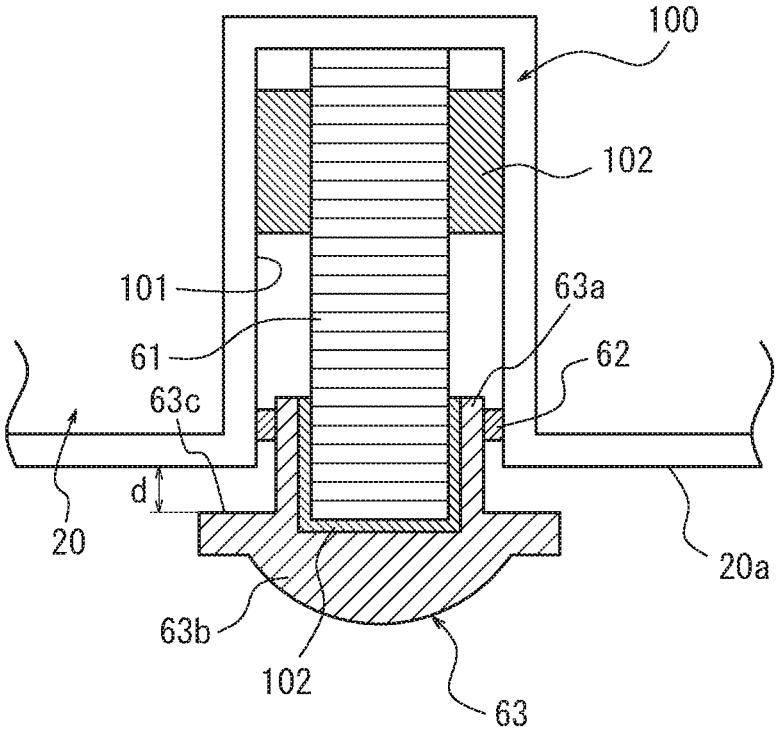
FIG. 5 is a partially enlarged cross-sectional view of the piezoelectric vibrator in FIG. 1.

As illustrated in the partially enlarged cross-sectional view in FIG. 5, the end of the laminated piezoelectric element 61 including the first lead connector 61*e* and the second lead connector 61*f* is fixed in the slit 101 of the holding unit 100 in the housing 20 via adhesive 102 (for example, epoxy resin). The cap 63 is inserted onto the other end of the laminated piezoelectric element 61 and fixed by adhesive 102.

The cap 63 is formed from a material, such as hard plastic or the like, that can reliably transmit the expanding and contracting vibration of the laminated piezoelectric element 61 to the mounting surface, such as a desk. In order to suppress scratching of the mounting surface, the cap 63 may be made from a relatively soft plastic instead of hard plastic. With the cap 63 mounted on the laminated piezoelectric element 61, an entering portion 63*a* located in the slit 101 and a protrusion 63*b* protruding from the housing 20 are formed in the cap 63. The O-ring 62 is disposed on the outer circumference of the entering portion 63*a* located in the slit 101. The O-ring 62 may, for example, be formed from silicone rubber. The O-ring 62 is for movably holding the laminated piezoelectric element 61 and also makes it difficult for moisture or dust to enter into the slit 101. The tip of the protrusion 63*b* is formed in a hemispherical shape. The tip of the protrusion 63*b* is not limited to being hemispherical, however, and may be any shape that reliably has point contact or surface contact with the mounting surface, such as a desk, and can transmit the expanding and contracting vibration of the laminated piezoelectric element 61 to the mounting surface. In FIG. 5, the space between the O-ring 62 and the portion of the laminated piezoelectric element 61 adhered to the slit 101 may be filled with gel or the like to increase the effect of dust and moisture protection. In a state in which the piezoelectric vibrator 60 is mounted in the holding unit 100 and the battery lid 21 is mounted on the housing 20, the protrusion 63*b* of the cap 63 protrudes from the bottom side 20*a* of the housing 20. The protrusion 63*b* of the cap 63 has an opposing face 63*c* that is a surface facing the bottom side 20*a* of the housing 20. As illustrated in FIG. 5, in a state in which no voltage is applied to the laminated piezoelectric element 61 so that the laminated piezoelectric element 61 is not expanding or contracting, the opposing face 63*c* is at a distance of d from the bottom side 20*a*.

Referring again to FIG. 2, the mobile phone 10 includes a stand 90 that is openable and closable with respect to the battery lid 21, i.e. the housing 20. The stand 90 includes a leg 91 and an attaching portion 92 acting as a pivot during opening and closing. In the present embodiment, while housed in the housing 20, the stand 90 includes the attaching portion 92 at a top side 20*b* of the housing 20 opposite the bottom side 20*a*, and the leg 91 extends towards the bottom side 20*a* along the transverse direction of the housing 20. A space 87 for housing the stand 90 included in the battery lid 21 is provided in the housing 20 of the mobile phone 10. When the mobile phone 10 is mounted on a horizontal mounting surface, such as a desk, with the bottom side 20*a* downwards, i.e. when stood horizontally, the mobile phone 10 is supported at two points on the mounting surface by the leg 91 and the piezoelectric vibrator 60. The arrangement of the piezoelectric vibrator 60 and the leg 91 is described in detail below.

Figure 6:
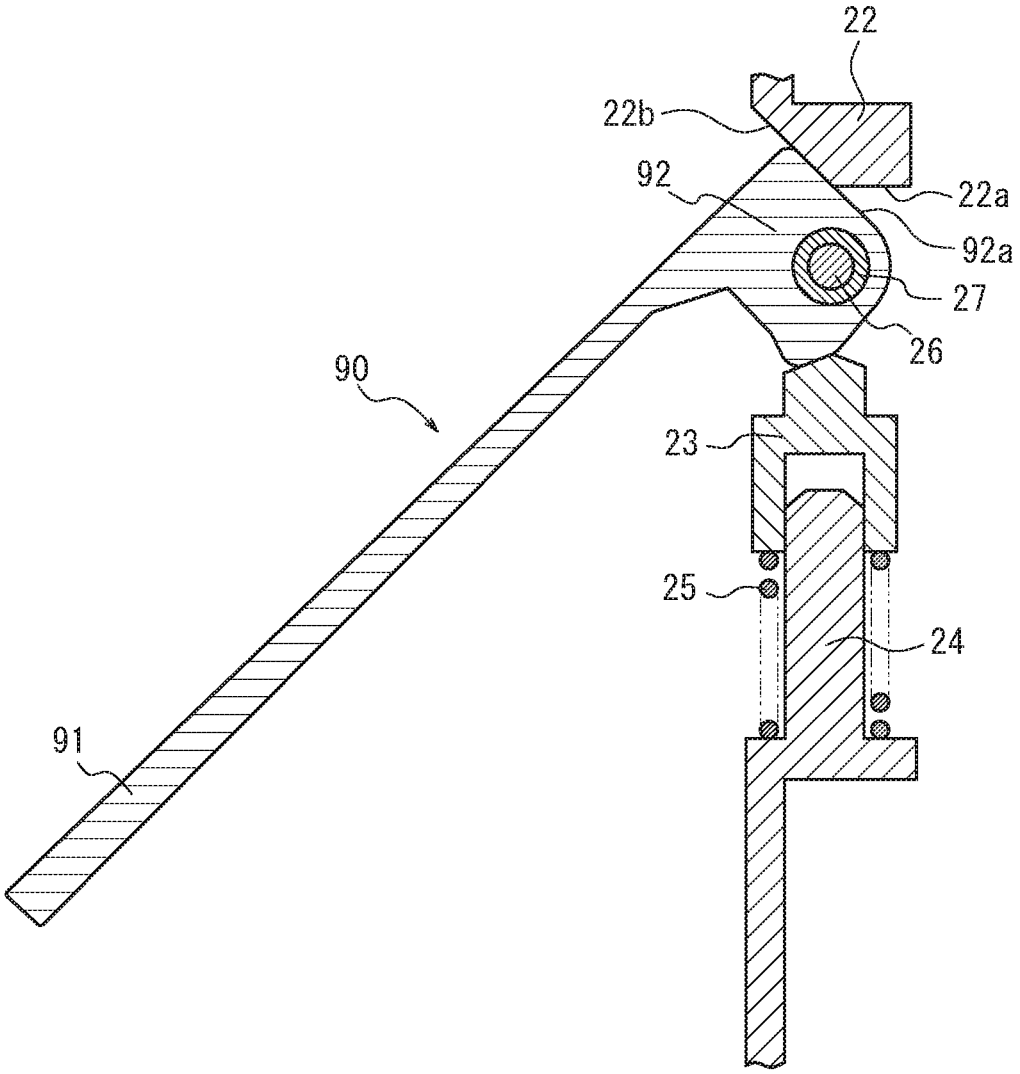
FIG. 6 is a partially enlarged cross-sectional view of the stand in FIG. 2.

The stand 90 may, for example, be made of metal, and as illustrated in the partially enlarged cross-sectional view in FIG. 6, at the attaching portion 92, the stand 90 is held by a rotating stopper 22 and a stand guide 23, which are part of the battery lid 21. An end face 92*a* of the attaching portion 92 contacts a rotating stopper face 22*a* or 22*b*. At the attaching portion 92, the stand 90 is opened and closed by being rotated, with a metal shaft 26 as the axis of rotation. An opening/closing operation of the stand 90 to bring the end face 92*a* into contact with the rotating stopper face 22*a* closes the stand 90 and houses it in the battery lid 21. An opening/closing operation of the stand 90 to bring the end face 92*a* into contact with the rotating stopper face 22*b* opens the stand 90 so that the stand 90 functions as a support member when mounting the mobile phone 10 on a mounting surface.

The stand guide 23 is held at the tip of a spring attaching portion 24, which is a portion of the battery lid 21, via a spring 25. The stand guide 23 can maintain the stand 90 in the open or closed state by transmitting pressure received from the spring 25 to the attaching portion 92. The circumference of the shaft 26 is covered by a shaft collar 27. The stand guide 23 and the shaft collar 27, which generate friction with the attaching portion 92 due to opening or closing of the attaching portion 92, may for example be made from a sliding resin, such as fluorinated plastic, polyacetal, nylon, or the like.

In the present embodiment, the axis of rotation of the attaching portion 92 is substantially parallel to the bottom side 20*a* of the housing 20. In this context, "substantially parallel" refers to being within a range of ±30° of an axis parallel to the bottom side 20*a*. When the axis of rotation exceeds this range, the leg 91 of the stand 90 is disposed diagonally within the battery lid 21. It thus becomes necessary to provide a space 87 conforming to the stand 90 in the housing 20 as well. By doing so, however, the space for housing other functional units provided in the housing 20 is limited, thereby worsening space efficiency. Hence, the axis of rotation of the attaching portion 92 is preferably substantially parallel, and more preferably parallel, to the bottom side 20*a*.

Figure 7:
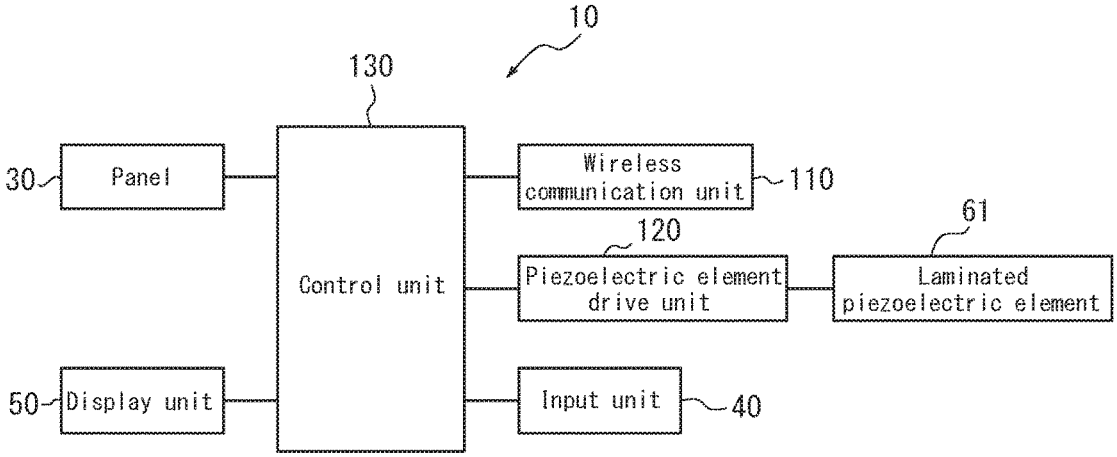
FIG. 7 is a functional block diagram of the main portions of the mobile phone in FIG. 1.

FIG. 7 is a functional block diagram of the main portions of the mobile phone 10. In addition to the above-described panel 30, input unit 40, display unit 50, and laminated piezoelectric element 61, the mobile phone 10 includes a wireless communication unit 110, the piezoelectric element drive unit 120, and the control unit 130. The panel 30, input unit 40, display unit 50, and wireless communication unit 110 connect to the control unit 130. The laminated piezoelectric element 61 connects to the control unit 130 via the piezoelectric element drive unit 120.

The wireless communication unit 110 may have a well-known structure and connects wirelessly to a communication network via a base station or the like. The control unit 130 is a processor that controls overall operations of the mobile phone 10. The control unit 130 applies a playback sound signal (voltage corresponding to a playback sound signal of the other party's voice, a ringtone, music including songs, or the like) to the laminated piezoelectric element 61 via the piezoelectric element drive unit 120. Note that the playback sound signal may be based on music data stored in internal memory or may be music data stored on an external server or the like and played back over a network.

Figure 8:
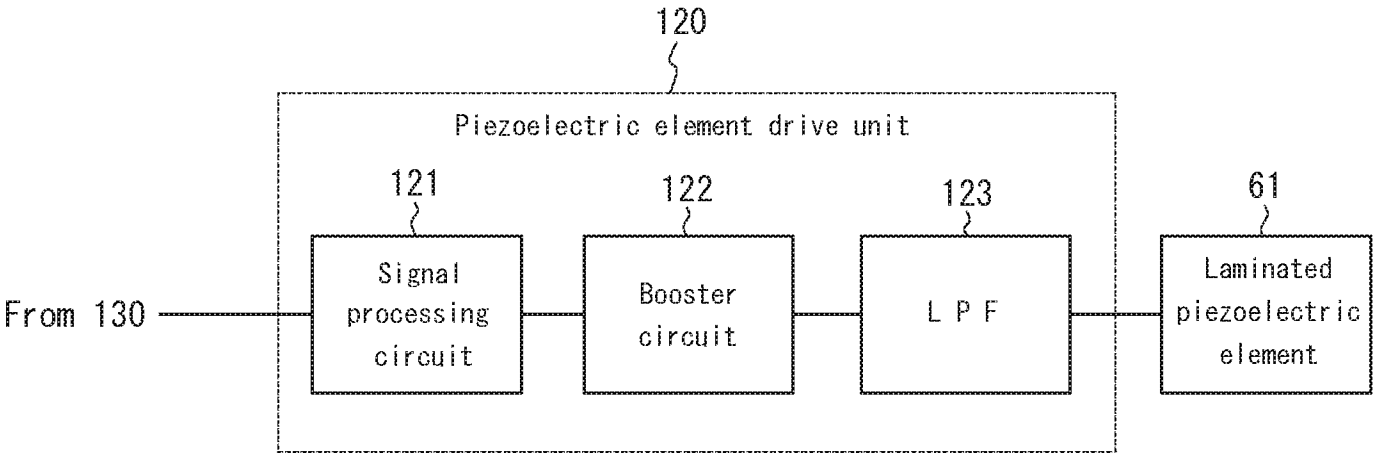
FIG. 8 is a functional block diagram illustrating the structure of an example of the piezoelectric element drive unit in FIG. 7.

For example as illustrated in FIG. 8, the piezoelectric element drive unit 120 includes a signal processing circuit 121, a booster circuit 122, and a low pass filter (LPF) 123. The signal processing circuit 121 may be configured using a digital signal processor (DSP) that includes an equalizer, A/D converter circuit, or the like and performs necessary signal processing, such as equalizing, D/A conversion, or the like on a digital signal from the control unit 130 to generate an analog playback sound signal, outputting the analog playback sound signal to the booster circuit 122. The functions of the signal processing circuit 121 may be internal to the control unit 130.

The booster circuit 122 boosts the voltage of the input analog playback sound signal and applies the result to the laminated piezoelectric element 61 via the LPF 123. The maximum voltage of the playback sound signal applied to the laminated piezoelectric element 61 by the booster circuit 122 may, for example, be from 10 Vpp to 50 Vpp, yet the voltage is not limited to this range and may be adjusted appropriately in accordance with the weight of the mobile phone 10 and the performance of the laminated piezoelectric element 61. For the playback sound signal applied to the laminated piezoelectric element 61, direct current may be biased, and the maximum voltage may be set centered on the bias voltage.

Figure 9:
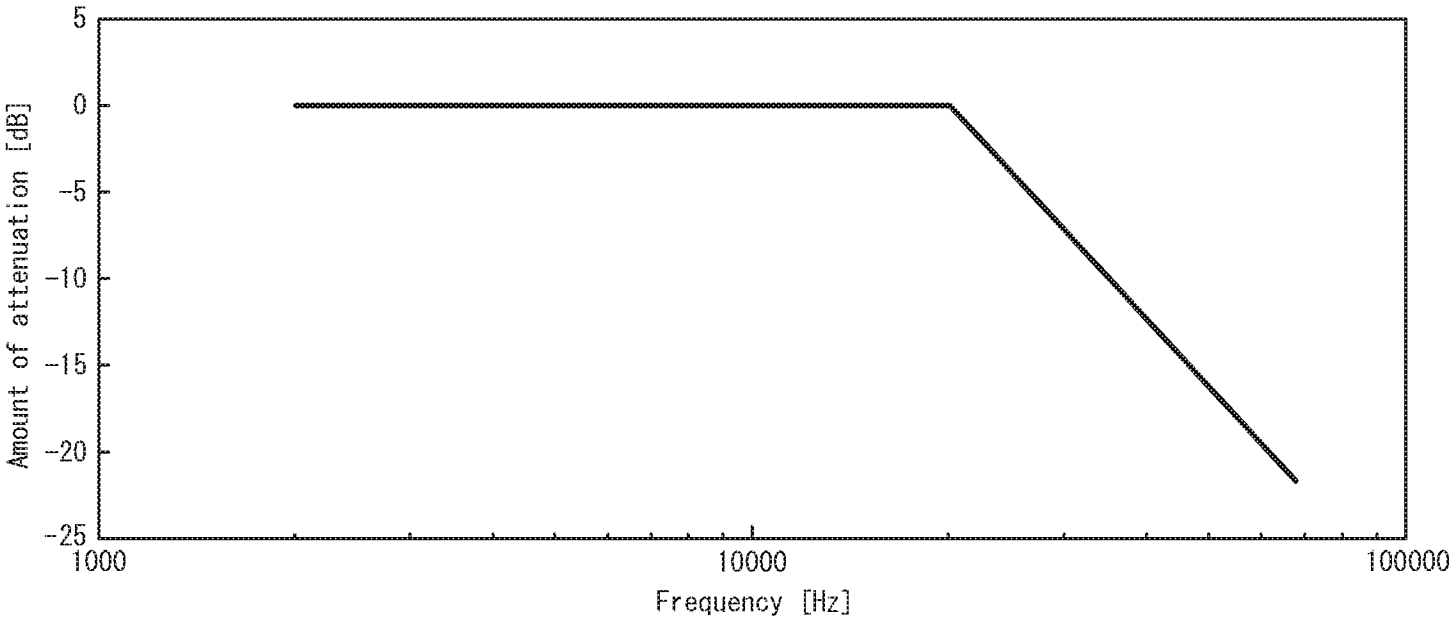
FIG. 9 illustrates an example of the frequency characteristic of the LPF in FIG. 8.

For piezoelectric elements in general, not just the laminated piezoelectric element 61, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 9 illustrates the frequency characteristic of the LPF 123 when the cutoff frequency is approximately 20 kHz. Thus attenuating or cutting the high-frequency component can suppress power consumption.

Figure 10:
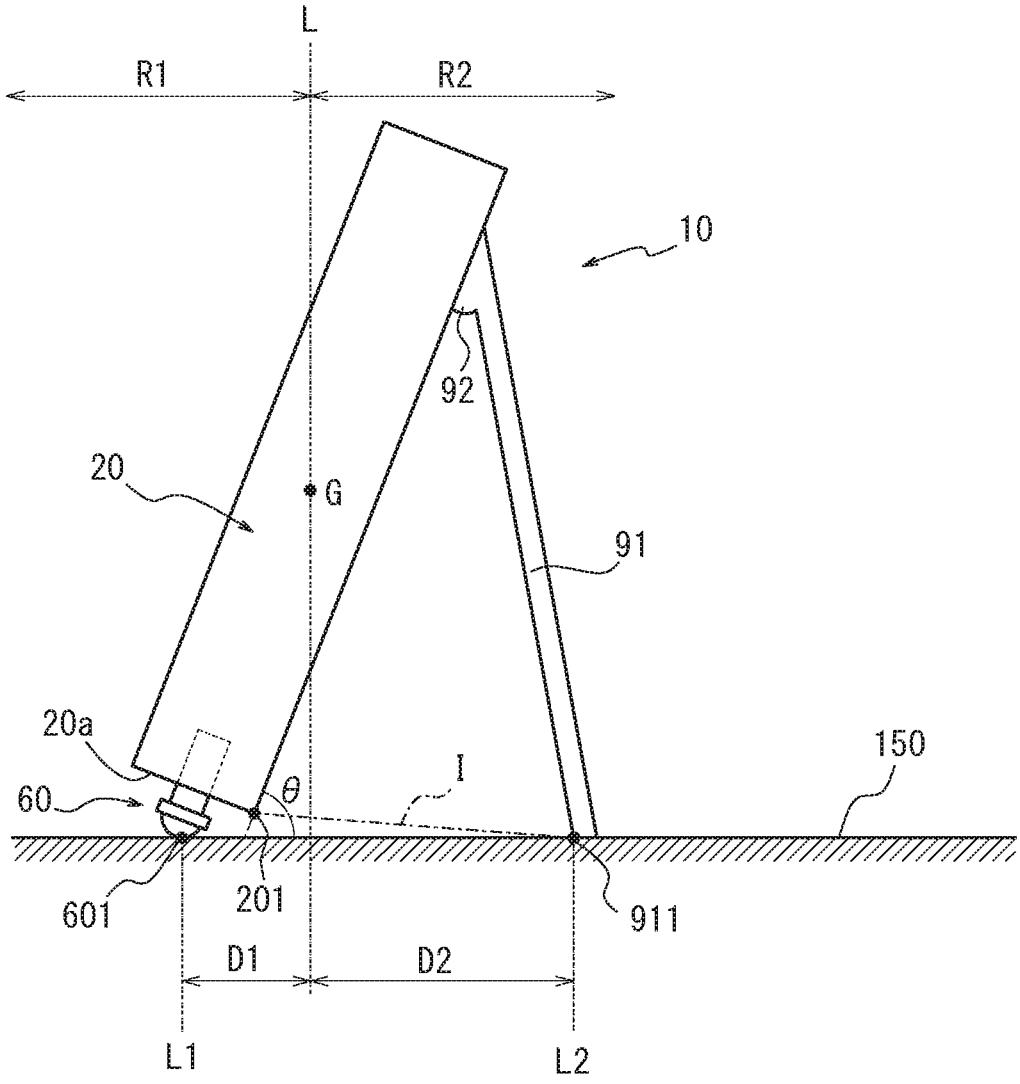
FIG. 10 illustrates the arrangement of the piezoelectric vibrator and the leg in the sound generator in FIG. 1.

Next, with reference to FIG. 10, the arrangement of the piezoelectric vibrator 60 and the leg 91 is described. FIG. 10 illustrates a state in which the mobile phone 10 is mounted on a horizontal mounting surface 150, such as a desk, with the bottom side 20*a* downwards. The desk referred to here is an example of a contacted member, and the mounting surface 150 is an example of a mounting surface that the sound generator contacts. As illustrated in FIG. 10, the mobile phone 10 is supported at two points on the mounting surface 150 by the leg 91 and the piezoelectric vibrator 60. Point G is the center of gravity of the mobile phone 10. In other words, the point G is the center of gravity of the anchor in the sound generator.

In FIG. 10, the leg 91 has a lowermost edge 911. The lowermost edge 911 is, within the leg 91, the location that abuts the horizontal mounting surface 150, such as a desk, when the mobile phone 10 is mounted on the mounting surface 150 with the bottom side 20*a* downwards.

The piezoelectric vibrator 60 has a lowermost edge 601. The lowermost edge 601 is, within the piezoelectric vibrator 60, the location that abuts the horizontal mounting surface 150, such as a desk, when the mobile phone 10 is mounted on the mounting surface 150 with the bottom side 20*a* downwards. The lowermost edge 601 is, for example, the tip of the cap 63.

The mobile phone 10 has a lowermost edge 201. The lowermost edge 201 is, within the mobile phone 10, the location that would abut the horizontal mounting surface 150, such as a desk, when the mobile phone 10 is mounted on the mounting surface 150 with the bottom side 20*a* downwards if the piezoelectric vibrator 60 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

In FIG. 10, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the bottom side 20*a* downwards. An alternate long and short dash line I is a line (virtual line) that connects the lowermost edge 911 of the leg 91 and the lowermost edge 201 of the mobile phone 10 assuming the piezoelectric vibrator 60 does not exist. A dashed line L1 is a line (virtual line) that traverses the lowermost edge 601 and is perpendicular to the mounting surface. A dashed line L2 is a line (virtual line) that traverses the lowermost edge 911 and is perpendicular to the mounting surface. The dashed line L1 is separated from the dashed line L in the horizontal direction by a distance of D1. The dashed line L2 is separated from the dashed line L in the horizontal direction by a distance of D2.

In FIG. 10, the region R2 is a region at one side of the mobile phone 10, separated by the dashed line L. The region R1 is a region at the other side of the mobile phone 10, separated by the dashed line L. The leg 91 is provided in the region R2. The piezoelectric vibrator 60 is provided on the bottom side 20*a* in the region R1.

In FIG. 10, the mobile phone 10 is supported at two points, by the leg 91 and the piezoelectric vibrator 60. Therefore, the sum of the load in the vertical direction on the lowermost edge 601 and on the lowermost edge 911 when the piezoelectric vibrator 60 is at rest is equivalent to the total weight of the mobile phone 10. As for the moment of force, the product of the load in the vertical direction on the lowermost edge 601 and the distance D1 is equivalent to the product of the load in the vertical direction on the lowermost edge 911 and the distance D2. Based on this fact, the load on the piezoelectric vibrator 60 increases as the piezoelectric vibrator 60 is disposed closer to the dashed line L. As a result, the piezoelectric vibrator 60 can provide strong vibration to the mounting surface 150, causing the mounting surface to emit good sound.

In other words, in the region R1, the piezoelectric vibrator 60 is preferably provided at a position as close as possible to the dashed line L. The load in the vertical direction on the piezoelectric vibrator 60 thus increases as compared to when the piezoelectric vibrator 60 is provided at a position distant from the dashed line L in the region R1. Hence, the mobile phone 10 can effectively be used as an anchor for the sound generator.

In the region R2, the lowermost edge 911 of the leg 91 is preferably provided at a position as far as possible from the dashed line L. A sufficient distance can thus be ensured between the leg 91 and the piezoelectric vibrator 60 even when the piezoelectric vibrator 60 is provided at a position as close as possible to the dashed line L. Hence, the sound generator can be stably mounted on the mounting surface 150. Since the leg 91 is connected to the housing 20 at the attaching portion 92, the angle θ between the housing 20 and the mounting surface 150 decreases as the distance D2 increases. If the angle θ becomes small, the vertical component of the load on the piezoelectric vibrator 60 decreases, and the vibration that the piezoelectric vibrator 60 provides to the mounting surface 150 weakens. Moreover, the horizontal component increases, yielding abnormal noise and causing the mobile phone 10 to jump or move sideways. Accordingly, the length of the stand 90, the angle at which the stand 90 opens, the position of the attaching portion 92 in the housing 20, and the like are appropriately determined taking into consideration the load on the piezoelectric vibrator 60 and the inclination of the housing 20 with respect to the mounting surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the mounting surface 150 from the alternate long and short dash line I. In this way, the mounting surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the mounting surface 150 from the alternate long and short dash line I. It is thus more difficult for the lowermost edge 201 of the mobile phone 10 to contact the mounting surface 150, which for example depending on the type of paint on the housing 20, makes it more difficult for the paint to peel off. Abnormal noise is also less likely to be emitted between the lowermost edge 201 and the mounting surface 150.

Figure 11A:
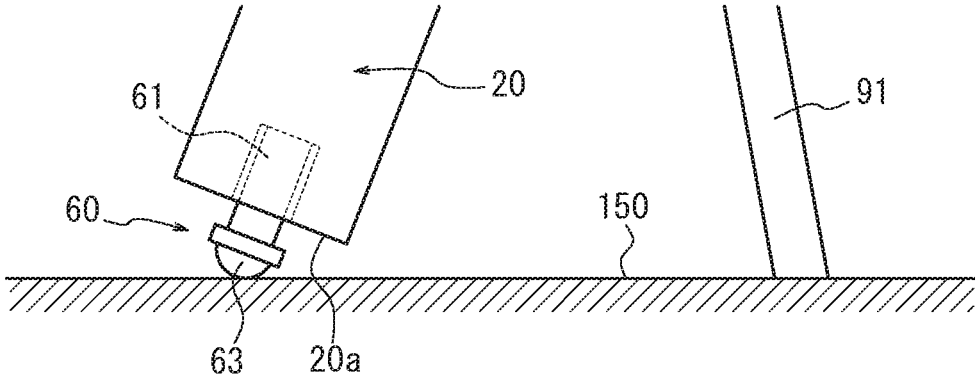
FIG. 11A schematically illustrates operation of the mobile phone in FIG. 1 as a sound generator.
Figure 11B:
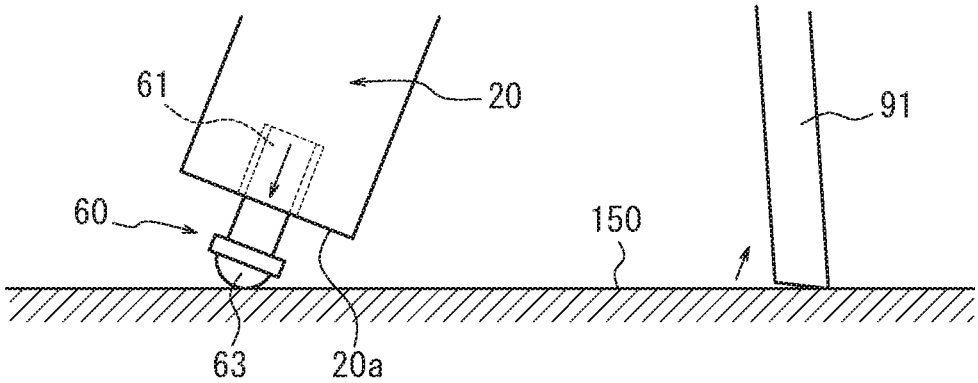
FIG. 11B schematically illustrates operation of the mobile phone in FIG. 1 as a sound generator.
Figure 11C:
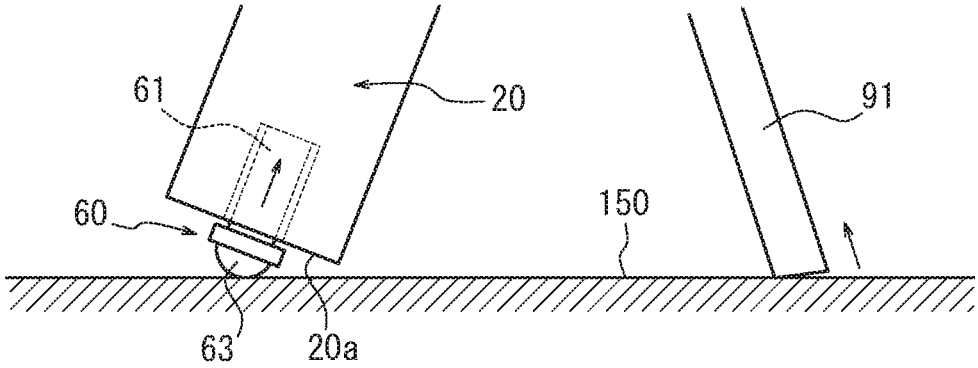
FIG. 11C schematically illustrates operation of the mobile phone in FIG. 1 as a sound generator.

FIGS. 11A, 11B, and 11C schematically illustrate operation of the mobile phone 10 as a sound generator. When causing the mobile phone 10 to function as a sound generator, the mobile phone 10 is stood horizontally with the bottom side 20*a* of the housing 20 downwards, so that the cap 63 of the piezoelectric vibrator 60 and the leg 91 contact the mounting surface 150, such as a desk, as illustrated in FIG. 11A. In this way, the weight of the mobile phone 10 is provided to the piezoelectric vibrator 60 as a load. In other words, the mobile phone 10 acts as an anchor for the sound generator according to the present disclosure. Note that in the state illustrated in FIG. 11A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting in accordance with the playback sound signal with the portion of the leg 91 contacting the mounting surface 150 acting as a pivot, and without the cap 63 separating from the mounting surface 150, as illustrated in FIGS. 11B and 11C. As long as problems such as the lowermost edge 201 contacting the mounting surface 150 and emitting abnormal noise do not occur, the cap 63 may separate slightly from the mounting surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 50 μm, vibration grows large, and the sound generator may wobble.

As described above, when the laminated piezoelectric element 61 is fully expanded, the tip of the cap 63 is preferably located towards the mounting surface 150 from a line (the alternate long and short dash line I in FIG. 10) connecting the lowermost edge 911 of the leg 91 and the lowermost edge 201 of the mobile phone 10 assuming the piezoelectric vibrator 60 does not exist. Furthermore, when the laminated piezoelectric element 61 is fully contracted, the tip of the cap 63 is preferably located towards the mounting surface 150 from this virtual line.

The distance d between the bottom side 20*a* and the opposing face 63*c* of the cap 63 illustrated in FIG. 5 is preferably greater than the amount of displacement when the laminated piezoelectric element 61 is fully contracted from a state in which no voltage is applied thereto so that the laminated piezoelectric element 61 is not expanding or contracting. In this way, it is difficult for the bottom side 20*a* of the housing 20 and the cap 63 to contact even when the laminated piezoelectric element 61 is fully contracted (the state in FIG. 11C). Accordingly, the cap 63 does not easily detach from the piezoelectric element 61.

The location at which the piezoelectric vibrator 60 is disposed on the bottom side 20*a*, the length of the laminated piezoelectric element 61 in the lamination direction, the dimensions of the cap 63, and the like are appropriately determined so as to satisfy the above conditions.

According to the sound generator of the present embodiment, a piezoelectric element is used as the source of vibration, hence reducing the number of components as compared to a vibration generating device having a dynamic speaker configuration and allowing for a simple structure with few components. Furthermore, the stack-type laminated piezoelectric element 61 is used as the piezoelectric element and vibrates by expanding and contracting along the lamination direction due to a playback sound signal. Since this expanding and contracting vibration is transmitted to the mounting surface 150, the vibration transmission efficiency with respect to the mounting surface 150 in the expansion and contraction direction (deformation direction) is good, and the mounting surface 150 can be vibrated efficiently. Moreover, since the laminated piezoelectric element 61 contacts the mounting surface 150 with the cap 63 therebetween, damage to the laminated piezoelectric element 61 can also be prevented. By standing the mobile phone 10 horizontally so that the cap 63 of the piezoelectric vibrator 60 contacts the mounting surface 150, the weight of the mobile phone 10 is applied as a load to the cap 63. Hence, the cap 63 can reliably contact the mounting surface 150, and the expanding and contracting vibration of the piezoelectric vibrator 60 can efficiently be transmitted to the mounting surface 150. In this way, even with a compact structure, the mobile phone 10 can cause good sound to be emitted from the mounting surface 150. When standing the mobile phone 10 horizontally, the mobile phone 10 can be stably self-supporting by being supported by the stand 90. Good sound can thus be continuously emitted from the mounting surface.

The sound generator according to the present embodiment can mainly transmit vibration of a laminated piezoelectric element directly to a mounting surface. Therefore, unlike when transmitting vibration of a laminated piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a piezoelectric element until the other elastic body returns to a state in which deformation is again possible. In light of this fact, the anchor of the sound generator according to the present embodiment preferably has enough stiffness (flexural strength) so as not to undergo flexing deformation due to deformation of the piezoelectric element.

Embodiment 2

Figure 12:
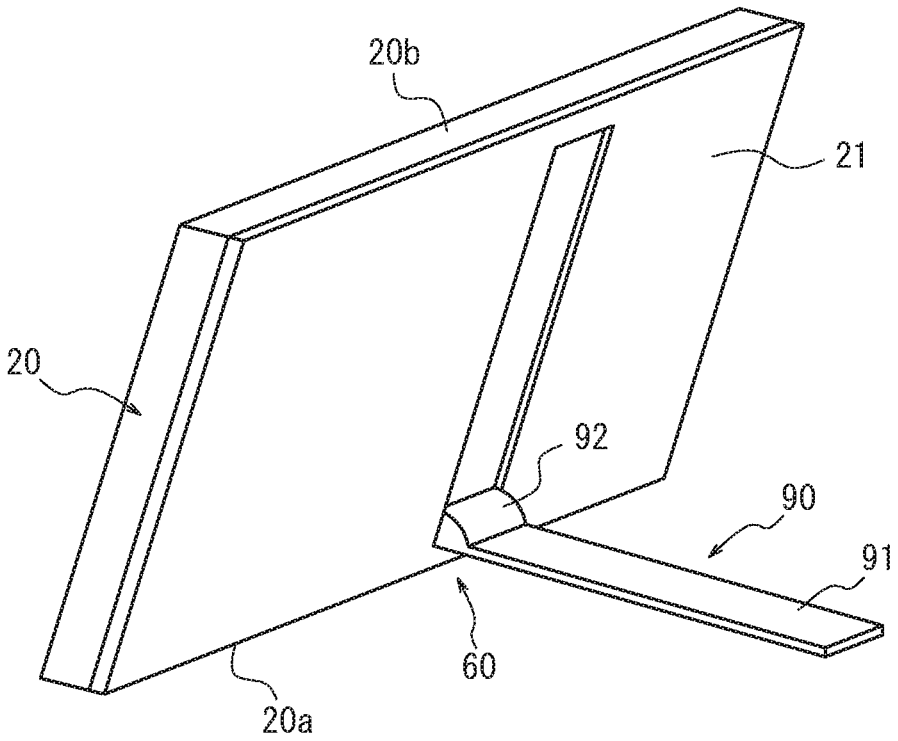
FIG. 12 is an external perspective view schematically illustrating the structure of a sound generator according to Embodiment 2 of the present disclosure.

FIG. 12 is an external perspective view schematically illustrating the structure of a sound generator according to Embodiment 2 of the present disclosure, showing a back view of a mobile phone 10, which is provided with a battery lid 21. In Embodiment 2 as well, the axis of rotation of the attaching portion 92 is substantially parallel to a bottom side 20*a* of a housing 20. In the present embodiment, however, while housed in the housing 20, a stand 90 includes an attaching portion 92 at the bottom side 20*a* of the housing 20, and a leg 91 extends towards the top side 20*b* along the transverse direction of the housing 20. The following describes the differences from Embodiment 1, omitting a description of common features.

Figure 13:
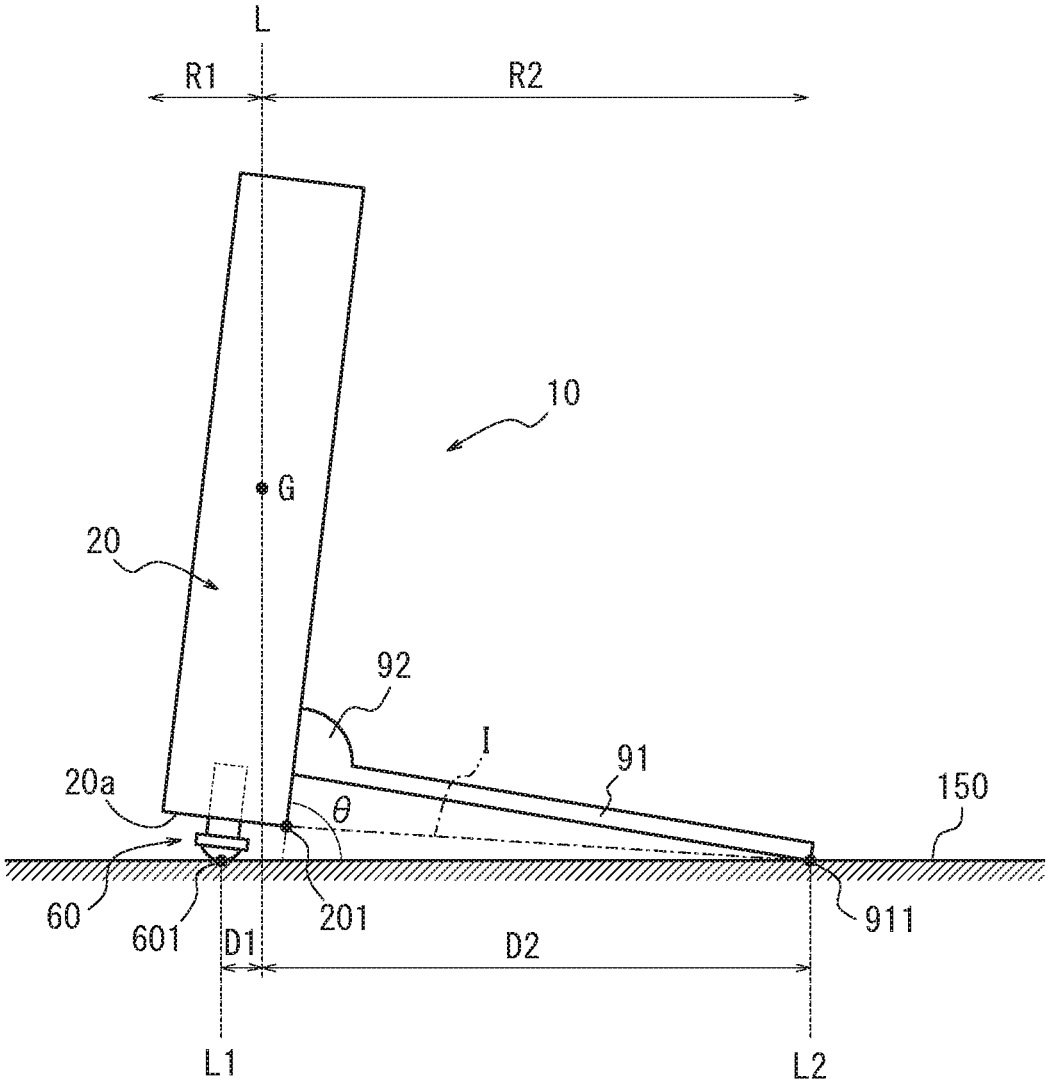
FIG. 13 illustrates the arrangement of the piezoelectric vibrator and the leg in the sound generator in FIG. 12.

Next, with reference to FIG. 13, the arrangement of a piezoelectric vibrator 60 and the leg 91 is described. Like FIG. 10, FIG. 13 illustrates a state in which the mobile phone 10 is mounted on a horizontal mounting surface 150, such as a desk, with the bottom side 20*a* downwards. As illustrated in FIG. 13, in a horizontally self-supporting state, the mobile phone 10 is supported at two points on the mounting surface 150 by the piezoelectric vibrator 60 and the leg 91. Point G is the center of gravity of the mobile phone 10. In other words, the point G is the center of gravity of the anchor in the sound generator.

In FIG. 13, as in FIG. 10, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the bottom side 20*a* downwards. A dashed line L1 is a line (virtual line) that traverses a lowermost edge 601 and is perpendicular to the mounting surface. A dashed line L2 is a line (virtual line) that traverses a lowermost edge 901 and is perpendicular to the mounting surface. The dashed line L1 is separated from the dashed line L in the horizontal direction by a distance of D1. The dashed line L2 is separated from the dashed line L in the horizontal direction by a distance of D2.

As described in Embodiment 1, in order to increase the load in the vertical direction applied to the piezoelectric vibrator 60, in the region R1, the piezoelectric vibrator 60 is preferably provided at a position as close as possible to the dashed line L. In other words, the angle θ that the housing 20 forms with the mounting surface 150 is preferably as close to a right angle as possible. In the region R2, the lowermost edge 911 of the leg 91 is preferably provided at a position as far as possible from the dashed line L. A sufficient distance can thus be ensured between the leg 91 and the piezoelectric vibrator 60 even when the piezoelectric vibrator 60 is provided at a position as close as possible to the dashed line L. Hence, the sound generator can be stably mounted on the mounting surface 150.

According to the present embodiment, the attaching portion 92 is positioned towards the bottom side 20*a*, making it easy to separate the lowermost edge 911 of the leg 91 from the dashed line L. Hence, the mobile phone 10 can easily be mounted stably on the mounting surface. Furthermore, by providing the lowermost edge 911 at a position far from the dashed line L, the load in the vertical direction on the lowermost edge 911 decreases, allowing for an increase in the load in the vertical direction on the lowermost edge 601. As a result, even with a compact structure for the mobile phone 10, the piezoelectric vibrator 60 can efficiently transmit vibration to the mounting surface 150, thus causing better sound to be emitted from the mounting surface 150.

Embodiment 3

Figure 14:
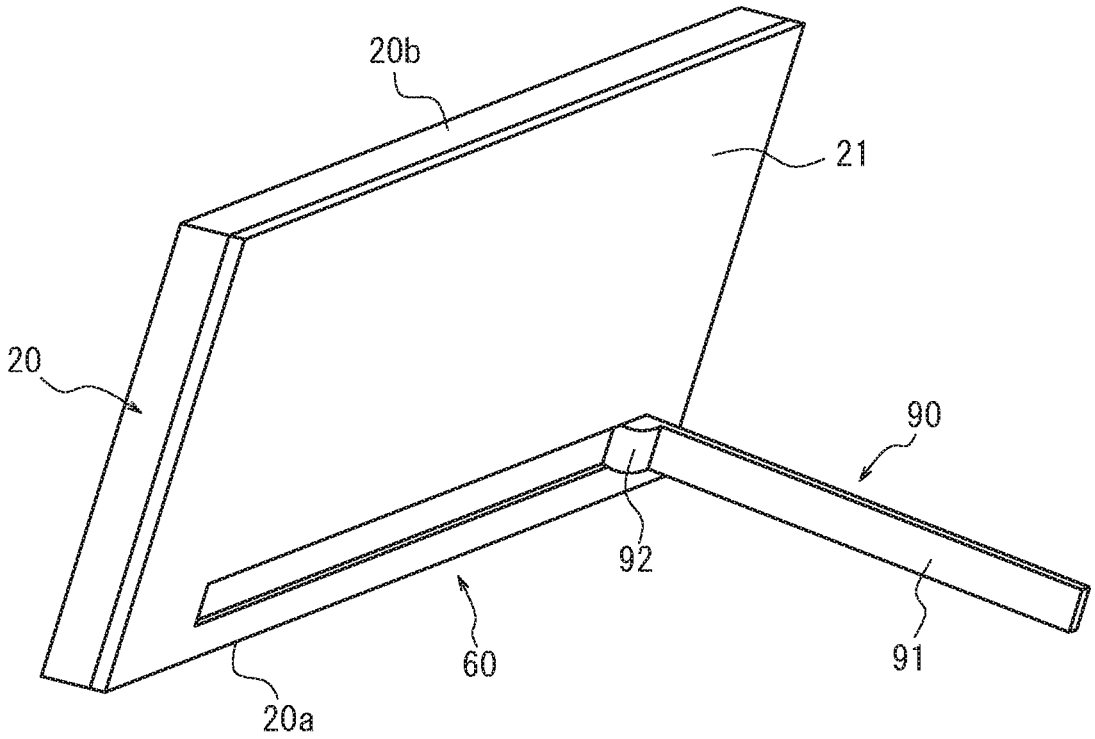
FIG. 14 is an external perspective view schematically illustrating the structure of a sound generator according to Embodiment 3 of the present disclosure.

FIG. 14 is an external perspective view schematically illustrating the structure of a sound generator according to Embodiment 3 of the present disclosure, showing a back view of a mobile phone 10, which is provided with a battery lid 21. In Embodiment 3, as illustrated in FIG. 14, the axis of rotation of an attaching portion 92 is substantially perpendicular to a bottom side 20*a* of a housing 20. In this context, "substantially perpendicular" refers to being within a range of ±30° of an axis perpendicular to the bottom side 20*a*. If this range is exceeded, the space for housing other functional units provided in the housing 20 is limited, thereby worsening space efficiency. Hence, the axis of rotation of the attaching portion 92 is preferably substantially perpendicular, and more preferably perpendicular, to the bottom side 20*a*. In the present embodiment, while housed in the housing 20, the stand 90 includes the attaching portion at one side of the housing 20, and a leg 91 extends towards the other side along the longitudinal direction of the housing. The following describes the differences from Embodiment 1, omitting a description of common features.

Figure 15:
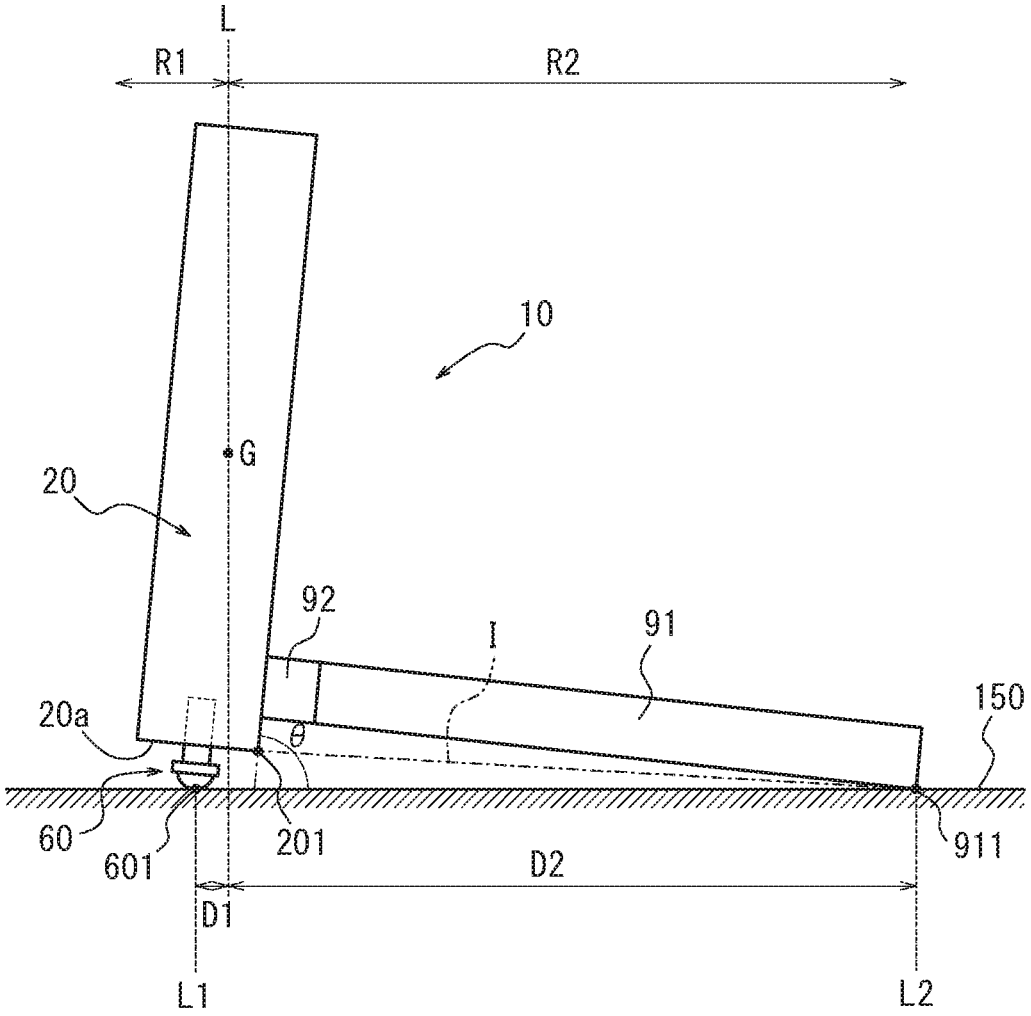
FIG. 15 illustrates the arrangement of the piezoelectric vibrator and the leg in the sound generator in FIG. 14.

Next, with reference to FIG. 15, the arrangement of a piezoelectric vibrator 60 and the leg 91 is described. Like FIG. 10, FIG. 15 illustrates a state in which the mobile phone 10 is mounted on a horizontal mounting surface 150, such as a desk, with the bottom side 20*a* downwards. As illustrated in FIG. 15, in a horizontally self-supporting state, the mobile phone 10 is supported at two points on the mounting surface 150 by the piezoelectric vibrator 60 and the leg 91. Point G is the center of gravity of the mobile phone 10. In other words, the point G is the center of gravity of the anchor in the sound generator.

In FIG. 15, as in FIG. 10, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the bottom side 20*a* downwards. A dashed line L1 is a line (virtual line) that traverses a lowermost edge 601 and is perpendicular to the mounting surface. A dashed line L2 is a line (virtual line) that traverses a lowermost edge 901 and is perpendicular to the mounting surface. The dashed line L1 is separated from the dashed line L in the horizontal direction by a distance of D1. The dashed line L2 is separated from the dashed line L in the horizontal direction by a distance of D2.

As described in Embodiment 1, in order to increase the load in the vertical direction applied to the piezoelectric vibrator 60, in the region R1, the piezoelectric vibrator 60 is preferably provided at a position as close as possible to the dashed line L. In other words, the angle θ that the housing 20 forms with the mounting surface 150 is preferably as close to a right angle as possible. In the present embodiment, the axis of rotation of the attaching portion 92 is perpendicular to the bottom side 20*a*. Therefore, the angle θ easily approaches a right angle as the attaching portion 92 is provided at a position in the housing 20 closer to the bottom side 20*a*.

The lowermost edge 911 of the leg 91 is preferably provided at a position as far as possible from the dashed line L. A sufficient distance can thus be ensured between the leg 91 and the piezoelectric vibrator 60 even when the piezoelectric vibrator 60 is provided at a position as close as possible to the dashed line L. Hence, the sound generator can be stably mounted on the mounting surface 150. Furthermore, as the lowermost edge 911 is provided at a position farther from the dashed line L, the load in the vertical direction on the lowermost edge 911 decreases, allowing for an increase in the load in the vertical direction on the lowermost edge 601. As a result, even with a compact structure for the mobile phone 10, the piezoelectric vibrator 60 can efficiently transmit vibration to the mounting surface 150, thus causing better sound to be emitted from the mounting surface 150.

In the present embodiment, while the stand 90 is housed in the housing 20, the leg 91 extends along the longitudinal direction of the housing 20. Hence, a sufficient length can easily be secured for the leg 91 as compared to Embodiment 1. Therefore, the mobile phone 10 can easily be mounted stably on the mounting surface. Furthermore, by providing the lowermost edge 911 at a position far from the dashed line L, the load in the vertical direction on the lowermost edge 911 decreases, allowing for an increase in the load in the vertical direction on the lowermost edge 601. As a result, the piezoelectric vibrator 60 can efficiently transmit vibration to the mounting surface 150, thereby causing the mounting surface 150 to emit better sound.

Embodiment 4

Figure 16:
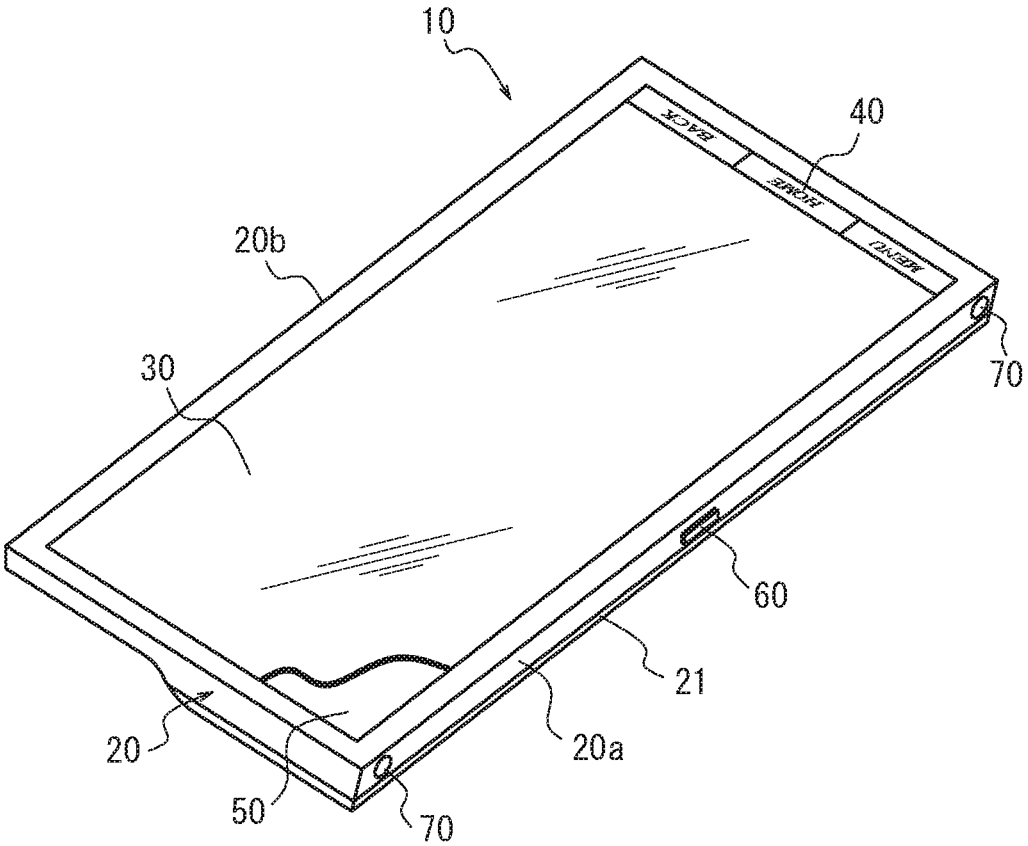
FIG. 16 is an external perspective view schematically illustrating the structure of a sound generator according to Embodiment 4 of the present disclosure.

FIG. 16 is an external perspective view schematically illustrating the structure of a sound generator according to Embodiment 4 of the present disclosure. The sound generator according to the present embodiment includes a mobile phone 10, such as a smartphone, a piezoelectric vibrator 60, and two elastic members 70. As described below, the mobile phone 10 acts as an anchor (the anchor in the sound generator) providing a load to the piezoelectric vibrator 60. The mobile phone 10 includes a housing 20. In the housing 20, a panel 30 and an input unit 40 are provided at the front side of the mobile phone 10, and as illustrated by the partial cutout of the panel 30 in FIG. 16, a display unit 50 is held below the panel 30. In the present embodiment, to simplify explanation, the mobile phone 10 is a phablet, i.e. a large-scale smartphone (the panel 30 being, for example, from 5 inches to 7 inches). The following describes the differences from Embodiment 1, omitting a description of common features.

The housing 20 has an approximately rectangular external shape. The thickness of the housing 20 at a bottom side 20*a*, positioned at the bottom when the mobile phone 10 is stood horizontally, is greater than the thickness of the housing 20 at a top side 20*b* opposite the bottom side 20*a*. A battery, such as a lithium-ion battery, lithium polymer battery, fuel cell, or the like is installed at the back side of the housing 20 towards the bottom side 20*a* and is covered by a battery lid 21.

The sound generator according to the present embodiment includes the piezoelectric vibrator 60 for a sound generator and sheet-like elastic members 70 on the bottom side 20*a* of the housing 20. The elastic members 70 may, for example, be formed from rubber, silicone, polyurethane, or the like. When the mobile phone 10 is mounted on a horizontal mounting surface, such as a desk, with the bottom side 20*a* downwards, i.e. when stood horizontally, the mobile phone 10 is supported at three points on the mounting surface by the piezoelectric vibrator 60 and the two elastic members 70. The arrangement of the piezoelectric vibrator 60 and the elastic members 70 is described in detail below.

Figure 17:
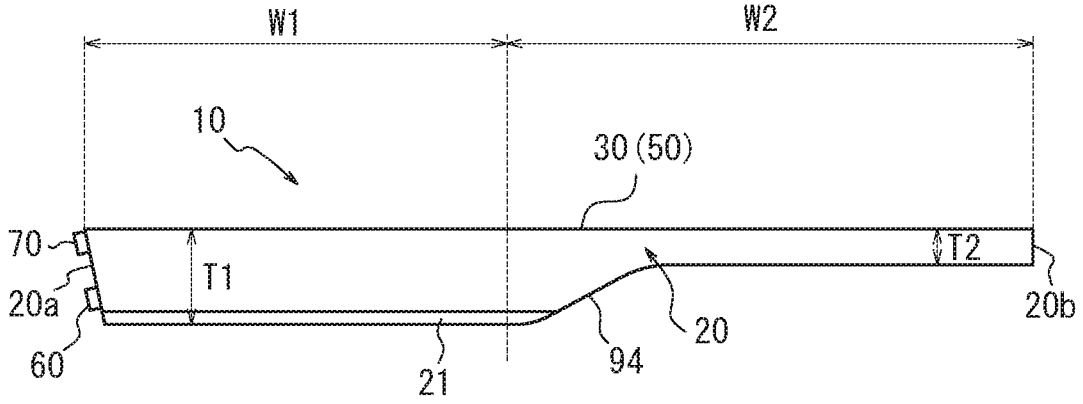
FIG. 17 is a schematic side view of the sound generator in FIG. 16.

FIG. 17 is a schematic side view of the sound generator in FIG. 16. When the mobile phone 10 is mounted on the mounting surface, the bottom side 20*a* is inclined with respect to the thickness direction of the housing 20, as illustrated in FIG. 17, so that the display unit 50 faces diagonally upward. A thickness T1 of the housing 20 at the bottom side 20*a* is greater than a thickness T2 of the housing 20 at the top side 20*b*. The housing 20 includes a first region W1, towards the bottom side 20*a*, with the predetermined thickness T1 and a second region W2, towards the top side 20*b*, that is thinner than the thickness T1. In the region W2, the housing 20 includes an inclined portion 94 that is a portion transitioning from the thickness T1 to the thickness T2.

The first region W1 has the function of a holding unit (grip) when the user operates the mobile phone 10 while holding the mobile phone 10 in the left hand. For example, the user can hold the mobile phone 10 by placing the battery lid 21 in the palm of the left hand, holding down the panel 30 near the bottom side 20*a* with the pad of the left thumb, and pressing the inclined portion 94 with the tip of the left middle finger.

In this way, when the user holds the mobile phone 10 in the left hand, the base of the user's left thumb presses the battery lid 21 near the bottom side 20*a*, and the first joint of the left thumb presses along the edge where the bottom side 20*a* and the front side of the housing 20 meet. Therefore, to allow the user to stably hold the mobile phone 10, the thickness T1 is preferably equal to or less than the length from the root of the thumb to the first joint of the thumb. For example, the thickness T1 may be 50 mm or less. The width of the first region W1 is preferably equal to or less than the length from the base of the thumb to the tip of the middle finger. For example, the width of the first region W1 may be 150 mm or less.

Figure 18:
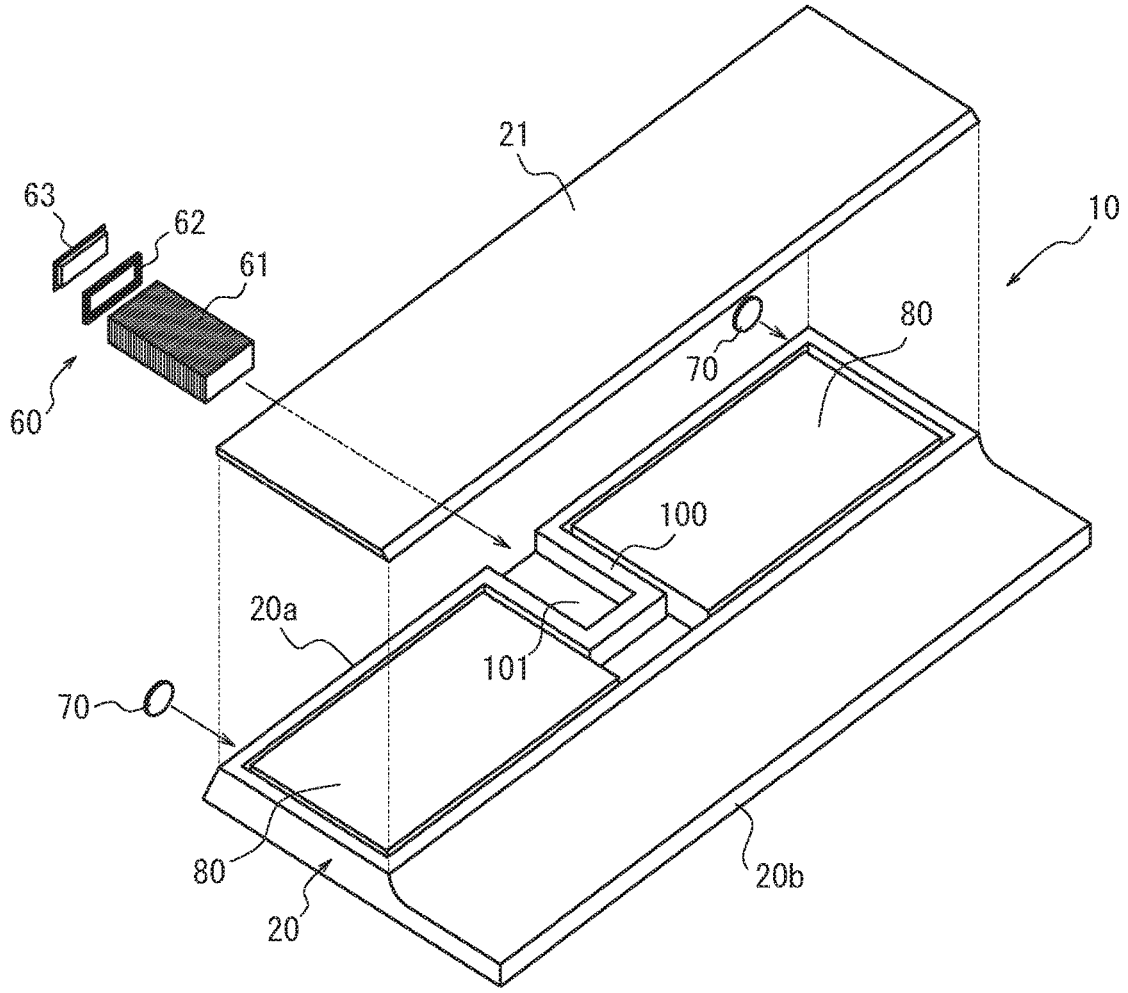
FIG. 18 is an exploded perspective view schematically illustrating the main parts at the back side of the mobile phone in FIG. 16.

FIG. 18 is an exploded perspective view schematically illustrating the main parts at the back side of the mobile phone 10 in FIG. 16. At the back side of the housing 20, a plurality of batteries 80 (two in FIG. 18) are installed. At the bottom side 20*a* of the housing 20, the mobile phone 10 includes a holding unit 100 that houses and holds the piezoelectric vibrator 60. The holding unit 100 includes a slit 101, with a uniform width, that extends in a substantially perpendicular direction when the mobile phone 10 is mounted on a mounting surface with the bottom side 20*a* downwards and that opens to the bottom side 20*a*. In other words, in the present embodiment, the piezoelectric vibrator 60 is disposed between the plurality of batteries 80.

Figure 19:
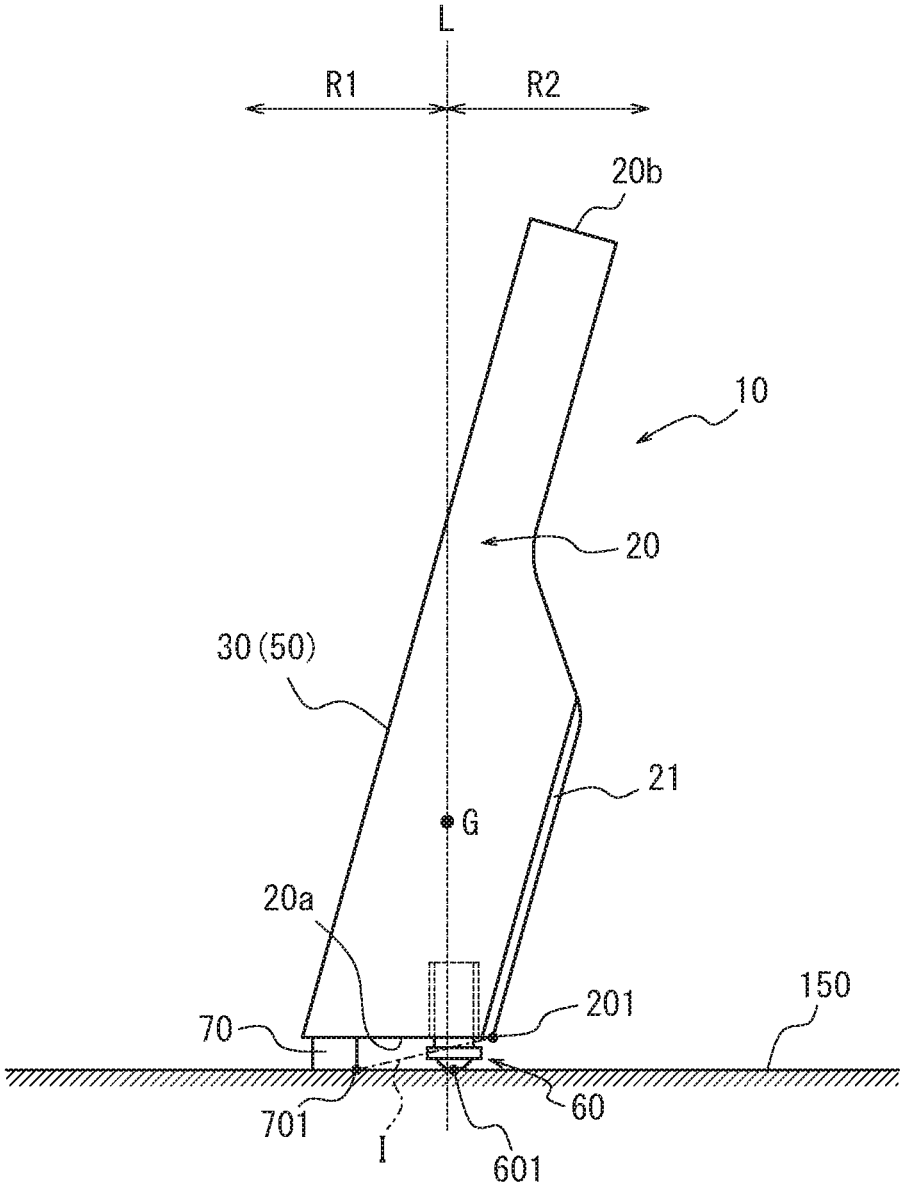
FIG. 19 illustrates the arrangement of the piezoelectric vibrator and the elastic member in the sound generator in FIG. 16.

Next, with reference to FIG. 19, the arrangement of the piezoelectric vibrator 60 and the elastic members 70 is described. FIG. 19 illustrates a state in which the mobile phone 10 is mounted on a horizontal mounting surface 150, such as a desk, with the bottom side 20*a* downwards. The desk referred to here is an example of a contacted member, and the mounting surface 150 is an example of a mounting surface on which the sound generator is mounted. As illustrated in FIG. 19, the mobile phone 10 is supported at three points on the mounting surface 150 by the piezoelectric vibrator 60 and the two elastic members 70. When the mobile phone 10 is mounted on the mounting surface 150, the display unit 50 faces diagonally upward. Point G is the center of gravity of the mobile phone 10. In other words, the point G is the center of gravity of the anchor in the sound generator.

The mobile phone 10 can be structured so that, when mounted on the mounting surface 150 as in FIG. 19, the center of gravity G is positioned towards the bottom side 20*a* from an intermediate position between the bottom side 20*a* and the top side 20*b*. In order for the center of gravity G of the mobile phone 10 to be positioned towards the bottom side 20*a* from the intermediate position, the center of gravity of the batteries 80 provided in the housing 20 may be positioned towards the bottom side 20*a* from the intermediate position. Lowering the center of gravity of the batteries 80 makes it easier to lower the center of gravity G of the mobile phone 10. As a result, the mobile phone 10 can stably be mounted on the mounting surface 150.

In FIG. 19, the elastic members 70 each have a lowermost edge 701. The lowermost edge 701 is, within the elastic member 70, the location that abuts the horizontal mounting surface 150, such as a desk, when the mobile phone 10 is mounted on the mounting surface 150 with the bottom side 20*a* downwards.

The piezoelectric vibrator 60 has a lowermost edge 601. The lowermost edge 601 is, within the piezoelectric vibrator 60, the location that abuts the horizontal mounting surface 150, such as a desk, when the mobile phone 10 is mounted on the mounting surface 150 with the bottom side 20*a* downwards. The lowermost edge 601 is, for example, the tip of the cap 63.

The mobile phone 10 has a lowermost edge 201. The lowermost edge 201 is, within the mobile phone 10, the location that would abut the horizontal mounting surface 150, such as a desk, when the mobile phone 10 is mounted on the mounting surface 150 with the bottom side 20*a* downwards if the piezoelectric vibrator 60 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

In FIG. 19, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the bottom side 20*a* downwards. The dashed line L intersects the bottom side 20*a* of the housing 20. In this way, even when the entire housing 20 is inclined so that the display unit 50 faces diagonally upward, as in FIG. 19, the mobile phone 10 can be made self-supporting without using a stand. An alternate long and short dash line I is a line (virtual line) that connects the lowermost edge 701 of the elastic member 70 and the lowermost edge 201 of the mobile phone 10 assuming the piezoelectric vibrator 60 does not exist.

In FIG. 19, the region R1 is a region at one side of the mobile phone 10, separated by the dashed line L. The region R2 is a region at the other side of the mobile phone 10, separated by the dashed line L. The elastic members 70 are provided on the bottom side 20*a* in the region R1. The lowermost edge 601 is provided on the bottom side 20*a* in the region R2.

In the region R2 of the bottom side 20*a*, the lowermost edge 601 is preferably provided at a position as close as possible to the dashed line L. The load on the piezoelectric vibrator 60 thus increases as compared to when the piezoelectric vibrator 60 is provided at a position distant from the dashed line L on the bottom side 20*a* in the region R2. Hence, the mobile phone 10 can effectively be used as an anchor for the sound generator.

In the region R1 of the bottom side 20*a*, the elastic members 70 are preferably provided at positions as far as possible from the dashed line L. A sufficient distance can thus be ensured between the elastic members 70 and the piezoelectric vibrator 60 even when the piezoelectric vibrator 60 is placed at a position as close as possible to the dashed line L. Hence, the sound generator can be stably mounted on the mounting surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the mounting surface 150 from the alternate long and short dash line I. In this way, the mounting surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the mounting surface 150 from the alternate long and short dash line I. It is thus more difficult for the lowermost edge 201 of the mobile phone 10 to contact the mounting surface 150, which for example depending on the type of paint on the housing 20, makes it more difficult for the paint to peel off. Abnormal noise is also less likely to be emitted between the lowermost edge 201 and the mounting surface 150.

Figure 20A:
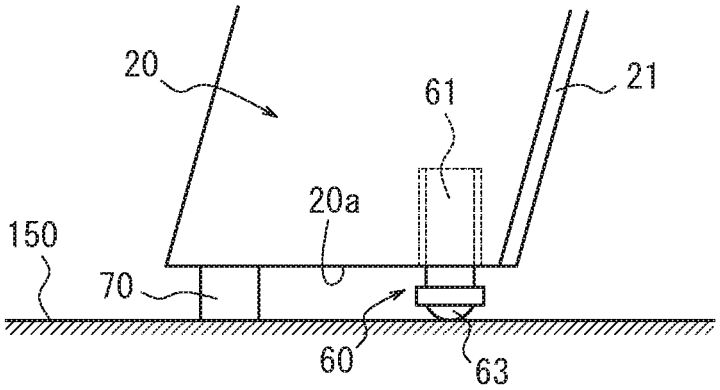
FIG. 20A schematically illustrates operation of the mobile phone in FIG. 16 as a sound generator.
Figure 20B:
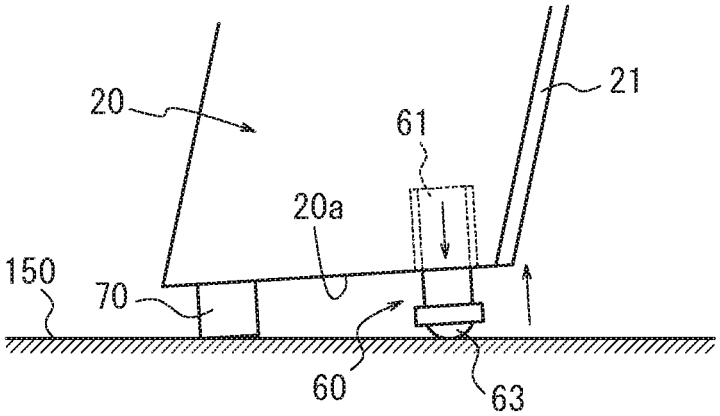
FIG. 20B schematically illustrates operation of the mobile phone in FIG. 16 as a sound generator.
Figure 20C:
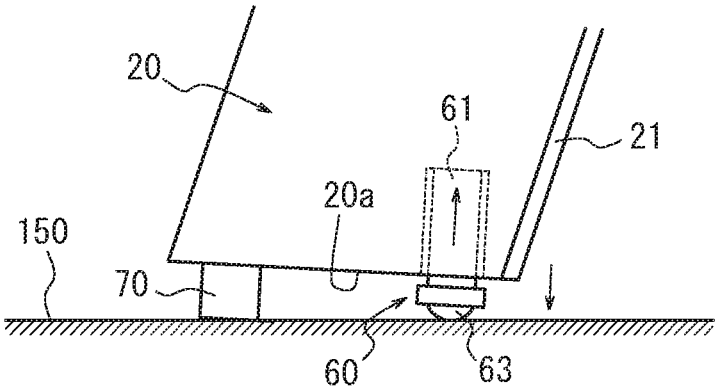
FIG. 20C schematically illustrates operation of the mobile phone in FIG. 16 as a sound generator.

FIGS. 20A, 20B, and 20C schematically illustrate operation of the mobile phone 10 as a sound generator. When causing the mobile phone 10 to function as a sound generator, the mobile phone 10 is stood horizontally with the bottom side 20*a* of the housing 20 downwards, so that the cap 63 of the piezoelectric vibrator 60 and the elastic members 70 contact the mounting surface 150, such as a desk, as illustrated in FIG. 20A. In this way, the weight of the mobile phone 10 is provided to the piezoelectric vibrator 60 as a load. In other words, the mobile phone 10 acts as an anchor for the sound generator according to the present disclosure. Note that in the state illustrated in FIG. 20A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting in accordance with the playback sound signal with the portions of the elastic members 70 contacting the mounting surface 150 acting as a pivot, and without the cap 63 separating from the mounting surface 150, as illustrated in FIGS. 20B and 20C. As long as problems such as the lowermost edge 201 contacting the mounting surface 150 and emitting abnormal noise do not occur, the cap 63 may separate slightly from the mounting surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 50 μm, vibration grows large, and the sound generator may wobble.

As described above, when the laminated piezoelectric element 61 is fully expanded, the tip of the cap 63 is preferably located towards the mounting surface 150 from a line (the alternate long and short dash line I in FIG. 19) connecting the lowermost edge 701 of the elastic member 70 and the lowermost edge 201 of the mobile phone 10 assuming the piezoelectric vibrator 60 does not exist. Furthermore, when the laminated piezoelectric element 61 is fully contracted, the tip of the cap 63 is preferably located towards the mounting surface 150 from this virtual line.

In the sound generator of the present embodiment, a piezoelectric element is used as the source of vibration, hence reducing the number of components as compared to a vibration generating device having a dynamic speaker configuration and allowing for a simple structure with few components. Furthermore, the stack-type laminated piezoelectric element 61 is used as the piezoelectric element and vibrates by expanding and contracting along the lamination direction due to a playback sound signal. Since this expanding and contracting vibration is transmitted to the mounting surface 150, the vibration transmission efficiency with respect to the mounting surface 150 in the expansion and contraction direction (deformation direction) is good, and the mounting surface 150 can be vibrated efficiently. Moreover, since the laminated piezoelectric element 61 contacts the mounting surface 150 with the cap 63 therebetween, damage to the laminated piezoelectric element 61 can also be prevented. By standing the mobile phone 10 horizontally so that the cap 63 of the piezoelectric vibrator 60 contacts the mounting surface 150, the weight of the mobile phone 10 is applied as a load to the cap 63. Hence, the cap 63 can reliably contact the mounting surface 150, and the expanding and contracting vibration of the piezoelectric vibrator 60 can efficiently be transmitted to the mounting surface 150. The mobile phone 10 can thus cause the mounting surface 150 to emit good sound.

Furthermore, according to the sound generator of the present embodiment, the bottom side 20*a* of the mobile phone 10 intersects a line that traverses the center of gravity G and that is perpendicular to the horizontal mounting surface 150, such as a desk, when the mobile phone 10 is mounted on the mounting surface 150 with the bottom side 20*a* downwards. Even when the mobile phone 10 is inclined, the mobile phone 10 can therefore be made self-supporting without using a stand. Hence, an operation such as to deploy a kickstand is unnecessary to make the mobile phone 10 self-supporting. Since the mobile phone 10 can be made self-supporting, the load of the mobile phone 10 can also be applied efficiently to the piezoelectric vibrator 60 without support by a kickstand or the like. Vibration of the piezoelectric element 61 can thus be transmitted efficiently to the mounting surface 150. By positioning the center of gravity G of the mobile phone 10 towards the bottom side 20*a* from the intermediate position between the bottom side 20*a* and the top side 20*b*, the mobile phone 10 can stably be made self-supporting. In particular, since the thickness at the bottom side 20*a* is greater than the thickness at the top side 20*b*, the center of gravity G can easily be positioned towards the bottom side 20*a*. Furthermore, by positioning the center of gravity G towards the thicker bottom side 20*a*, as described above, the bottom side 20*a* becomes a holding unit (grip) when the user holds the mobile phone 10, thus allowing the user to hold the mobile phone 10 easily. As a result, the user can operate the mobile phone 10 while stably holding it.

When the mobile phone 10 includes a plurality of batteries 80, the weight increases as compared to when only one battery 80 is included, thus allowing the mobile phone 10 to apply stronger pressure on the piezoelectric vibrator 60. As a result, vibration of the piezoelectric element 61 can be transmitted efficiently to the mounting surface 150, thereby improving the quality of emitted sound.

Embodiment 5

Figure 21:
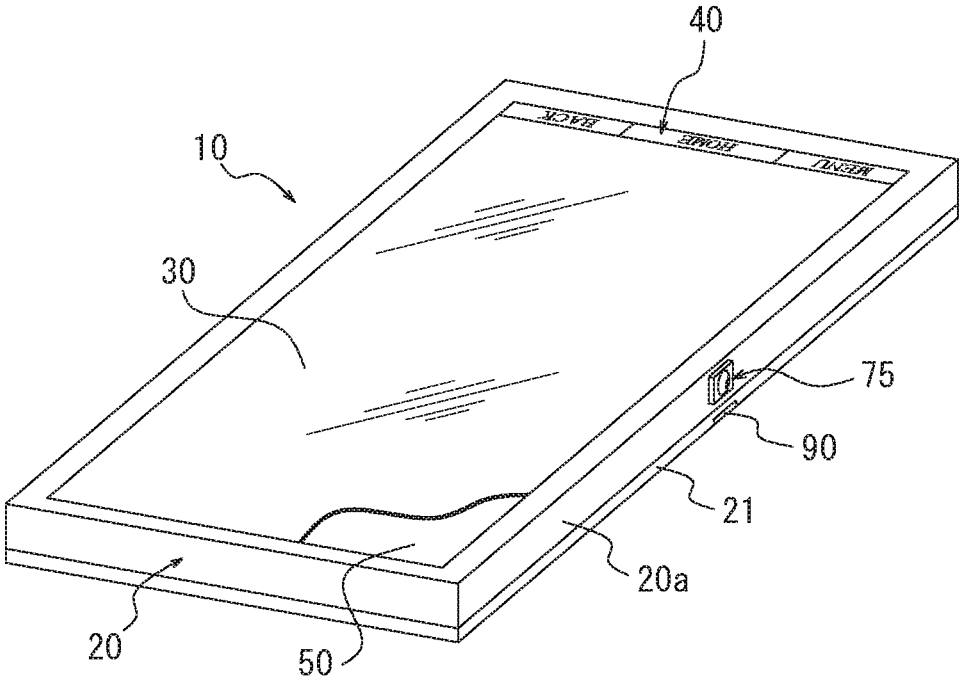
FIG. 21 is an external perspective view schematically illustrating the structure of a sound generator according to Embodiment 5 of the present disclosure.

FIG. 21 is an external perspective view of a sound generator according to Embodiment 5 of the present disclosure. The sound generator according to the present embodiment includes a mobile phone 10, such as a smartphone, and a vibration unit 75. The mobile phone 10 includes a housing 20 having an approximately rectangular external shape. In the housing 20, a panel 30 and an input unit 40 are provided at the front side of the mobile phone 10, and as illustrated by the partial cutout of the panel 30 in FIG. 21, a display unit 50 is held below the panel 30. A battery pack, camera unit, and the like are installed at the back side of the housing 20 and covered by a battery lid 21. The following describes the differences from Embodiment 1, omitting a description of common features.

The sound generator according to the present embodiment includes the vibration unit 75 on a bottom side 20*a*, which is one of the long sides of the housing 20 in the mobile phone 10. The bottom side 20*a* faces a mounting surface, such as a desk, when the mobile phone 10 is mounted horizontally on the mounting surface. The mobile phone 10 acts as an anchor (the anchor in the sound generator) providing a load to a piezoelectric vibrator 60 (see FIG. 23) via the vibration unit 75. The vibration unit 75 may be provided in any position on the bottom side 20*a*, yet in the present embodiment, the center of gravity of the mobile phone 10 is in the central portion of the housing 20, and the vibration unit 75 is described below as being positioned in the central portion of the long side on the bottom side 20*a*. By positioning the vibration unit 75 in the central portion, the load from the mobile phone 10 acting as the anchor can be efficiently provided to the vibration unit 75.

Figure 22:
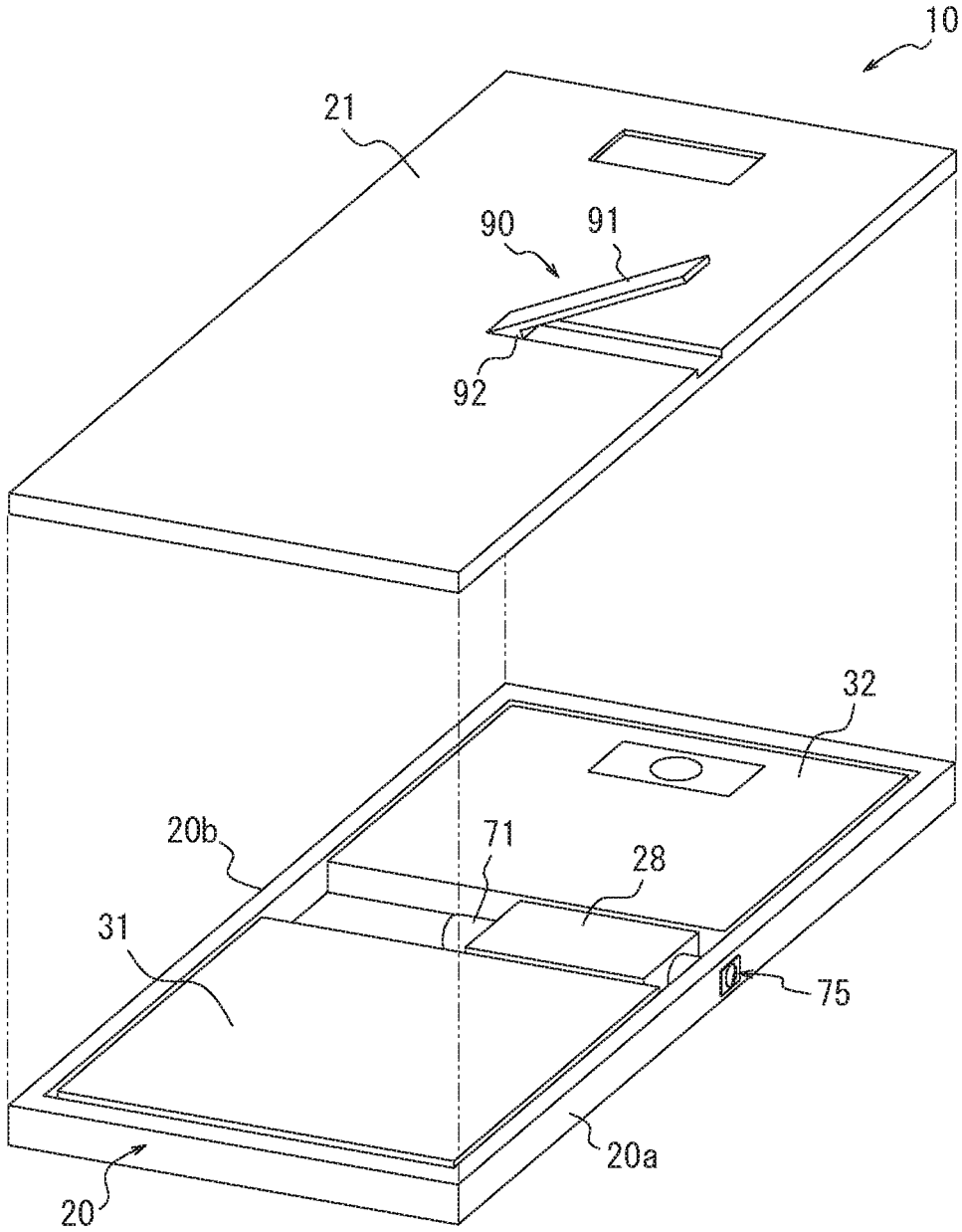
FIG. 22 is an external, exploded perspective view of the main parts at the back side of the mobile phone in FIG. 21.

FIG. 22 is an exploded perspective view schematically illustrating the main parts at the back side of the mobile phone 10 in FIG. 21. A battery pack 31, a camera unit 32, and the like are installed at the back side of the housing 20. At the back side of the housing 20, the mobile phone 10 includes a holding unit 28 that houses and holds the piezoelectric vibrator 60. The holding unit 28 extends along the transverse direction of the housing 20. The holding unit 28 contacts the vibration unit 75 by the bottom side 20*a* and contacts a regulating unit 71 by a top side 20*b* of the housing 20 opposite the bottom side 20*a*.

As illustrated in FIG. 22, the mobile phone 10 includes a stand 90 that is openable and closable with respect to the battery lid 21, i.e. the housing 20. FIG. 22 shows the stand 90 in an open state. The stand 90 includes a leg 91, an attaching portion 92 acting as a pivot during opening and closing, and a pressing portion 93, described below. In the present embodiment, while housed in the housing 20, the stand 90 includes the attaching portion 92 at the top side 20*b*, and the leg 91 extends towards the bottom side 20*a* along the transverse direction of the housing 20. Furthermore, the attaching portion 92 is positioned in the central portion along the longitudinal direction of the housing 20. In other words, when the mobile phone 10 is mounted on a horizontal mounting surface, such as a desk, with the bottom side 20*a* downwards, the attaching portion 92 is positioned along the same line as the vibration unit 75 when the mobile phone 10 is viewed from the front. When the mobile phone 10 is mounted on the mounting surface horizontally, at least the leg 91 and the vibration unit 75 contact the mounting surface and support the mobile phone 10.

Figure 23:
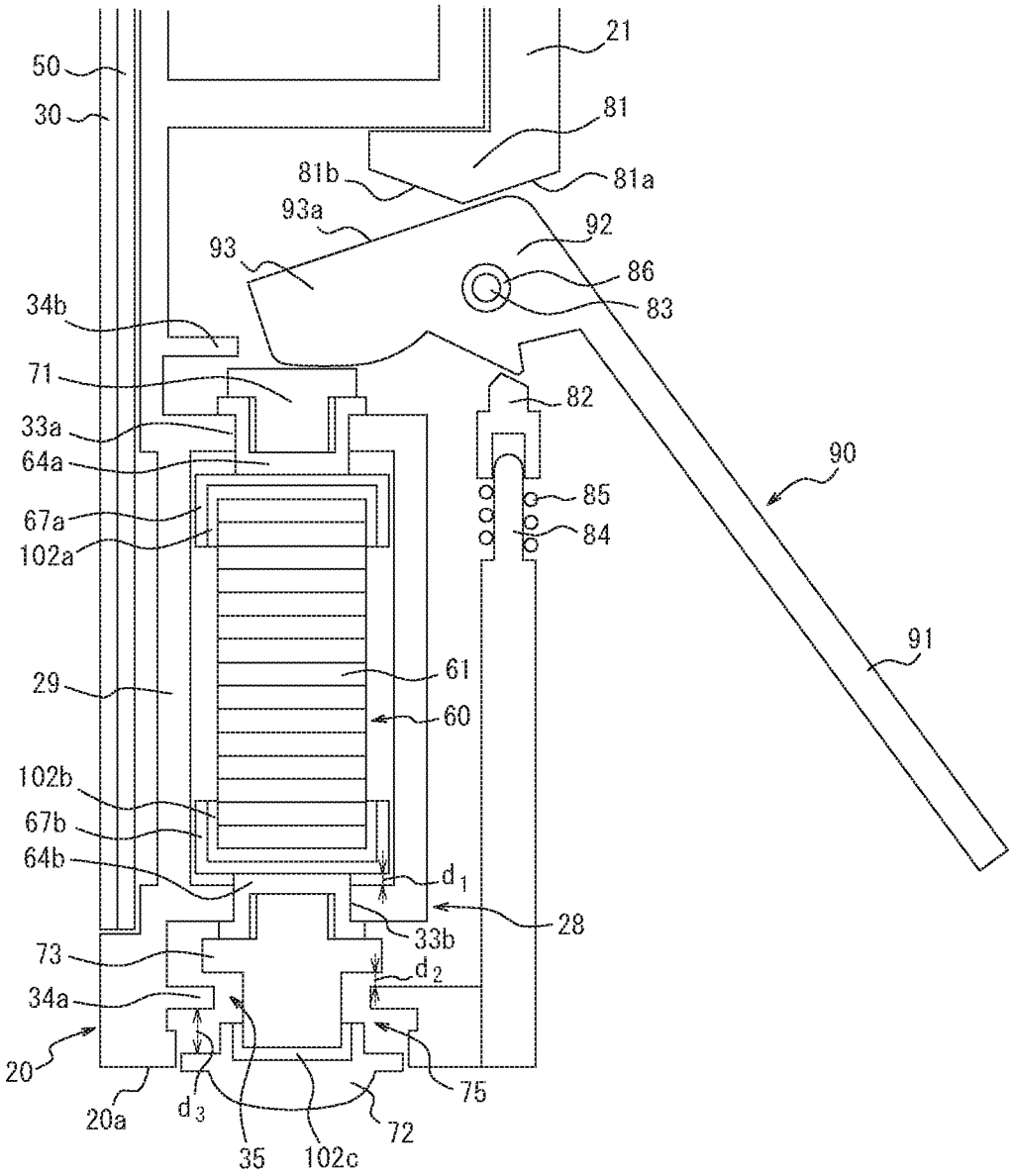
FIG. 23 is a portion of a cross-sectional view along the transverse direction of the mobile phone in FIG. 21.

FIG. 23 is a portion of a cross-sectional view along the transverse direction of the mobile phone 10, specifically illustrating a cross-section of the holding unit 28, vibration unit 75, regulating unit 71, and stand 90. Like FIG. 22, FIG. 23 shows the stand 90 in an open state. The mobile phone 10 includes the piezoelectric vibrator 60 in the holding unit 28 within the housing 20. The piezoelectric vibrator 60 is held so as to extend along the transverse direction of the mobile phone 10 in the holding unit 28. The circumference of the piezoelectric vibrator 60 is covered by a guide 29 along the transverse direction of the mobile phone 10. Therefore, even if a shock is provided to the mobile phone 10, for example by the mobile phone 10 being dropped, the position of the piezoelectric vibrator 60 does not shift forwards or backwards or in the longitudinal direction within the mobile phone 10. The holding unit 28 has, at the top and bottom thereof, openings 33*a* and 33*b* for introducing the vibration unit 75 and the regulating unit 71, which are contacted by the piezoelectric vibrator 60.

The piezoelectric vibrator 60 includes the piezoelectric element 61, sealing members 64*a* and 64*b* that prevent moisture from entering into the piezoelectric element 61, and cover members 67*a* and 67*b* that protect the piezoelectric element 61. The sealing members 64*a* and 64*b* may be any member that can prevent moisture from entering into the piezoelectric element 61 from outside the holding unit 28, yet in the present embodiment, the sealing members 64*a* and 64*b* are described as being elastic packing. With such sealing members, the piezoelectric vibrator 60 is maintained watertight in the housing 20.

In the present embodiment, the number of layers and the cross-sectional area of the laminated piezoelectric element 61 are determined appropriately in accordance with the weight of the mobile phone 10 (in the case of a portable electronic device, for example 80 g to 800 g) that serves as an anchor, so as to ensure sufficient pressure or quality of the sound emitted from the mounting surface, such as a desk, with which the vibration unit 75 is in contact.

The cover members 67*a* and 67*b* are inserted onto the edges of the laminated piezoelectric element 61 and are fixed by adhesive 102*a* and 102*b* (for example, epoxy resin). The piezoelectric vibrator 60 includes packing above and below the cover members 67*a* and 67*b*. The packing blocks the openings 33*a* and 33*b* of the holding unit 28 and prevents moisture from entering into the piezoelectric vibrator 60 from the outside.

The piezoelectric vibrator 60 contacts the vibration unit 75 via the sealing member (packing) 64*b* at the edge of the piezoelectric vibrator 60 by the bottom side 20*a*. The sealing member 64*b* and the vibration unit 75 are fixed by using, for example, double-sided tape or a fitting structure. As described above, the vibration unit 75 is positioned on the bottom side 20*a*, which is one of the long sides of the housing 20 in the mobile phone 10, and is therefore positioned between the piezoelectric vibrator 60 and the mounting surface when the mobile phone 10 is mounted horizontally on the mounting surface. When the mobile phone 10 is mounted on the mounting surface horizontally and a sound signal is applied to the laminated piezoelectric element 61, the laminated piezoelectric element 61 vibrates. This vibration is transmitted to the vibration unit 75, so that the vibration unit 75 vibrates the mounting surface.

Accordingly, in order to cause better sound to be emitted from the mounting surface, the cover members 67*a* and 67*b* are preferably formed from a material, such as hard plastic, that can reliably transmit the expansion and contraction of the laminated piezoelectric element 61 to the vibration unit 75. In FIG. 23, the tips of the cover members 67*a* and 67*b* are formed to be planar, yet the tips are not limited to being planar and may be any shape that reliably has point contact or surface contact with the vibration unit 75 and can transmit the expanding and contracting vibration of the laminated piezoelectric element 61. In FIG. 23, the areas between the packing and the openings 33*a* and 33*b* may be filled with gel or the like to increase the effect of moisture protection.

The vibration unit 75 is formed from a material, such as metal, ceramic, hard plastic, or the like, that can reliably transmit the expanding and contracting vibration of the laminated piezoelectric element 61 to the mounting surface, such as a desk. At the bottom side 20*a* of the housing 20, the vibration unit 75 has a cap 72 that is a cover member. The cap 72 is fixed by adhesive 102*c*. The cap 72 is formed from a material such as hard plastic or the like that can reliably transmit, to the mounting surface, such as a desk, the expanding and contracting vibration of the laminated piezoelectric element 61 transmitted via the vibration unit 75. In order to suppress scratching of the mounting surface, the cap 72 may be made from a relatively soft plastic instead of hard plastic. The vibration unit 75 includes a flange 73. The diameter of the flange 73 is set to be larger than the diameter of a space (opening 35) in which a thin stopper 34*a* provided in the housing 20 is formed. With this structure, the stopper 34*a* can prevent the vibration unit 75 from becoming detached from the housing 20.

The piezoelectric vibrator 60 contacts the regulating unit 71 via the sealing member 64*a* at the edge of the piezoelectric vibrator 60 opposite the vibration unit 75, i.e. towards the top side 20*b*. The regulating unit 71 can place the piezoelectric vibrator 60 in a regulated state by regulating the support state of the piezoelectric vibrator 60 and a non-regulated state by not regulating the support state. The regulated state and the non-regulated state are described in detail below with reference to FIGS. 24A and 24B. Since FIG. 23 shows the stand 90 in an open state, the regulating unit 71 is in contact with the pressing portion 93 and is being pressed by the pressing portion 93. On the other hand, when the stand 90 is in a closed state, i.e. when the stand 90 is housed in the battery lid 21, the regulating unit 71 does not contact the pressing portion 93. The housing 20 is provided with a stopper 34*b* in order to prevent the regulating unit 71 from detaching when the stand 90 is housed.

The stand 90 may, for example, be made of metal, and at the attaching portion 92, the stand 90 is held by a rotating stopper 81 and a stand guide 82, which are part of the battery lid 21. An end face 93*a* of the pressing portion 93 contacts a rotating stopper face 81*a* or 81*b*. At the attaching portion 92, the stand 90 is opened and closed by being rotated, with a metal shaft 83 of the rotating stopper 81 as the axis of rotation. An opening/closing operation of the stand 90 to bring the end face 93*a* into contact with the rotating stopper face 81*b* closes the stand 90 and houses it in the battery lid 21. An opening/closing operation of the stand 90 to bring the end face 93*a* into contact with the rotating stopper face 81*a* opens the stand 90 so that the stand 90 functions as a support member when mounting the mobile phone 10 on a mounting surface.

The stand guide 82 is held at the tip of a spring attaching portion 84, which is a portion of the battery lid 21, via a spring 85. The stand guide 82 can maintain the stand 90 in the open or closed state by transmitting pressure received from the spring 85 to the attaching portion 92. The circumference of the shaft 83 is covered by a shaft collar 86. The stand guide 82 and the shaft collar 86, which generate friction with the attaching portion 92 due to opening or closing of the attaching portion 92, may for example be made from a sliding resin, such as fluorinated plastic, polyacetal, nylon, or the like. In the present embodiment, the axis of rotation of the attaching portion 92 is parallel to the bottom side 20*a* of the housing 20.

Figure 24B:
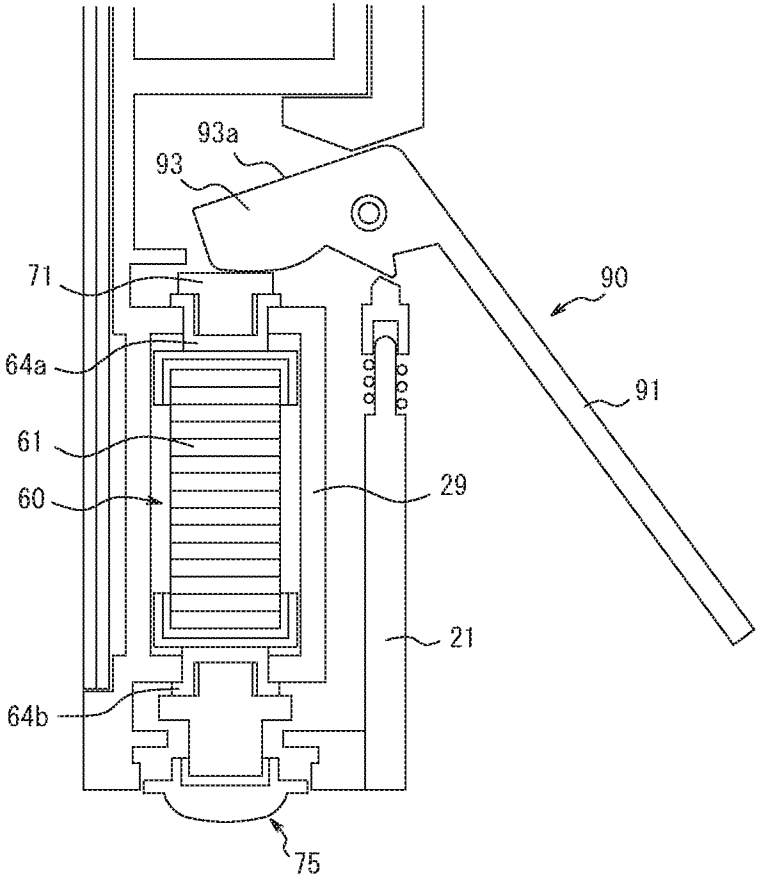
FIG. 24B illustrates operation of the stand in the mobile phone in FIG. 21.
Figure 24A:
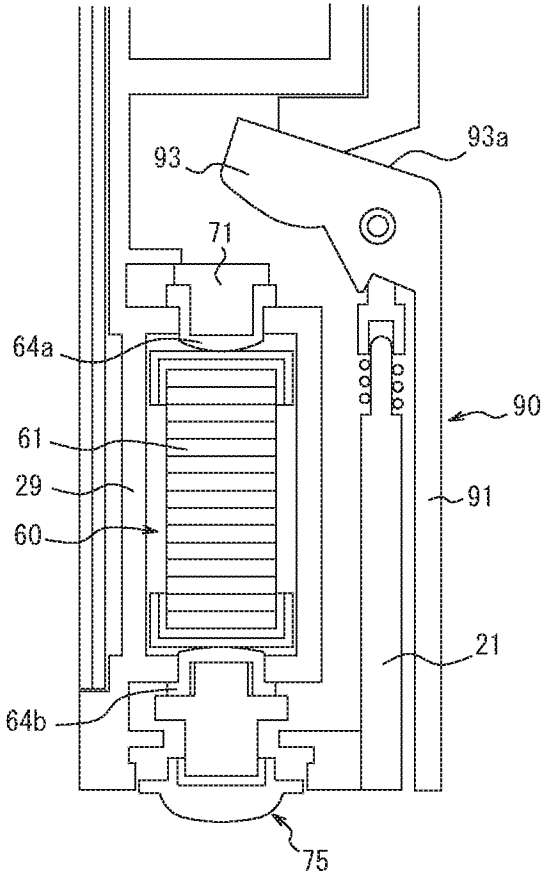
FIG. 24A illustrates operation of the stand in the mobile phone in FIG. 21.
Figure 25A:
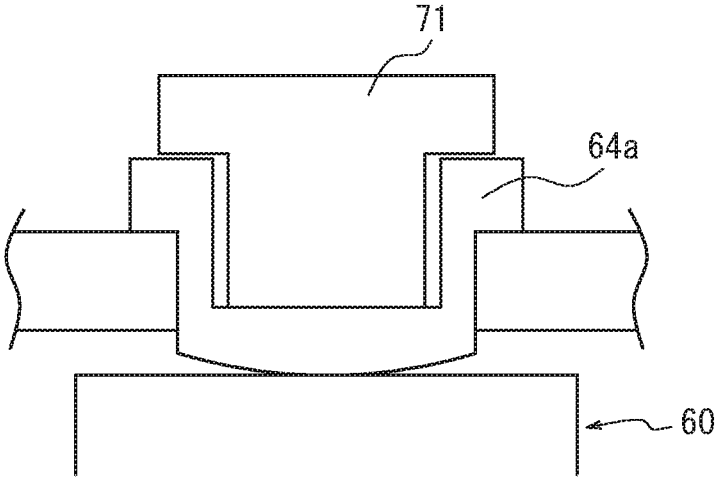
FIG. 25A is a partial enlarged view illustrating a first position of a regulating unit.

With reference to FIGS. 24A and 24B, operation of the stand 90 is now described. FIG. 24A shows a state in which the leg 91 of the stand 90 is housed in the battery lid 21, i.e. the closed state of the stand 90. In this state, it is assumed that sound is not emitted by the laminated piezoelectric element 61 of the mobile phone 10. At this time, the end face 93*a* of the pressing portion 93 is in contact with the rotating stopper face 81*b*, and the pressing portion 93 is not in contact with the regulating unit 71. Accordingly, when the stand 90 is closed, the laminated piezoelectric element 61 is not pressed by the pressing portion 93. At this time, the regulating unit 71 is in a first position. FIG. 25A illustrates the first position of the regulating unit 71.

When the stand 90 is closed, i.e. when the regulating unit 71 is in the first position, the laminated piezoelectric element 61 is held by the sealing members (packing) 64*a* and 64*b* above and below and by the circumferential guide 29. At this time, since the laminated piezoelectric element 61 is not pressed by the pressing portion 93, the laminated piezoelectric element 61 is held lightly in the vertical direction. Even when the laminated piezoelectric element 61 vibrates due to application of a sound signal to the laminated piezoelectric element 61, this vibration is absorbed by the sealing member 64*a* since the sealing member 64*a* has elasticity. Therefore, the vibration is not transmitted to the vibration unit 75, and sound is not emitted from the mounting surface. In other words, when the stand 90 is closed (when the regulating unit 71 is in the first position), the piezoelectric vibrator 60 is in the non-regulated state, in which the support state thereof is not regulated. In the non-regulated state, even if a shock is provided to the vibration unit 75, for example by the mobile phone 10 being dropped, the elastic sealing members 64*a* and 64*b* can absorb the shock, preventing damage to the laminated piezoelectric element 61.

Figure 25B:
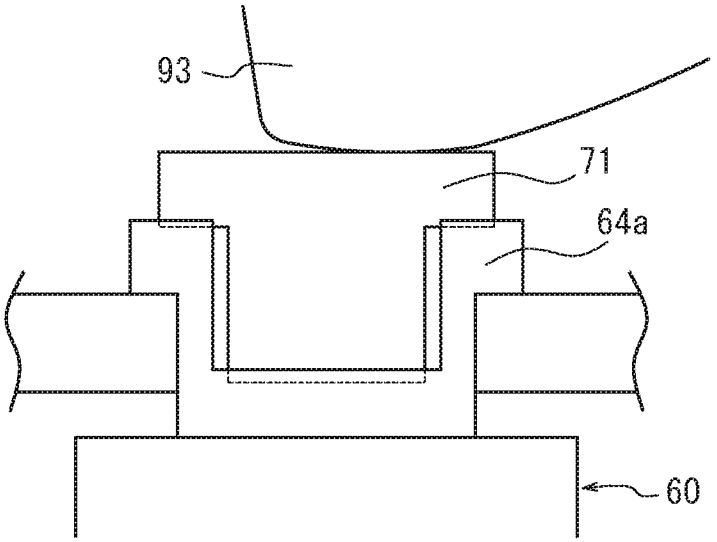
FIG. 25B is a partial enlarged view illustrating a second position of the regulating unit.

Like the cross-section in FIG. 23, FIG. 24B shows a state in which the leg 91 of the stand 90 is separated from the battery lid 21, i.e. the open state of the stand 90. In this state, it is assumed that the mobile phone 10 is mounted horizontally on a mounting surface and that sound is emitted using the laminated piezoelectric element 61. At this time, the end face 93*a* of the pressing portion 93 is in contact with the rotating stopper face 81*a*. The pressing portion 93 also contacts and presses the regulating unit 71. This pressure on the regulating unit 71 is applied to the laminated piezoelectric element 61 via the sealing member 64*a*. At this time, the regulating unit 71 is in a second position. FIG. 25B illustrates the second position of the regulating unit 71. By receiving pressure from the pressing portion 93, a portion of the regulating unit 71 digs into the sealing member 64*a*, as illustrated by the dashed line in FIG. 25B. The pressure applied to the regulating unit 71 from the pressing portion 93 is also transmitted to the vibration unit 75 via the piezoelectric vibrator 60, so that the vibration unit 75 is pushed out towards the bottom side 20*a*. In this way, when the laminated piezoelectric element 61 is used to emit sound, the vibration unit 75 can be projected out from the bottom side 20*a*, making it easier for the vibration unit 75 to contact the mounting surface. Note that since the change in the amount of projection of the vibration unit 75 is small, this change is not represented in FIGS. 24A and 24B.

When the stand 90 is open, i.e. when the regulating unit 71 is in the second position, the laminated piezoelectric element 61 is held by the sealing members (packing) 64*a* and 64*b* above and below and by the circumferential guide 29. Here, unlike when the stand 90 is closed, the laminated piezoelectric element 61 is also fixed in the vertical direction due to the pressure applied to the regulating unit 71 by the pressing portion 93. In other words, when the stand 90 is open, the piezoelectric vibrator 60 is in the regulated state, in which the support state thereof is regulated. In this state, when the laminated piezoelectric element 61 vibrates due to a sound signal being applied thereto, the vibration is transmitted to the vibration unit 75 via the sealing member 64*b*, and the vibration unit 75 vibrates. The vibration of the vibration unit 75 is transmitted to the mounting surface, causing sound to be emitted from the mounting surface.

In order to cause sound to be emitted using the laminated piezoelectric element 61 of the mobile phone 10, the user first pulls out the leg 91 of the stand 90 from the closed state illustrated in FIG. 24A, yielding the open state illustrated in FIG. 24B. At this time, by the pressing portion 93 pressing the regulating unit 71, the regulating unit 71 is displaced from the first position to the second position, the laminated piezoelectric element 61 is fixed, and the piezoelectric vibrator 60 enters the regulated state. After using the mobile phone 10 to cause sound to be emitted, the user houses the leg 91 in the battery lid 21 from the open state illustrated in FIG. 24B, placing the stand 90 in the closed state illustrated in FIG. 24A. The regulating unit 71 is then returned from the second position to the first position by the elastic force of the sealing member 64*a*, and the piezoelectric vibrator 60 enters the non-regulated state.

In this way, by opening and closing the stand 90 to change the position of the regulating unit 71, when the laminated piezoelectric element 61 vibrates, the vibration unit 75 does not vibrate if the stand 90 is closed and the mobile phone 10 is not mounted horizontally on a mounting surface, whereas the vibration unit 75 does vibrate if the stand 90 is open and the mobile phone 10 is mounted horizontally on a mounting surface. The opening and closing of the stand 90 can thus be associated with vibration of the vibration unit 75. Opening and closing of the stand 90 can also be associated with application of a sound signal to the laminated piezoelectric element 61. In other words, with the stand 90 in the open state (regulated state), the mobile phone 10 can apply a sound signal to the laminated piezoelectric element 61 to drive the laminated piezoelectric element 61, and with the stand 90 in the closed state (non-regulated state), the mobile phone 10 can suspend the application of a sound signal to the laminated piezoelectric element 61 so as not to drive the laminated piezoelectric element 61. With this structure, opening and closing of stand 90 can be caused to function as a switch for the sound signal to the laminated piezoelectric element 61. Such functioning as a switch can be implemented using mechanical or electrical means.

Figure 26:
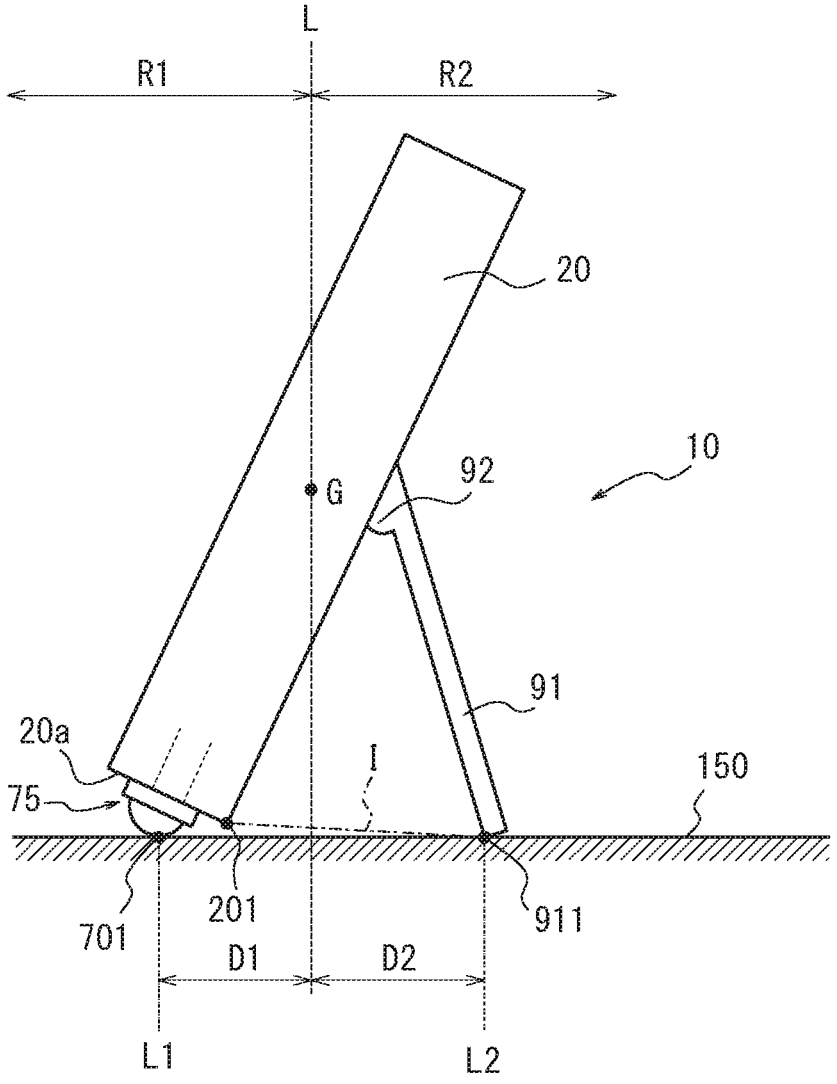
FIG. 26 illustrates the arrangement of the vibration unit and the leg in the sound generator in FIG. 21.

Next, with reference to FIG. 26, the arrangement of the vibration unit 75 and the leg 91 is described. FIG. 26 illustrates a state in which the mobile phone 10 is mounted on a horizontal mounting surface 150, such as a desk, with the bottom side 20*a* downwards while the stand 90 is in the open state. The desk referred to here is an example of a contacted member, and the mounting surface 150 is an example of a mounting surface that the sound generator contacts. As illustrated in FIG. 26, at least the leg 91 and the vibration unit 75 contact the mounting surface 150 and support the mobile phone 10. Point G is the center of gravity of the mobile phone 10. In other words, the point G is the center of gravity of the anchor in the sound generator.

The vibration unit 75 has a lowermost edge 701. The lowermost edge 701 is, within the vibration unit 75, the location that abuts the horizontal mounting surface 150, such as a desk, when the mobile phone 10 is mounted on the mounting surface 150 with the bottom side 20*a* downwards. The lowermost edge 701 is, for example, the tip of the cap 72.

The mobile phone 10 has a lowermost edge 201. The lowermost edge 201 is, within the mobile phone 10, the location that would abut the horizontal mounting surface 150, such as a desk, when the mobile phone 10 is mounted on the mounting surface 150 with the bottom side 20*a* downwards if the vibration unit 75 did not exist. A non-limiting example of the lowermost edge 201 of the mobile phone 10 is a corner of the housing 20. When a protrusion protrudes from the bottom side 20*a*, this protrusion may be the lowermost edge 201 of the mobile phone 10. The protrusion may, for example, be a side key, a connector cap, or the like.

In FIG. 26, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the bottom side 20*a* downwards. An alternate long and short dash line I is a line (virtual line) that connects the lowermost edge 911 of the leg 91 and the lowermost edge 201 of the mobile phone 10 assuming the vibration unit 75 does not exist. A dashed line L1 is a line (virtual line) that traverses the lowermost edge 701 and is perpendicular to the mounting surface. A dashed line L2 is a line (virtual line) that traverses a lowermost edge 911 and is perpendicular to the mounting surface. The dashed line L1 is separated from the dashed line L in the horizontal direction by a distance of D1. The dashed line L2 is separated from the dashed line L in the horizontal direction by a distance of D2.

In FIG. 26, the region R2 is a region at one side of the mobile phone 10, separated by the dashed line L. The region R1 is a region at the other side of the mobile phone 10, separated by the dashed line L. The leg 91 is provided in the region R2. The vibration unit 75 is provided on the bottom side 20*a* in the region R1.

In the region R1 of the bottom side 20*a*, the vibration unit 75 is preferably provided at a position as close as possible to the dashed line L. The load on the vibration unit 75 via the piezoelectric vibrator 60 thus increases as compared to when the vibration unit 75 is provided at a position distant from the dashed line L on the bottom side 20*a* in the region R1. Hence, the mobile phone 10 can effectively be used as an anchor for the sound generator.

In the region R2 of the bottom side 20*a*, the lowermost edge 911 of the leg 91 is preferably provided at a position as far as possible from the dashed line L. A sufficient distance can thus be ensured between the lowermost edge 911 and the vibration unit 75 even when the vibration unit 75 is placed at a position as close as possible to the dashed line L. Hence, the sound generator can be stably mounted on the mounting surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 701 of the vibration unit 75 is preferably located towards the mounting surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 701 preferably projects towards the mounting surface 150 from the alternate long and short dash line I. In this way, the mounting surface 150 can appropriately be vibrated by the vibration unit 75.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 701 of the vibration unit 75 is preferably located towards the mounting surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 701 preferably projects towards the mounting surface 150 from the alternate long and short dash line I. It is thus more difficult for the lowermost edge 201 of the mobile phone 10 to contact the mounting surface 150, which for example depending on the type of paint on the housing 20, makes it more difficult for the paint to peel off. Abnormal noise is also less likely to be emitted between the lowermost edge 201 and the mounting surface 150.

Figure 27A:
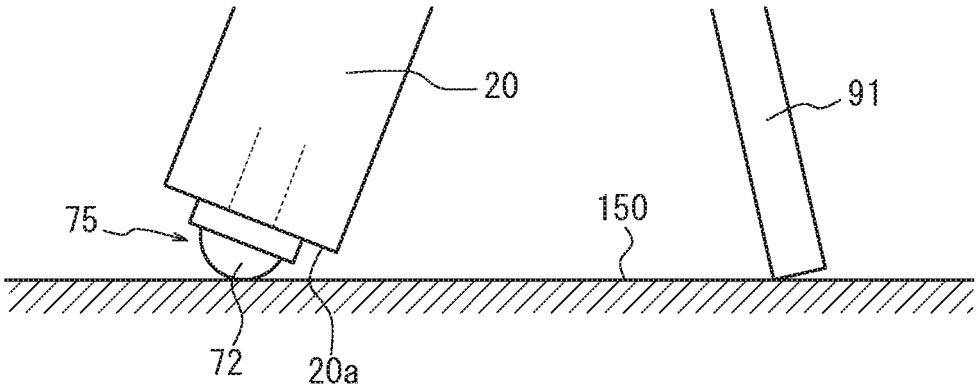
FIG. 27A schematically illustrates operation of the mobile phone in FIG. 21 as a sound generator.
Figure 27B:
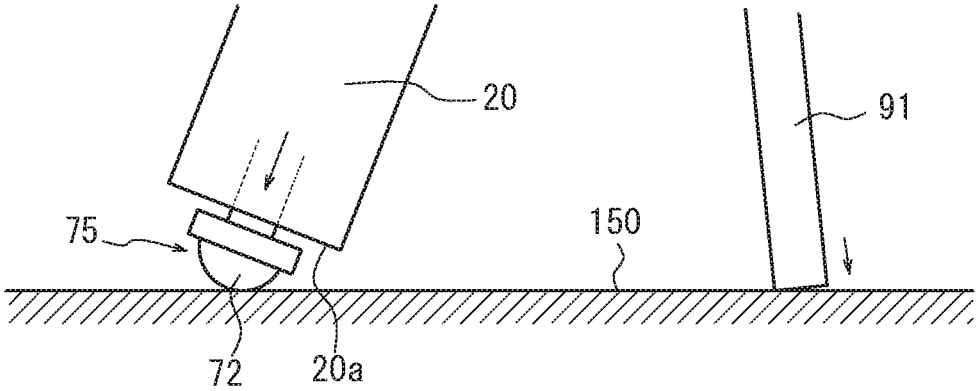
FIG. 27B schematically illustrates operation of the mobile phone in FIG. 21 as a sound generator.
Figure 27C:
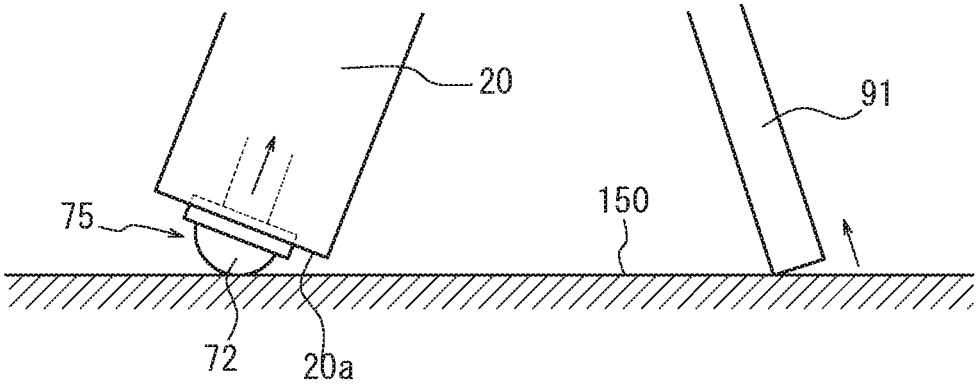
FIG. 27C schematically illustrates operation of the mobile phone in FIG. 21 as a sound generator.

FIGS. 27A, 27B, and 27C schematically illustrate operation of the mobile phone 10 as a sound generator. When causing the mobile phone 10 to function as a sound generator, the mobile phone 10 is stood horizontally with the bottom side 20*a* of the housing 20 downwards and the stand 90 in the open state, so that the cap 72 of the vibration unit 75 and the leg 91 contact the mounting surface 150, such as a desk, as illustrated in FIG. 27A. In this way, the weight of the mobile phone 10 is provided to the vibration unit 75 as a load via the piezoelectric vibrator 60. In other words, the mobile phone 10 acts as an anchor for the sound generator according to the present disclosure. The pressure applied to the regulating unit 71 from the pressing portion 93 is also transmitted to the laminated piezoelectric element 61. Note that in the state illustrated in FIG. 27A, the laminated piezoelectric element 61 does not expand or contract, since no voltage is applied thereto.

In this state, when the laminated piezoelectric element 61 of the piezoelectric vibrator 60 is driven by a playback sound signal, the laminated piezoelectric element 61 vibrates by expanding and contracting. FIG. 27B is an exaggerated view of the laminated piezoelectric element 61 in the expanded state. The vibration unit 75 receives a force from the piezoelectric vibrator 60, and by being pushed out towards the mounting surface 150, the vibration unit 75 projects from the housing 20 towards the mounting surface 150 more than when the laminated piezoelectric element 61 is at rest (the state illustrated in FIG. 27A). FIG. 27C is an exaggerated view of the laminated piezoelectric element 61 in the contracted state. At this time, due to application of the load of the mobile phone 10, the vibration unit 75 is pushed in from the mounting surface 150 towards the housing 20 and therefore withdraws towards the housing 20 more than when the laminated piezoelectric element 61 is at rest. In this way, by alternating between the states illustrated in FIGS. 27B and 27C, the vibration unit 75 vibrates in accordance with the playback sound signal with the portion of the leg 91 contacting the mounting surface 150 acting as a pivot, and without the cap 72 separating from the mounting surface 150. As long as problems such as the lowermost edge 201 contacting the mounting surface 150 and emitting abnormal noise do not occur, the cap 72 may separate slightly from the mounting surface 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the mounting surface 150 through the vibration unit 75, and the mounting surface 150 vibrates, causing the mounting surface 150 to function as a vibration speaker by emitting sound. If the difference in length between full expansion and full contraction is less than 0.05 μm, it may not be possible to vibrate the mounting surface 150 appropriately. Conversely, if the difference exceeds 50 μm, vibration grows large, and the sound generator may wobble.

The distance d1 between the bottom side portion of the laminated piezoelectric element 61 and the inner surface of the holding unit 28 towards the bottom side 20*a*, and the distance d2 between the flange 73 and the stopper 34*a*, as illustrated in FIG. 23, are preferably greater than the amount of displacement when the laminated piezoelectric element 61 transitions from not expanding or contracting to a state of full expansion. As a result, even when the laminated piezoelectric element is fully expanded (the state in FIG. 27B), the bottom side portion of the laminated piezoelectric element 61 and the flange 73 respectively do not contact the inner surface of the holding unit 28 towards the bottom side 20*a* and the stopper 34*a*, allowing vibration of the laminated piezoelectric element 61 to be transmitted effectively to the mounting surface 150. Furthermore, the distance d3 between the cap 72 and the stopper 34*a* illustrated in FIG. 23 is preferably greater than the amount of displacement when the laminated piezoelectric element 61 is fully contracted from a state in which no voltage is applied thereto so that the laminated piezoelectric element 61 is not expanding or contracting. In this way, it is difficult for the cap 72 and the stopper 34*a* to contact even when the laminated piezoelectric element 61 is fully contracted (the state in FIG. 27C). Accordingly, the cap 72 is less likely to detach from the vibration unit 75.

The shape of the holding unit 28 and the vibration unit 75 and the location at which these components are disposed in the housing 20, the dimensions of the cap 72, the length of the laminated piezoelectric element 61 in the lamination direction, and the like are appropriately determined so as to satisfy the above conditions.

According to the sound generator of the present embodiment, a laminated piezoelectric element is used as the source of vibration, hence reducing the number of components as compared to a vibration generating device having a dynamic speaker configuration and achieving a simple structure with few components, thereby allowing for a reduction in size and weight. Furthermore, as the laminated piezoelectric element, the stack-type laminated piezoelectric element 61 is used and vibrates by expanding and contracting along the lamination direction due to a playback sound signal. Since this expanding and contracting vibration is transmitted to the mounting surface, the vibration transmission efficiency with respect to the mounting surface in the expansion and contraction direction (deformation direction) is good, and the mounting surface can be vibrated efficiently. Moreover, since the laminated piezoelectric element 61 contacts the vibration unit 75 with the cover member 67*b* therebetween, damage to the laminated piezoelectric element 61 can also be prevented. By standing the mobile phone 10 horizontally so that the cap 72 of the vibration unit 75 contacts the mounting surface, the weight of the mobile phone 10 is applied as a load to the cap 72 of the vibration unit 75 via the piezoelectric vibrator 60. Hence, the cap 72 can reliably contact the mounting surface, and the expanding and contracting vibration of the piezoelectric vibrator 60 can efficiently be transmitted to the mounting surface.

According to the sound generator of the present embodiment, the open or closed state of the stand 90 can also be coordinated with the regulated state and non-regulated state of the piezoelectric vibrator 60. In other words, when the sound generator is not being used to cause sound to be emitted, the piezoelectric vibrator 60 can be placed in the non-regulated state by closing the stand 90. In this way, the piezoelectric vibrator 60 is protected from external shocks by the elasticity of the sealing members 64*a* and 64*b*. Conversely, when the sound generator is being used to cause sound to be emitted, then the piezoelectric vibrator 60 is fixed in the housing 20 by transitioning from the non-regulated state to the regulated state, and vibration of the laminated piezoelectric element 61 can reliably be transmitted to the vibration unit 75. Furthermore, when opening and closing of the stand 90 functions as a switch for the sound signal to the laminated piezoelectric element 61, the sound signal can be applied to the laminated piezoelectric element 61 in accordance with use of the sound generator. Operations can thus be simplified as compared to when a switch is provided separately.

Also, by providing the sealing members (packing) 64*a* and 64*b* in the piezoelectric vibrator 60, water is prevented from entering into the laminated piezoelectric element 61, thereby protecting the laminated piezoelectric element 61 from moisture.

Embodiment 6

Figure 28:
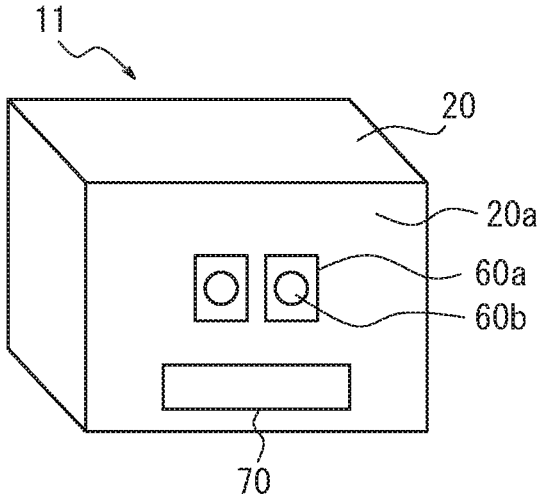
FIG. 28 is an external perspective view of a vibration speaker as Embodiment 6 of a sound generator according to the present disclosure.

FIG. 28 is an external perspective view of a vibration speaker, which is a sound generator according to Embodiment 6 of the present disclosure. The sound generator according to the present embodiment functions as a vibration speaker 11 and includes a piezoelectric vibrator 60*a*, a piezoelectric vibrator 60*b*, and a sheet-like elastic member 70. As described below, the vibration speaker 11 acts as an anchor (the anchor in the sound generator) providing a load to the piezoelectric vibrator 60*a* and the piezoelectric vibrator 60*b*. The vibration speaker 11 includes a housing 20 having an approximately rectangular external shape. The piezoelectric vibrator 60*a*, the piezoelectric vibrator 60*b*, and the elastic member 70 are formed on the bottom side 20*a* of the vibration speaker 11, which is one side of the housing 20. The following describes the differences from Embodiment 1, omitting a description of common features.

When the vibration speaker 11 is mounted on a horizontal mounting surface, such as a desk, with the bottom side 20*a* downwards, the vibration speaker 11 is supported at three points on the mounting surface by the piezoelectric vibrator 60*a*, the piezoelectric vibrator 60*b*, and the elastic member 70. The arrangement of the piezoelectric vibrator 60*a*, the piezoelectric vibrator 60*b*, and the elastic member 70 is described in detail below.

Figure 29:
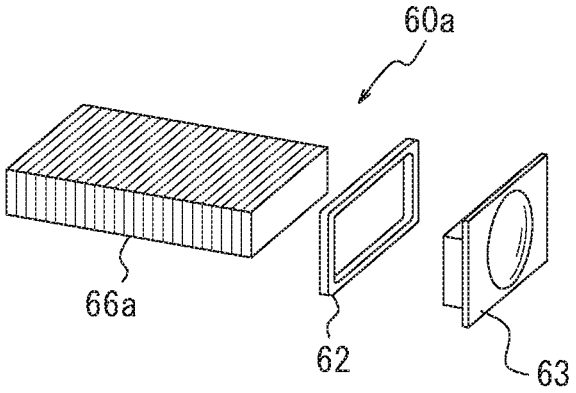
FIG. 29 is a perspective view schematically illustrating the piezoelectric vibrator of the vibration speaker in FIG. 28.

FIG. 29 is a perspective view schematically illustrating the piezoelectric vibrator 60*a* of the vibration speaker in FIG. 28. The piezoelectric vibrator 60*a* includes a laminated piezoelectric element 66*a*, an O-ring 62 for waterproofing, and an insulating cap 63 that is a cover member. The laminated piezoelectric element 66*a* has the same structure as the laminated piezoelectric element 61 in Embodiment 1. In FIG. 29, the structure of the piezoelectric vibrator 60*a* is illustrated, yet the piezoelectric vibrator 60*b* has a similar structure. At the bottom face of the housing 20, the vibration speaker 11 according to the present embodiment includes a holding unit that houses and holds the piezoelectric vibrator 60*a* and the piezoelectric vibrator 60*b*. The holding unit extends along the longitudinal direction of the housing 20.

Figure 30:
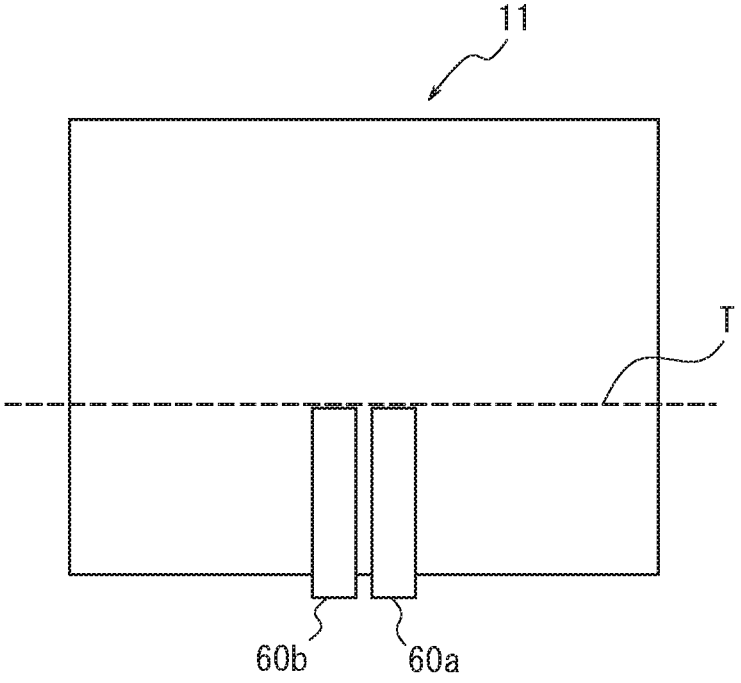
FIG. 30 is a schematic cross-sectional view of the vibration speaker in FIG. 28.

In other words, in the vibration speaker 11 according to the present embodiment, towards the bottom side 20*a* of the housing 20, the piezoelectric vibrator 60*a* and the piezoelectric vibrator 60*b* are disposed on a virtual plane T perpendicular to the expansion and contraction direction of the piezoelectric elements that form the piezoelectric vibrator 60*a* and the piezoelectric vibrator 60*b*, as illustrated in FIG. 30. FIG. 30 is a schematic cross-sectional view of the vibration speaker in FIG. 28.

Figure 31:
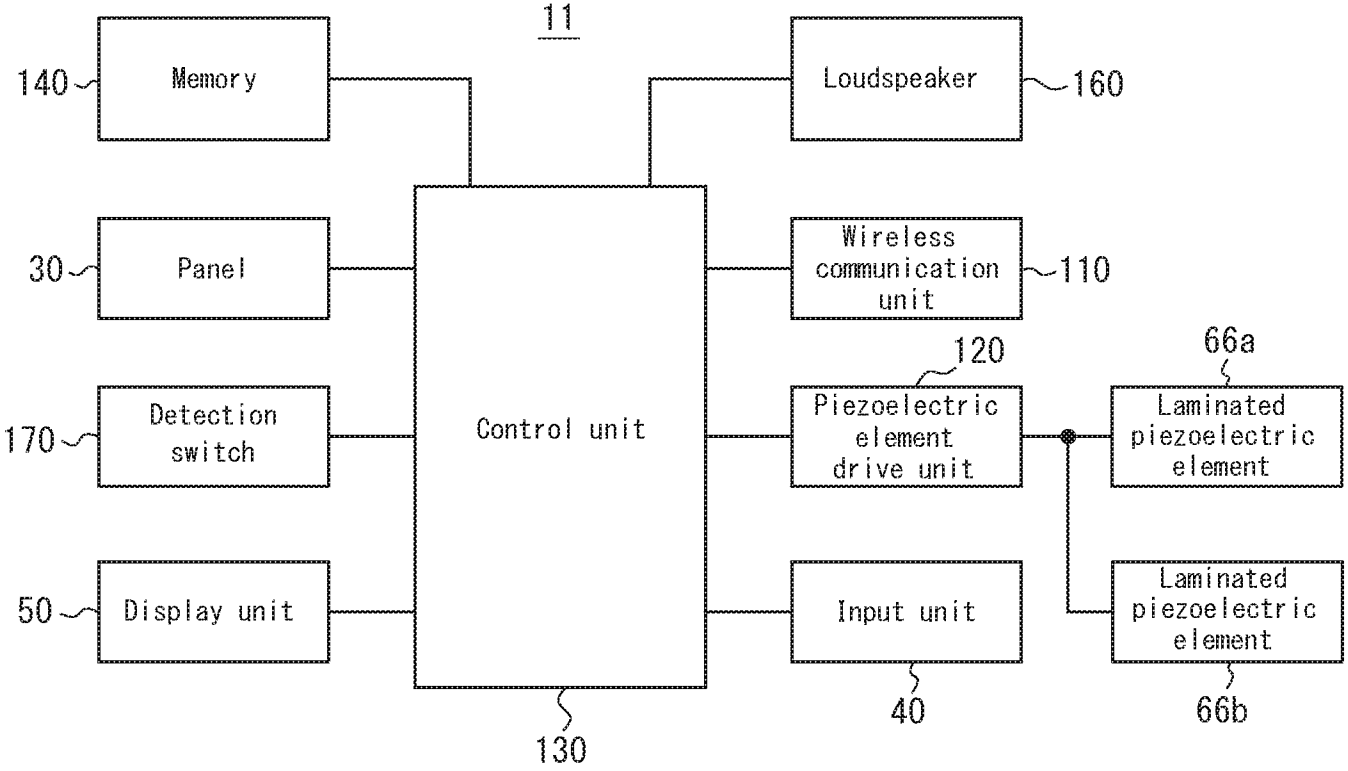
FIG. 31 is a functional block diagram of the main parts of the vibration speaker in FIG. 28.

FIG. 31 is a functional block diagram of the main portions of the vibration speaker 11 according to the present embodiment. The vibration speaker 11 includes a panel 30 that detects the contact position of the user's finger or the like due to a change in capacitance or the like; an input unit 40 that accepts input of an operation such as a playback instruction; a display unit 50 that displays images, the operation state, and the like; the laminated piezoelectric element 66*a* forming the piezoelectric vibrator 60*a*; and a laminated piezoelectric element 66*b* forming the piezoelectric vibrator 60*b*. Furthermore, the vibration speaker 11 includes a wireless communication unit 110, a piezoelectric element drive unit 120, a control unit 130, a memory 140, a detection switch 170, and a loudspeaker 160. The panel 30, input unit 40, display unit 50, wireless communication unit 110, piezoelectric element drive unit 120, memory 140, detection switch 170, and loudspeaker 160 connect to the control unit 130. The laminated piezoelectric element 66*a* and the laminated piezoelectric element 66*b* connect to the control unit 130 via the piezoelectric element drive unit 120. The panel 30 and the display unit 50 integrally form a touch panel.

The wireless communication unit 110 may have a well-known structure and connects wirelessly to other terminals or to a communication network via a close-range wireless communication standard, infrared, or the like. The control unit 130 is a processor that controls overall operations of the vibration speaker 11. The control unit 130 applies a playback sound signal (voltage corresponding to a playback sound signal of the other party's voice, a ringtone, music including songs, or the like) to the laminated piezoelectric element 66*a* and the laminated piezoelectric element 66*b* via the piezoelectric element drive unit 120. Note that the playback sound signal may be based on music data stored in internal memory or may be music data stored on an external server or the like and played back over a network.

The memory 140 stores programs, data, and the like used by the control unit 130. The detection switch 170 is configured using, for example, an illuminance sensor, an infrared sensor, a mechanical switch, or the like, and detects when the vibration speaker 11 is placed on a mounting surface, such as a desk, table, or the like, outputting the result of detection to the control unit 130. Based on the detection result from the detection switch 170, the control unit 130 for example turns operation of the laminated piezoelectric element 66*a* and the laminated piezoelectric element 66*b* on and off. The loudspeaker 160 is a speaker that outputs audio due to control by the control unit 130.

Figure 32:
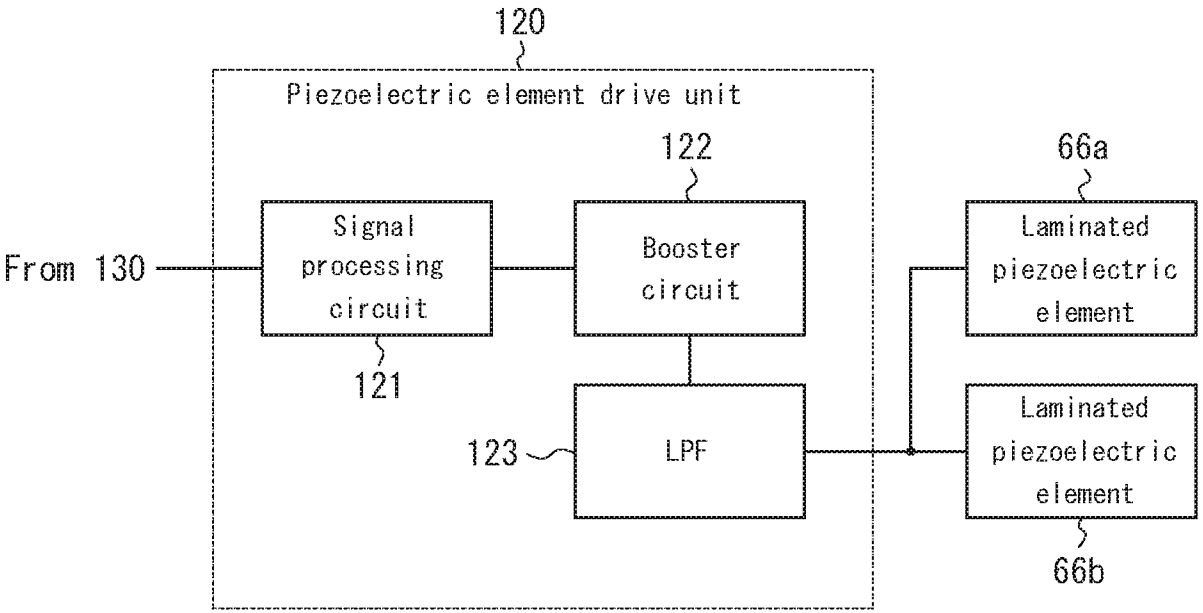
FIG. 32 is a functional block diagram illustrating the structure of an example of the piezoelectric element drive unit in FIG. 31.

For example as illustrated in FIG. 32, the piezoelectric element drive unit 120 includes a signal processing circuit 121, a booster circuit 122, and a LPF 123. The booster circuit 122 boosts the voltage of the input analog playback sound signal and applies the result to the laminated piezoelectric element 66*a* and the laminated piezoelectric element 66*b* via the LPF 123. The maximum voltage of the playback sound signal applied to the laminated piezoelectric element 66*a* and the laminated piezoelectric element 66*b* by the booster circuit 122 may, for example, be from 1 Vpp to 500 Vpp, yet the voltage is not limited to this range and may be adjusted appropriately in accordance with the weight of the vibration speaker 11 and the performance of the laminated piezoelectric element 66*a* and the laminated piezoelectric element 66*b*. For the playback sound signal applied to the laminated piezoelectric element 66*a* and the laminated piezoelectric element 66*b*, direct current may be biased, and the maximum voltage may be set centered on the bias voltage.

For piezoelectric elements in general, not just the laminated piezoelectric element 66*a* and the laminated piezoelectric element 66*b*, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. Attenuating or cutting the high-frequency component can suppress power consumption and can also suppress heat generation in the laminated piezoelectric element 66*a* and the laminated piezoelectric element 66*b*.

The loudspeaker 160 is driven by being controlled by the control unit 130 and emits audio upon input of a playback sound signal. This audio signal may be the same as the playback sound signal that is applied to the laminated piezoelectric element 66*a* and the laminated piezoelectric element 66*b* or may be different. This audio signal may be applied to the loudspeaker 160 simultaneously with application of the playback sound signal to the laminated piezoelectric element 66*a* and the laminated piezoelectric element 66*b* so that the loudspeaker 160 is driven simultaneously with the laminated piezoelectric element 66*a* and the laminated piezoelectric element 66*b*.

Figure 33:
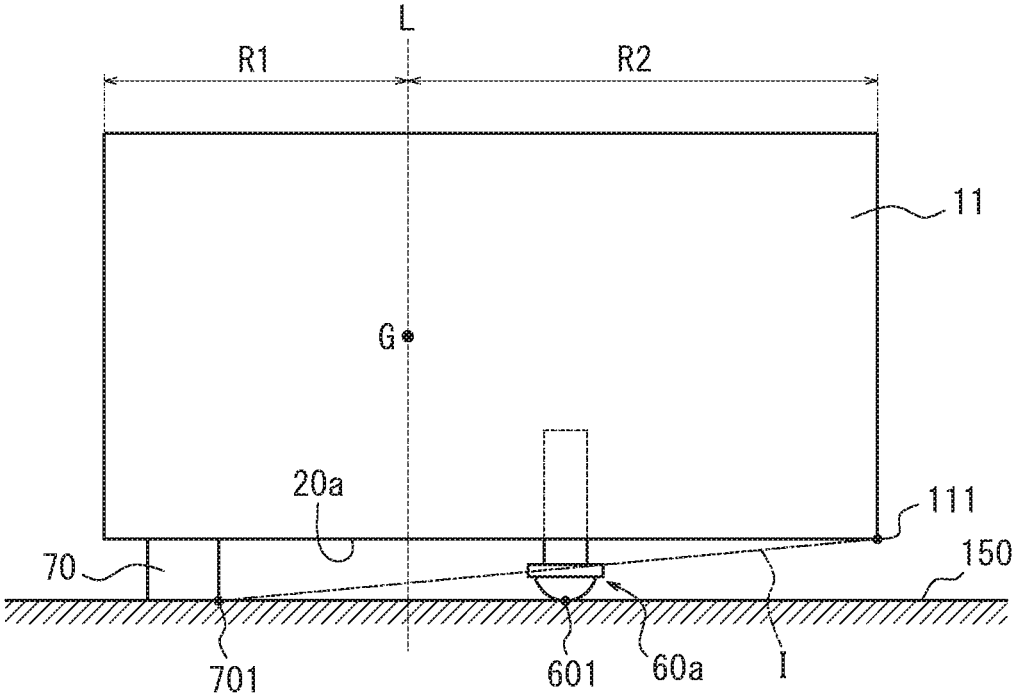
FIG. 33 illustrates the arrangement of the piezoelectric vibrator and the elastic member in the sound generator in FIG. 28.

Next, with reference to FIG. 33, the arrangement of the piezoelectric vibrator 60*a*, the piezoelectric vibrator 60*b*, and the elastic member 70 is described. FIG. 33 illustrates a state in which the vibration speaker 11 is mounted on a horizontal mounting surface 150, such as a desk, with the bottom side 20*a* downwards. The desk referred to here is an example of a contacted member in the present disclosure, and the mounting surface 150 is an example of a contact surface (mounting surface) that the sound generator contacts. As illustrated in FIG. 33, the vibration speaker 11 is supported at three points on the mounting surface 150 by the piezoelectric vibrator 60*a*, the piezoelectric vibrator 60*b*, and the elastic member 70. Point G is the center of gravity of the vibration speaker 11. In other words, the point G is the center of gravity of the anchor in the sound generator. Note that in FIG. 33, for the sake of simplicity, the piezoelectric vibrator 60*b* is not illustrated, yet the description below applies equally to the piezoelectric vibrator 60*b*.

In FIG. 33, the elastic member 70 has a lowermost edge 701. The lowermost edge 701 is, within the elastic member 70, the location that abuts the horizontal mounting surface 150, such as a desk, when the vibration speaker 11 is mounted on the mounting surface 150 with the bottom side 20*a* downwards.

The piezoelectric vibrator 60*a* has a lowermost edge 601. The lowermost edge 601 is, within the piezoelectric vibrator 60*a*, the location that abuts the horizontal mounting surface 150, such as a desk, when the vibration speaker 11 is mounted on the mounting surface 150 with the bottom side 20*a* downwards. The lowermost edge 601 is, for example, the tip of the cap 63.

The vibration speaker 11 has a lowermost edge 111. The lowermost edge 111 is, within the vibration speaker 11, the location that would abut the horizontal mounting surface 150, such as a desk, when the vibration speaker 11 is mounted on the mounting surface 150 with the bottom side 20*a* downwards if the piezoelectric vibrator 60*a* did not exist. A non-limiting example of the lowermost edge 111 of the vibration speaker 11 is a corner of the housing 20. When a protrusion protrudes from the bottom side 20*a*, this protrusion may be the lowermost edge 111 of the vibration speaker 11. The protrusion may, for example, be a side key, a connector cap, or the like.

In FIG. 33, a dashed line L is a line (virtual line) that traverses the center of gravity G of the vibration speaker 11 and is perpendicular to the horizontal mounting surface 150, such as a desk, when the vibration speaker 11 is mounted on the mounting surface 150 with the bottom side 20*a* downwards. An alternate long and short dash line I is a line (virtual line) that connects the lowermost edge 701 of the elastic member 70 and the lowermost edge 111 of the vibration speaker 11 assuming the piezoelectric vibrator 60*a* does not exist.

In FIG. 33, the region R1 is a region at one side of the vibration speaker 11, separated by the dashed line L. The region R2 is a region at the other side of the vibration speaker 11, separated by the dashed line L. The elastic member 70 is provided on the bottom side 20*a* in the region R1. The piezoelectric vibrator 60*a* is provided on the bottom side 20*a* in the region R2.

In the region R2 of the bottom side 20*a*, the piezoelectric vibrator 60*a* is preferably provided at a position as close as possible to the dashed line L. The load on the piezoelectric vibrator 60*a* thus increases as compared to when the piezoelectric vibrator 60*a* is provided at a position distant from the dashed line L on the bottom side 20*a* in the region R2. Hence, the vibration speaker 11 can effectively be used as an anchor for the sound generator.

In the region R1 of the bottom side 20*a*, the elastic member 70 is preferably provided at a position as far as possible from the dashed line L. A sufficient distance can thus be ensured between the elastic member 70 and the piezoelectric vibrator 60*a* even when the piezoelectric vibrator 60*a* is placed at a position as close as possible to the dashed line L. Hence, the sound generator can be stably mounted on the mounting surface 150.

When the laminated piezoelectric element 66*a* is fully expanded from a state in which no voltage is applied thereto and the laminated piezoelectric element 66*a* is not expanding or contracting, or at the time of maximum amplitude of the laminated piezoelectric element 66*a*, the lowermost edge 601 of the piezoelectric vibrator 60*a* is preferably located towards the mounting surface 150 from the alternate long and short dash line I. In other words, when the laminated piezoelectric element 66*a* is fully expanded from a state in which no voltage is applied thereto and the laminated piezoelectric element 66*a* is not expanding or contracting, or at the time of maximum amplitude of the laminated piezoelectric element 66*a*, the lowermost edge 601 preferably projects towards the mounting surface 150 from the alternate long and short dash line I. In this way, the mounting surface 150 can appropriately be vibrated by the piezoelectric vibrator 60*a*.

Furthermore, when the laminated piezoelectric element 66*a* is fully contracted from a state in which no voltage is applied thereto and the laminated piezoelectric element 66*a* is not expanding or contracting, or at the time of minimum amplitude of the laminated piezoelectric element 66*a*, the lowermost edge 601 of the piezoelectric vibrator 60*a* is preferably located towards the mounting surface 150 from the alternate long and short dash line I. In other words, when the laminated piezoelectric element 66*a* is fully contracted from a state in which no voltage is applied thereto and the laminated piezoelectric element 66*a* is not expanding or contracting, or at the time of minimum amplitude of the laminated piezoelectric element 66*a*, the lowermost edge 601 preferably projects towards the mounting surface 150 from the alternate long and short dash line I. It is thus more difficult for the lowermost edge 111 of the vibration speaker 11 to contact the mounting surface 150, which for example depending on the type of paint on the housing 20, makes it more difficult for the paint to peel off. Abnormal noise is also less likely to be emitted between the lowermost edge 111 and the mounting surface 150.

Figure 34A:
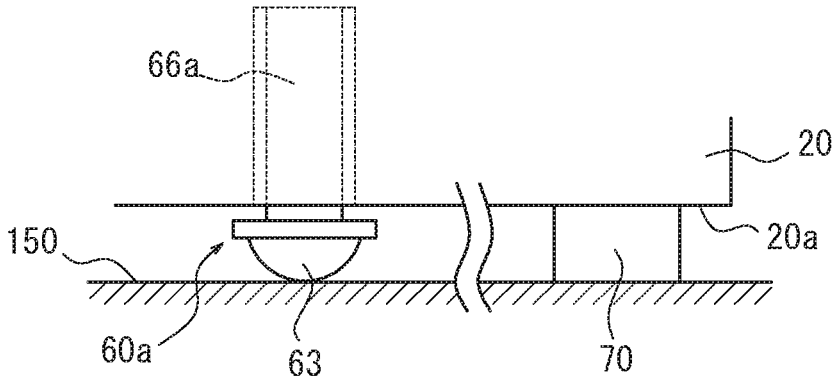
FIG. 34A schematically illustrates operation of the vibration speaker in FIG. 28 as a sound generator.
Figure 34B:
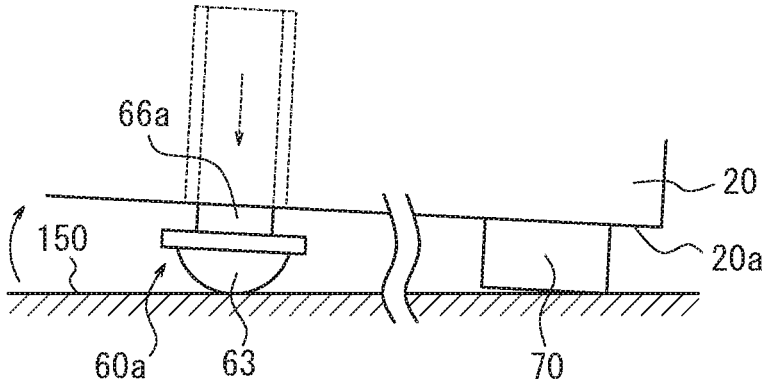
FIG. 34B schematically illustrates operation of the vibration speaker in FIG. 28 as a sound generator.
Figure 34C:
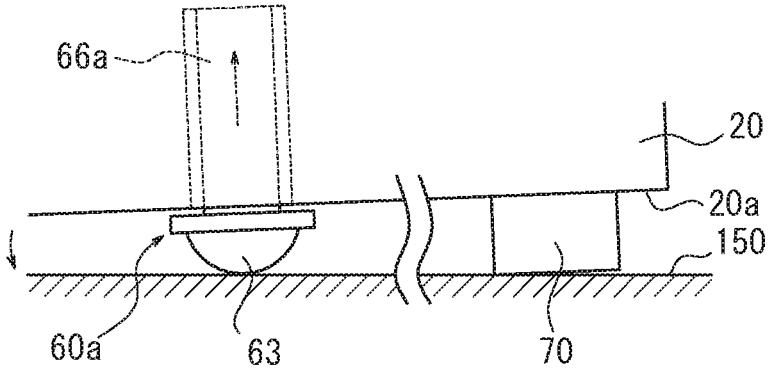
FIG. 34C schematically illustrates operation of the vibration speaker in FIG. 28 as a sound generator.

FIGS. 34A, 34B, and 34C schematically illustrate operation of the vibration speaker 11 according to the present embodiment as a sound generator. The following description uses the piezoelectric vibrator 60*a* as an example yet equally applies to the piezoelectric vibrator 60*b* as well. When causing the vibration speaker 11 to function as a sound generator, the vibration speaker 11 is mounted on a mounting surface (contact surface) 150, such as a desk, with the bottom side 20*a* of the housing 20 downwards, so that the cap 63 of the piezoelectric vibrator 60*a* and the elastic member 70 contact the mounting surface 150, as illustrated in FIG. 34A. In this way, the weight of the vibration speaker 11 is provided to the piezoelectric vibrator 60*a* as a load. In other words, the vibration speaker 11 acts as an anchor for the sound generator according to the present disclosure. Note that in the state illustrated in FIG. 34A, the laminated piezoelectric element 66*a* does not expand or contract, since no voltage is applied thereto.

In this state, when the laminated piezoelectric element 66*a* of the piezoelectric vibrator 60*a* is driven by a playback sound signal, the laminated piezoelectric element 66*a* vibrates by expanding and contracting in accordance with the playback sound signal with the portion of the elastic member 70 contacting the mounting surface (contact surface) 150 acting as a pivot, and without the cap 63 separating from the mounting surface (contact surface) 150, as illustrated in FIGS. 34B and 34C. As long as problems such as the lowermost edge 111 contacting the mounting surface 150 and emitting abnormal noise do not occur, the cap 63 may separate slightly from the mounting surface 150. The difference in length between when the laminated piezoelectric element 66*a* is fully expanded and fully contracted may, for example, be from 0.05 μm to 100 μm. In this way, the expanding and contracting vibration of the laminated piezoelectric element 66*a* is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 100 μm, vibration grows large depending on the frequency, and the sound generator may wobble. Even if the difference is less than 100 μm, the sound generator may wobble due to the relationship between load and frequency.

As described above, when the laminated piezoelectric element 66*a* is fully expanded, the tip of the cap 63 is preferably located towards the mounting surface 150 from a line (the alternate long and short dash line I in FIG. 33) connecting the lowermost edge 701 of the elastic member 70 and the lowermost edge 111 of the vibration speaker 11 assuming the piezoelectric vibrator 60*a* does not exist. Furthermore, when the laminated piezoelectric element 66*a* is fully contracted, the tip of the cap 63 is preferably located towards the mounting surface 150 from this virtual line.

The location at which the piezoelectric vibrator 60*a* is disposed on the bottom side 20*a*, the length of the laminated piezoelectric element 66*a* in the lamination direction, the dimensions of the cap 63, and the like are appropriately determined so as to satisfy the above conditions.

According to the vibration speaker as a sound generator in the present embodiment, a piezoelectric element is used as the source of vibration, hence reducing the number of components as compared to a vibration generating device having a dynamic speaker configuration and allowing for a simple structure with few components. Furthermore, the stack-type laminated piezoelectric element 66*a* is used as the piezoelectric element and vibrates by expanding and contracting along the lamination direction due to a playback sound signal. Since this expanding and contracting vibration is transmitted to the mounting surface (contact surface) 150, the vibration transmission efficiency with respect to the mounting surface (contact surface) 150 in the expansion and contraction direction (deformation direction) is good, and the mounting surface (contact surface) 150 can be vibrated efficiently. Moreover, since the laminated piezoelectric element 66*a* contacts the mounting surface (contact surface) 150 with the cap 63 therebetween, damage to the laminated piezoelectric element 66*a* can also be prevented. By mounting the vibration speaker 11 on the mounting surface (contact surface) 150 so that the cap 63 of the piezoelectric vibrator 60*a* contacts the mounting surface 150, the weight of the vibration speaker 11 is applied as a load to the cap 63. Hence, the cap 63 can reliably contact the mounting surface (contact surface) 150, and the expanding and contracting vibration of the piezoelectric vibrator 60*a* can efficiently be transmitted to the mounting surface (contact surface) 150.

The vibration speaker as a sound generator according to the present embodiment can mainly transmit vibration of a laminated piezoelectric element directly to a contact surface (mounting surface). Therefore, unlike a technique to transmit vibration of a laminated piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a piezoelectric element until the other elastic body returns to a state in which deformation is again possible. In light of this fact, the anchor of the sound generator according to the present embodiment preferably has enough stiffness (flexural strength) so as not to undergo flexing deformation due to deformation of the piezoelectric element.

The sound generator according to the present embodiment includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input.

Figure 35A:
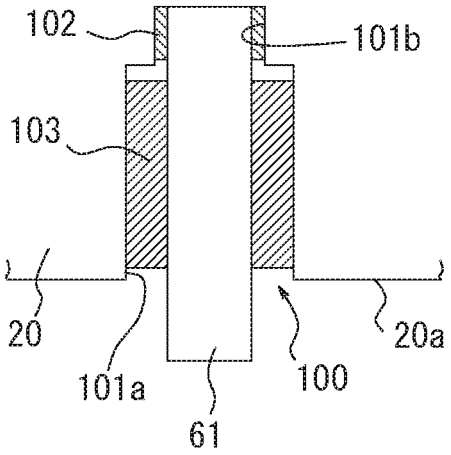
FIG. 35A illustrates a modification to the holding state of the piezoelectric vibrator.
Figure 35B:
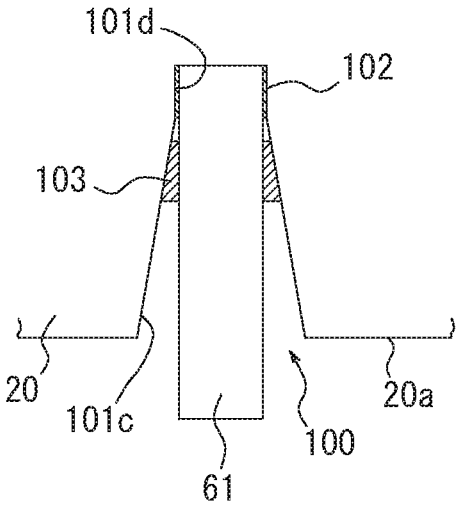
FIG. 35B illustrates another modification to the holding state of the piezoelectric vibrator.
Figure 35C:
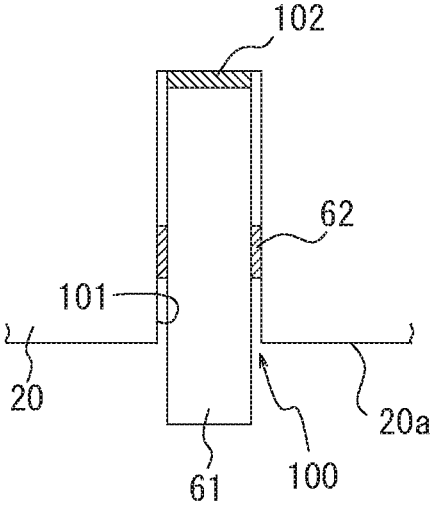
FIG. 35C illustrates yet another modification to the holding state of the piezoelectric vibrator.

The present disclosure is not limited to the above embodiments, and a variety of modifications and changes are possible. For example, the structure to fix the piezoelectric vibrator 60 to the holding unit 100 is not limited to that illustrated in FIG. 5. As illustrated in FIGS. 35A to 35C, the piezoelectric vibrator 60 may be held by the holding unit 100. The holding unit 100 illustrated in FIG. 35A includes a wide slit 101*a* that opens to the bottom side 20*a* and a narrow slit 101*b* that is contiguous with the slit 101*a*. One end of the laminated piezoelectric element 61 is disposed in the narrow slit 101*b*, and the sides of the laminated piezoelectric element 61 are fixed to the slit 101*b* by adhesive 102. Filler 103 such as silicone rubber, gel, or the like that does not impede expansion and contraction of the laminated piezoelectric element 61 is packed in the gap between the wide slit 101*a* and the laminated piezoelectric element 61. By thus holding the piezoelectric vibrator 60 in the holding unit 100, the mobile phone 10 can more reliably be waterproofed without using waterproof packing such as an O-ring. By covering the portion of the laminated piezoelectric element 61 protruding from the bottom side 20*a* with an insulating cap, the laminated piezoelectric element 61 can also reliably be insulated.

The holding unit 100 illustrated in FIG. 35B includes a tapered slit 101*c* that expands toward the bottom side 20*a* and a narrow slit 101*d* that is contiguous with the tapered slit 101*c*. One end of the laminated piezoelectric element 61 is disposed in the narrow slit 101*d*, and the sides of the laminated piezoelectric element 61 are fixed to the slit 101*d* by adhesive 102. Filler 103 such as silicone rubber, gel, or the like that does not impede expansion and contraction of the laminated piezoelectric element 61 is packed in the gap between the tapered slit 101*c* and the laminated piezoelectric element 61. This structure achieves the same effects as the holding unit 100 in FIG. 35A, and by including the tapered slit 101*c*, offers the advantage that the laminated piezoelectric element 61 is easy to assemble into the holding unit 100.

As in the above embodiment, the holding unit 100 illustrated in FIG. 35C has a uniform-width slit 101, yet the end face at one end of the laminated piezoelectric element 61 is fixed to the slit 101 by adhesive 102. Furthermore, an O-ring 62 is disposed in the slit 101 at an appropriate location along the laminated piezoelectric element 61. This holding state for the laminated piezoelectric element 61 particularly offers an advantage in routing lead wires in the case that connectors for lead wires are formed in lateral electrodes of the laminated piezoelectric element 61, as illustrated in FIG. 4.

Figure 36:
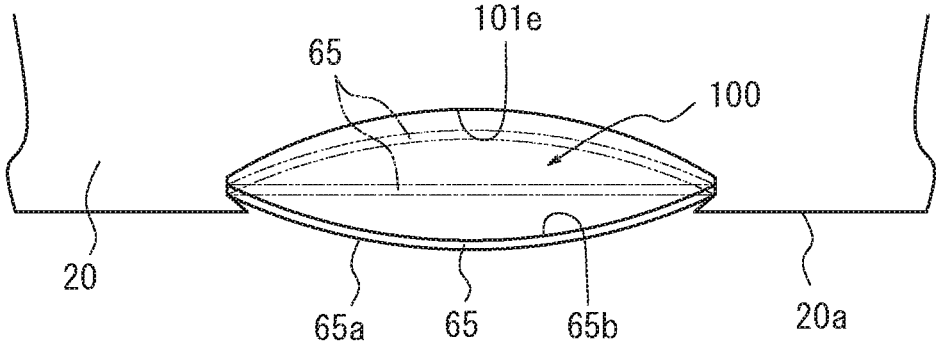
FIG. 36 schematically illustrates the structure of the main parts of a modification to the piezoelectric vibrator.

In the above embodiments and the modifications in FIGS. 35A to 35C, the cap 63 may be omitted from the piezoelectric vibrator 60, so that the end surface of the laminated piezoelectric element 61 is mounted on the mounting surface directly or with a vibration transmission member, formed from an insulating member or the like, therebetween. The piezoelectric element is not limited to the above-described stack-type laminated piezoelectric element. A unimorph, bimorph, or laminated bimorph element may be used. FIG. 36 schematically illustrates the structure of the main parts when using bimorph. Bimorph 65 is shaped as an elongated rectangle, with one surface 65*a* exposed at the bottom side 20*a* of the housing 20, and the edges of the rectangle held by the holding unit 100. The holding unit 100 includes an opening 101*e* that holds the bimorph 65, and the inner surface of the opening 101*e* towards a back side 65*b* of the bimorph 65 is curved. According to this structure, by mounting the housing 20 on the mounting surface so that the bimorph 65 contacts the mounting surface and then driving the bimorph 65 with a playback sound signal, the bimorph 65 undergoes bending (flexure) vibration. In this way, the vibration of the bimorph 65 is transmitted to the mounting surface, and the mounting surface functions as a vibration speaker, causing playback sound to be emitted from the mounting surface. Note that a covering layer of polyurethane or the like may be formed on the surface 65*a* of the bimorph 65.

Furthermore, in FIG. 8, a LPF having the same characteristics as the LPF 123 may be provided between the signal processing circuit 121 and the booster circuit 122. In FIG. 8, the LPF 123 may also be omitted by providing an equalizer of the signal processing circuit 121 or the like with the functions of the LPF 123.

In the above embodiments, an example of the piezoelectric vibrator 60 being disposed on the bottom side 20*a* of the housing 20 and protruding from the bottom side 20*a* has been described, yet the present disclosure is not limited in this way. Depending on the dimensions of the housing 20 and the dimensions of the piezoelectric vibrator 60, the piezoelectric vibrator 60 may, for example, protrude from the battery lid 21.

Figure 37:
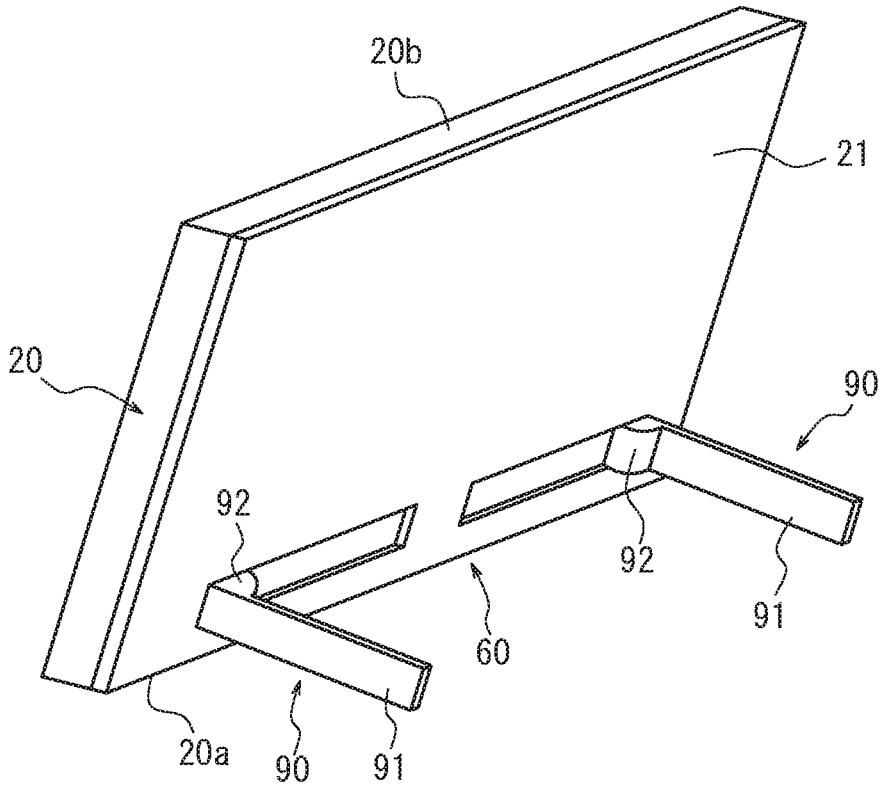
FIG. 37 is an external perspective view schematically illustrating the structure of a sound generator provided with a plurality of stands.

In the present disclosure, the number of stands 90 is not limited to one. The mobile phone 10 may be provided with a plurality of stands 90. For example, FIG. 37 is an external perspective view schematically illustrating the structure of a mobile phone 10 provided with two stands 90. When providing a plurality of stands as in FIG. 37, the mobile phone 10 is supported on a mounting surface by the piezoelectric vibrator 60 and a plurality of legs 91 when stood horizontally. Hence, as compared to when only one stand is provided, the mobile phone 10 can be made self-supporting more stably.

In the above embodiments, the sound generator is installed in the mobile phone 10, and the mobile phone 10 functions as an anchor, yet the anchor is not limited in this way. For example, a sound generator may be installed in any of a wide variety of electronic devices serving as an anchor, such as a portable music player, a tabletop television, a television conferencing system, a telephone conferencing system, a notebook computer, a projector, a hanging clock or hanging television, an alarm clock, or a photo frame.

Figure 38A:
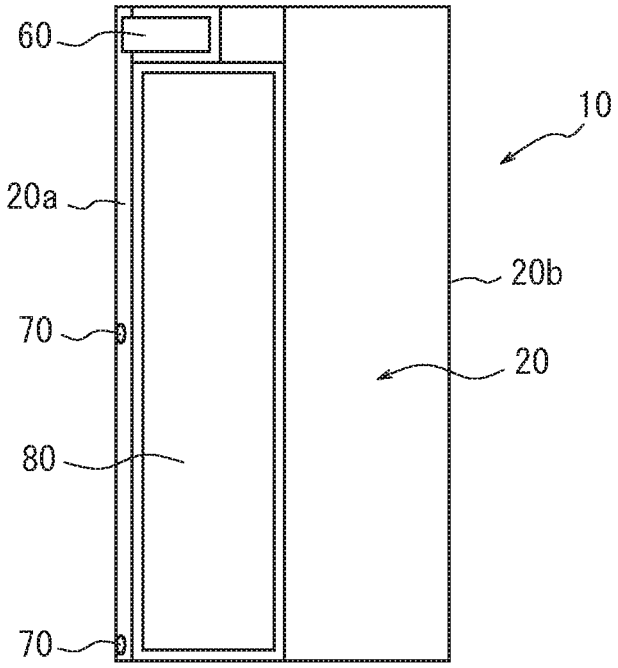
FIG. 38A is a back view, without the battery lid, schematically illustrating the structure of a modification to the arrangement of the piezoelectric vibrator and the battery in a mobile phone.
Figure 38B:
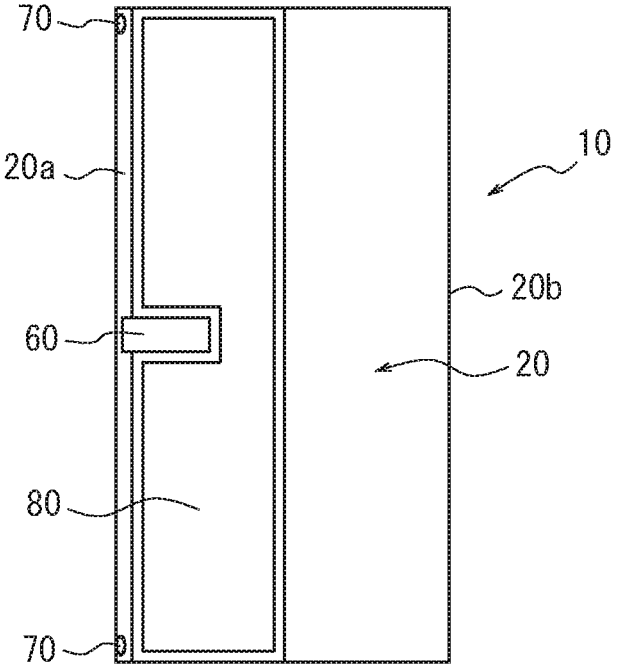
FIG. 38B is a back view, without the battery lid, schematically illustrating the structure of another modification to the arrangement of the piezoelectric vibrator and the battery in a mobile phone.

The arrangement of the piezoelectric vibrator 60 and the batteries 80 is not limited to the example in FIG. 18. FIGS. 38A and 38B are back views, without the battery lid, schematically illustrating the structure of two modifications to the arrangement of the piezoelectric vibrator and the battery in a mobile phone. For example, as illustrated in FIG. 38A, the mobile phone 10 may include one battery 80 therein, with the piezoelectric vibrator 60 being provided near one lateral side along the bottom side 20*a*. As illustrated in FIG. 38B, the piezoelectric vibrator 60 may be provided in the center along the bottom side 20*a*, and the mobile phone 10 may be provided with one battery 80 in a shape that does not interfere with the piezoelectric vibrator 60. The mobile phone 10 may also include a battery holder therein and be used by the user inserting a dry-cell battery into the battery holder.

Figure 39:
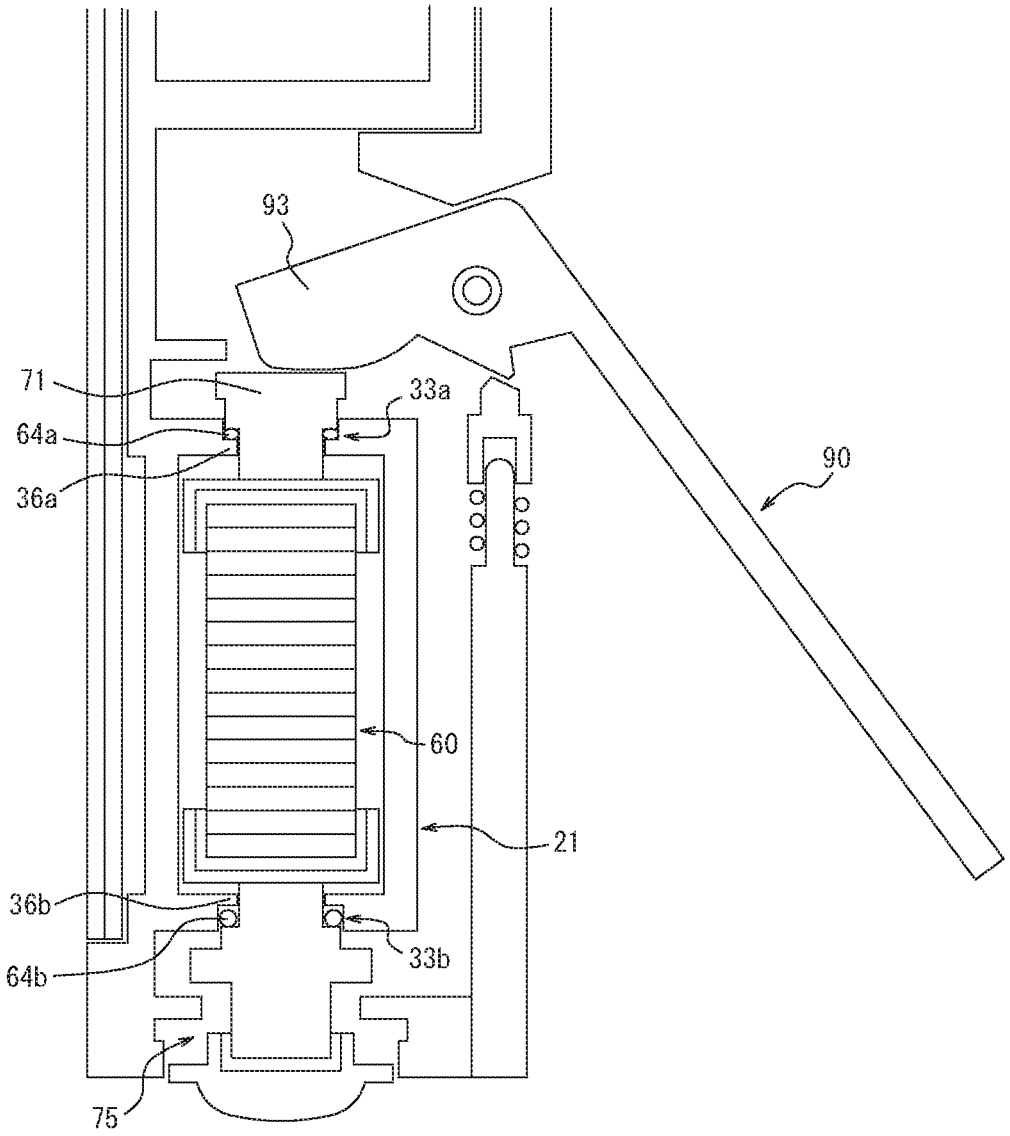
FIG. 39 is a portion of a cross-sectional view along the transverse direction of a mobile phone using an O-ring as a sealing member.

The present disclosure is not limited to Embodiment 5 above, but rather a variety of modifications and changes are possible. For example, the sealing members 64*a* and 64*b* are not limited to packing. O-rings may also be used as the sealing members 64*a* and 64*b*. FIG. 39 is a portion of a cross-sectional view along the transverse direction of a mobile phone using O-rings as the sealing members 64*a* and 64*b*. FIG. 39 corresponds to FIG. 23, used to describe Embodiment 5, and shows O-rings instead of packing for the sealing members 64*a* and 64*b*. The O-rings may, for example, be formed from silicone rubber having elasticity. The O-rings are respectively held by O-ring holding units 36*a* and 36*b* provided in the openings 33*a* and 33*b* and by the vibration unit 75 and regulating unit 71. The O-rings prevent moisture from entering into the piezoelectric vibrator 60 from the outside.

Figure 40A:
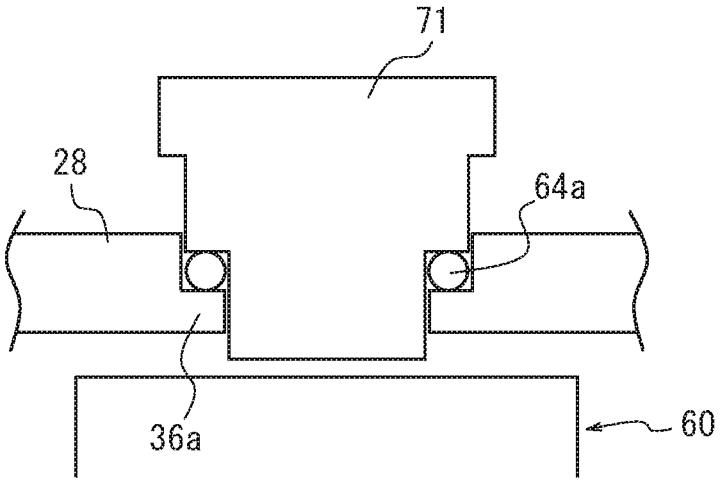
FIG. 40A is a partial enlarged view illustrating a first position of a regulating unit in the mobile phone in FIG. 39.
Figure 40B:
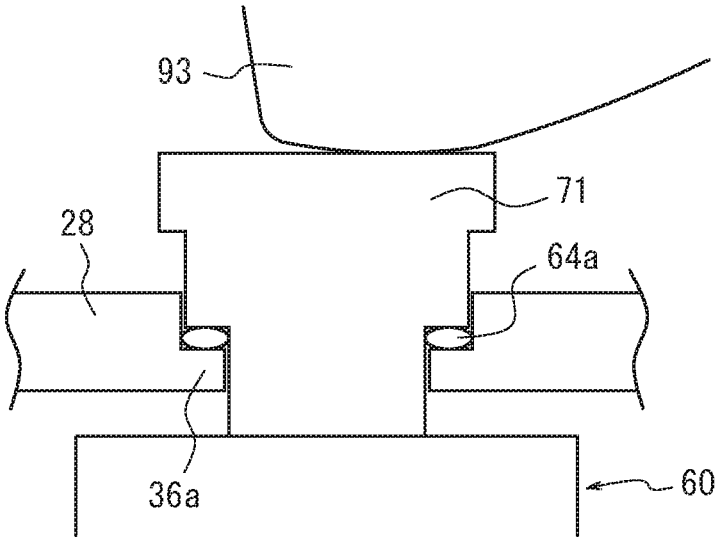
FIG. 40B is a partial enlarged view illustrating a second position of the regulating unit in the mobile phone in FIG. 39.

FIGS. 40A and 40B are partial enlarged views illustrating positions of the regulating unit 71 and the O-rings. With the stand 90 closed, i.e. when the sound generator is not generating sound, the regulating unit 71 is in a first position, as illustrated in FIG. 40A. When the stand 90 is opened for the sound generator to generate sound, the regulating unit 71 is pushed down by pressure from the pressing portion 93 and is displaced to a second position, as illustrated in FIG. 40B. At this time, the O-ring connected to the regulating unit 71 is crushed and becomes distorted. The regulating unit 71 then contacts the laminated piezoelectric element 61 and regulates the support state of the laminated piezoelectric element 61. In this state, the sound signal is applied to the laminated piezoelectric element 61, and upon the laminated piezoelectric element 61 vibrating, the vibration is transmitted to the mounting surface via the vibration unit 75, causing sound to be emitted from the mounting surface.

After the sound generator is used and the stand 90 is once again closed, pressure from the pressing portion 93 is no longer applied to the regulating unit 71. As a result, by the elastic force of the distorted O-ring, the regulating unit 71 is pushed back into the first position, returning to the state in FIG. 40A. In the first position, the regulating unit 71 and the laminated piezoelectric element 61 are not in contact. Therefore, even if a sound signal is applied to the laminated piezoelectric element 61 so that the laminated piezoelectric element 61 vibrates, the vibration occurs in the gap between the regulating unit 71 and the laminated piezoelectric element 61 and is not transmitted to the mounting surface. O-rings may thus be used as the sealing members 64*a* and 64*b*. Note that friction may be generated by direct contact between the regulating unit 71 and the cover member 67*a* of the laminated piezoelectric element 61. In order to prevent such friction, a sponge or the like may for example be inserted between the regulating unit 71 and the cover member 67*a*.

Figure 41A:
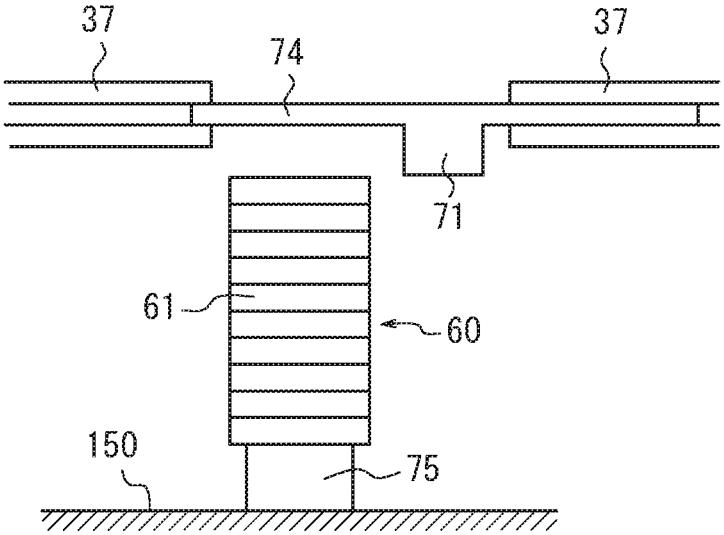
FIG. 41A is a diagram illustrating a first position of a regulating unit in a modification to the method of displacement of the regulating unit.
Figure 41B:
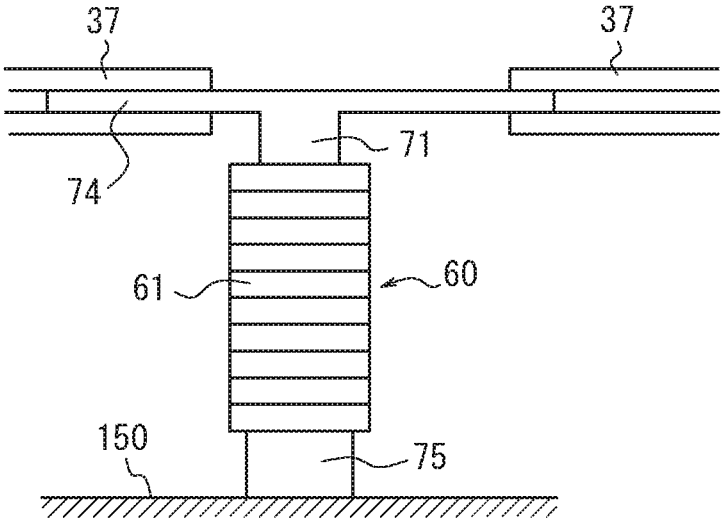
FIG. 41B is a diagram illustrating a second position of the regulating unit in a modification to the method of displacement of the regulating unit.

Displacement of the regulating unit 71 between the first position and the second position is not limited to vertical displacement as in the description above. For example, as schematically illustrated in FIGS. 41A and 41B, the regulating unit 71 may be displaced by sliding horizontally. FIG. 41A illustrates the regulating unit 71 at the first position in the sliding configuration. The vibration unit 75 is placed on the mounting surface 150, and the piezoelectric vibrator 60 is disposed so as to contact the vibration unit 75. The regulating unit 71 is held by, for example, a sliding plate 74. The sliding plate 74 is held by a sliding plate holding unit 37 provided in the housing 20. When the regulating unit 71 is in the first position, the regulating unit 71 and the piezoelectric vibrator 60 are not in contact. Therefore, the piezoelectric vibrator 60 is in the non-regulated state in which vibration is not regulated. In this case, even if a sound signal is applied to the laminated piezoelectric element 61 so that the laminated piezoelectric element 61 vibrates, the laminated piezoelectric element 61 vibrates upwards away from the vibration unit 75, without the vibration being transmitted to the mounting surface 150 via the vibration unit 75.

FIG. 41B illustrates the regulating unit 71 at the second position. At this time, the regulating unit 71 contacts the laminated piezoelectric element 61 and regulates the support state of the piezoelectric vibrator 60, thereby placing the piezoelectric vibrator 60 in the regulated state. In this state, upon application of a sound signal to the laminated piezoelectric element 61 so that the laminated piezoelectric element 61 vibrates, vibration of the laminated piezoelectric element 61 upward is restricted by the regulating unit 71, unlike in the case of the non-regulated state. Hence, vibration of the laminated piezoelectric element 61 is transmitted to the mounting surface 150 via the vibration unit 75. Sound is thus emitted from the mounting surface 150.

In order to maintain the stand 90 open more reliably, the stand 90 may include a claw that locks into a lock provided in the housing 20. The claw and lock should be formed so as not to impede opening and closing of the stand 90.

In the above embodiments, the contacted member is a desk, and the mounting surface is a horizontal mounting surface of the desk, yet the present disclosure is not limited in this way. The mounting surface need not be horizontal. The mounting surface may, for example, be a surface of the desk perpendicular to the ground. An example of a contacted member having a surface perpendicular to the ground is a partition for sectioning off space.

Figure 42:
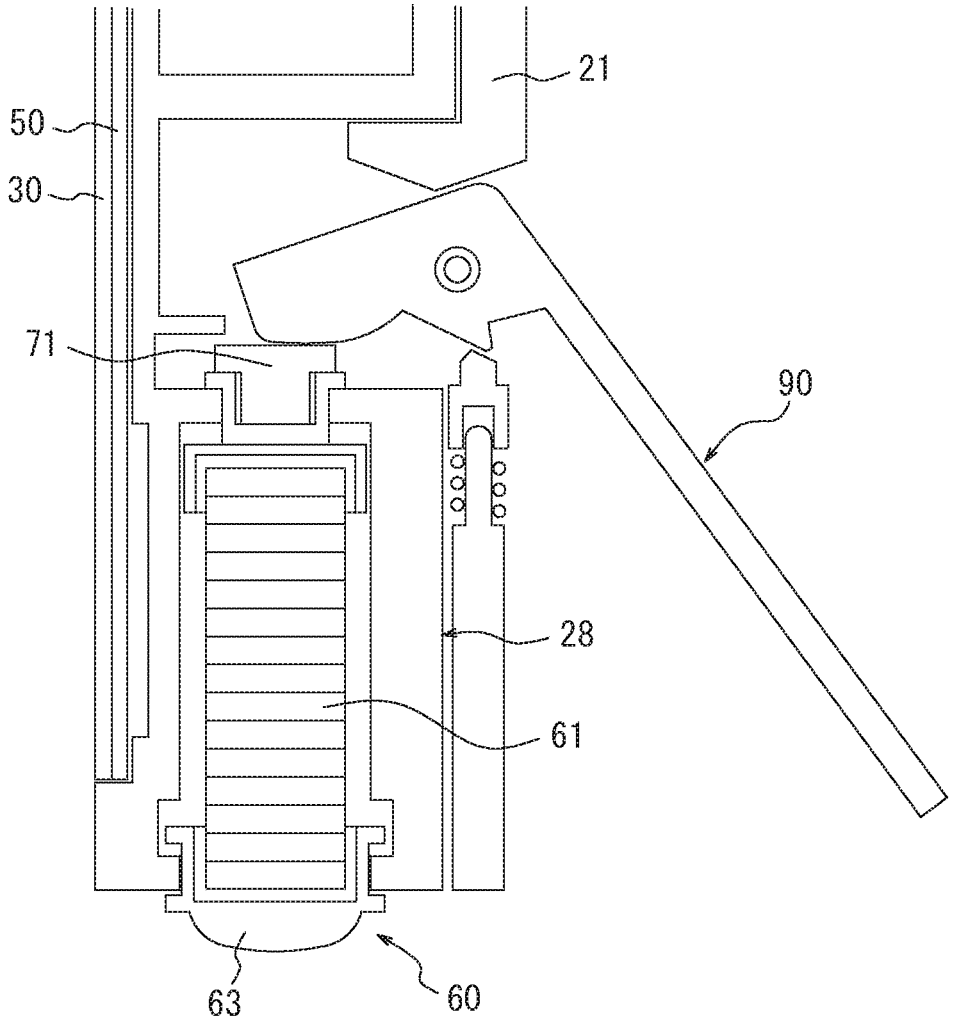
FIG. 42 is a portion of a cross-sectional view of a modification to a mobile phone.

In the above embodiment, the mobile phone 10 is provided with the vibration unit 75 that includes the flange 73 and the cap 72, yet the mobile phone 10 is not limited in this way. The mobile phone 10 may be provided with a vibration unit 75 including only the cap 72. Furthermore, the vibration unit 75 for example may be omitted from the mobile phone 10, as illustrated in FIG. 42, so that the piezoelectric vibrator 60 contacts the mounting surface directly. Vibration due to deformation of the piezoelectric element 61 is thus transmitted to the mounting surface to vibrate the mounting surface. In this case, the piezoelectric vibrator 60 may contact the mounting surface via a cap 63 that is a cover member and that transmits vibration due to deformation of the piezoelectric element 61 to the mounting surface to vibrate the mounting surface.

In Embodiment 6, an example of the piezoelectric vibrator 60*a* and the piezoelectric vibrator 60*b* being disposed on the bottom side 20*a* of the housing 20 and protruding from the bottom side 20*a* has been described, yet the present disclosure is not limited in this way. Depending on the dimensions of the housing 20 and the dimensions of the piezoelectric vibrator 60*a* and piezoelectric vibrator 60*b*, the piezoelectric vibrator 60*a* may, for example, protrude from the side of the housing or from the battery lid.

In Embodiment 6, the contacted member is a desk, and the contact surface is a horizontal mounting surface of the desk, yet the present disclosure is not limited in this way. The contact surface need not be horizontal. The contact surface may, for example, be a surface of the desk perpendicular to the ground. An example of a contacted member having a surface perpendicular to the ground is a partition for sectioning off space.

In Embodiment 6, the vibration speaker 11 is described as an example of a sound generator, and the vibration speaker 11 functions as an anchor, yet the anchor is not limited in this way. For example, a sound generator may be configured with any of a wide variety of electronic devices serving as an anchor, such as a mobile phone, a portable music player, a tabletop television, a telephone conferencing system, a notebook computer, a projector, a hanging clock or hanging television, an alarm clock, or a photo frame. The anchor is not limited to an electronic device and may, for example, be a vase, a chair, or the like. Furthermore, the present disclosure is not limited to a sound generator and may also be configured as a piezoelectric vibrator for a sound generator, the piezoelectric vibrator including a piezoelectric element, or as a sound generation system provided with a sound generator and a contacted member that has a contact surface contacted by the sound generator. These configurations are also to be understood as within the scope of the present disclosure.

(Modification 1)

Figure 43:
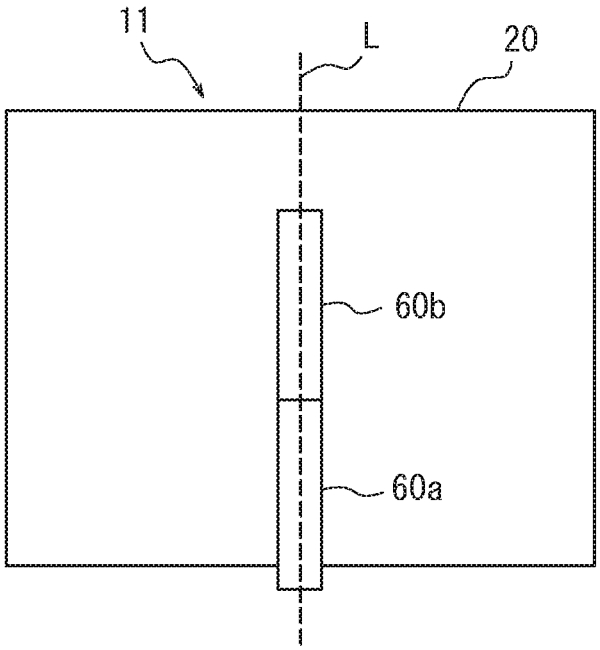
FIG. 43 is a schematic cross-sectional view of a vibration speaker that is a modification to a sound generator according to the present disclosure.

Next, with reference to FIG. 43, Modification 1 to the sound generator according to Embodiment 6 is described. FIG. 43 is a schematic cross-sectional view of a vibration speaker that is Modification 1 to the sound generator according to Embodiment 6. The following only describes the differences from Embodiment 6.

As illustrated in FIG. 43, in the vibration speaker 11 according to Modification 1, the piezoelectric vibrator 60*a* and the piezoelectric vibrator 60*b* are disposed towards the bottom face of the housing 20 on a virtual line L parallel to the expansion and contraction direction of the piezoelectric elements that form the piezoelectric vibrator 60*a* and the piezoelectric vibrator 60*b*.

The sound generator according to Modification 1 thus includes two piezoelectric vibrators, the piezoelectric vibrator 60*a* and the piezoelectric vibrator 60*b*, on a virtual line parallel to the expansion and contraction direction of the piezoelectric elements forming the piezoelectric vibrator 60*a* and the piezoelectric vibrator 60*b*. Hence, as compared to the case of only one piezoelectric vibrator, the stroke can be doubled, and the output power can be the same.

(Modification 2)

Figure 44:
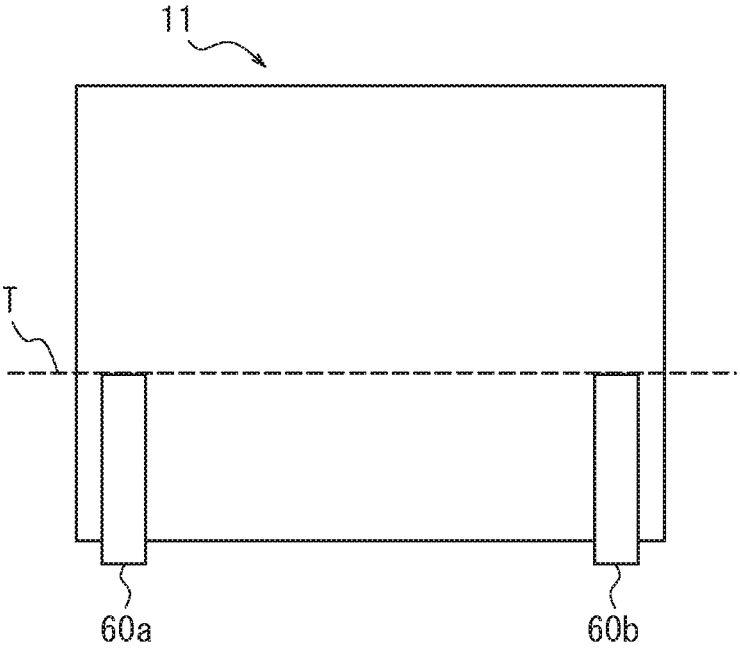
FIG. 44 is a schematic cross-sectional view of a vibration speaker that is a modification to a sound generator according to the present disclosure.

Next, with reference to FIG. 44, Modification 2 to the sound generator according to Embodiment 6 is described. FIG. 44 is a schematic cross-sectional view of a vibration speaker that is Modification 2. The following only describes the differences from Embodiment 6.

As illustrated in FIG. 44, in the vibration speaker 11 according to Modification 2, the piezoelectric vibrator 60*a* and the piezoelectric vibrator 60*b* are disposed towards the bottom face of the housing 20 on a virtual plane T perpendicular to the expansion and contraction direction of the piezoelectric elements that form the piezoelectric vibrator 60*a* and the piezoelectric vibrator 60*b*, and the distance therebetween is greater than in the embodiment illustrated in FIG. 30. In other words, in Modification 2, the piezoelectric vibrator 60*a* and the piezoelectric vibrator 60*b* are disposed at the edges of the bottom face of the housing 20.

The sound generator according to Modification 2 thus includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input. Moreover, in Modification 2, the piezoelectric vibrator 60*a* and the piezoelectric vibrator 60*b* are disposed at the edges towards the bottom face of the housing 20, and therefore the quality of stereo sound can be improved as compared to the embodiment illustrated in FIG. 3.

(Modification 3)

Figure 45:
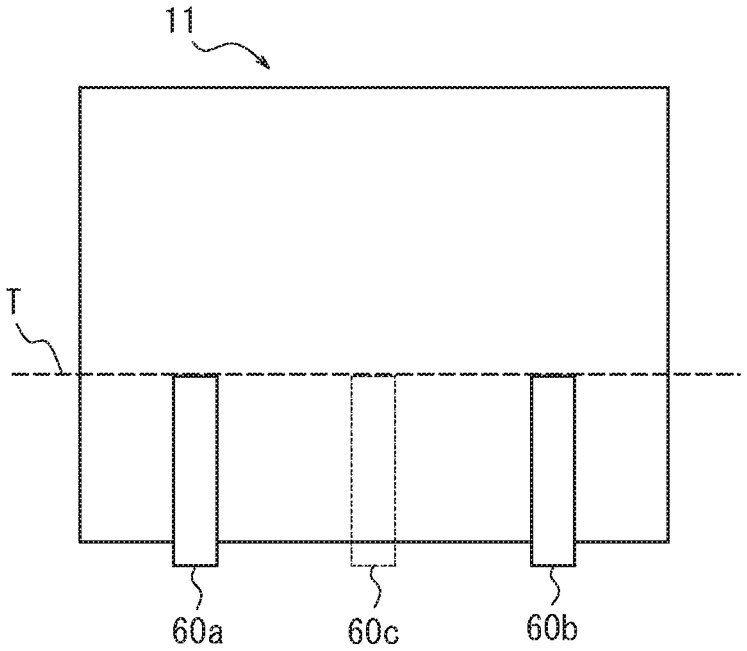
FIG. 45 is a schematic cross-sectional view of a vibration speaker that is a modification to a sound generator according to the present disclosure.
Figure 46:
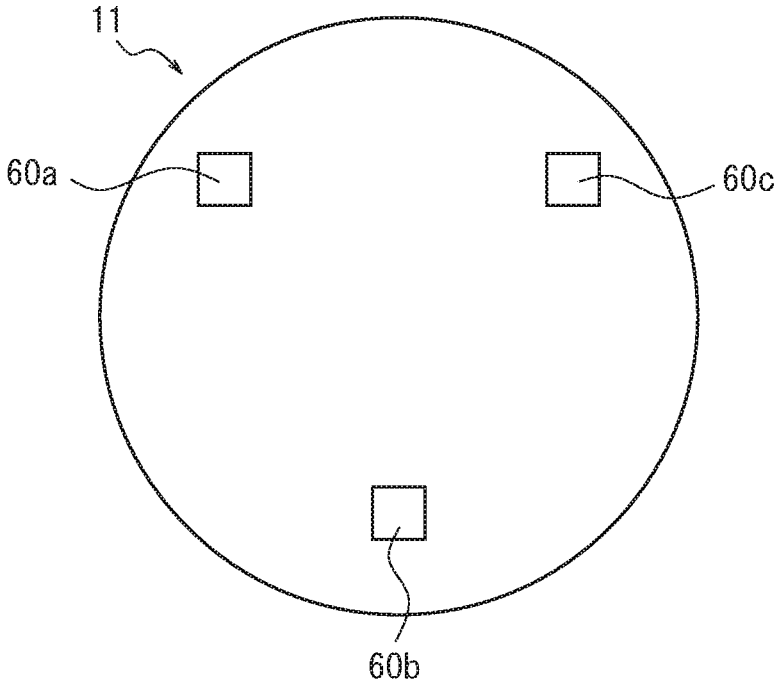
FIG. 46 is a schematic view of the bottom face of the vibration speaker in FIG. 45.

Next, with reference to FIGS. 45 and 46, Modification 3 to the sound generator according to Embodiment 6 is described. FIGS. 45 and 46 are schematic cross-sectional views of a vibration speaker that is Modification 3. The following only describes the differences from Embodiment 6.

As illustrated in FIGS. 45 and 46, the vibration speaker 11 according to Modification 3 includes three piezoelectric vibrators: piezoelectric vibrator 60*a*, piezoelectric vibrator 60*b*, and piezoelectric vibrator 60*c*. The piezoelectric vibrator 60*a*, piezoelectric vibrator 60*b*, and piezoelectric vibrator 60*c* are disposed towards the bottom face of the housing 20 on a virtual plane T perpendicular to the expansion and contraction direction of the piezoelectric elements that form the piezoelectric vibrator 60*a*, piezoelectric vibrator 60*b*, and piezoelectric vibrator 60*c*. In Modification 3, the piezoelectric vibrator 60*a*, piezoelectric vibrator 60*b*, and piezoelectric vibrator 60*c* are formed towards the bottom face of the housing 20 at positions corresponding to the vertices of an equilateral triangle. In the present disclosure, the positional relationship between the three piezoelectric vibrators is of course not limited to the case of forming vertices of an equilateral triangle, and any other appropriate positions may be adopted.

The sound generator according to Modification 3 thus includes three piezoelectric vibrators, the piezoelectric vibrator 60*a*, piezoelectric vibrator 60*b*, and piezoelectric vibrator 60*c* on a virtual plane perpendicular to the expansion and contraction direction of the piezoelectric elements forming the piezoelectric vibrator 60*a*, piezoelectric vibrator 60*b*, and piezoelectric vibrator 60*c*. Hence, as compared to the case of only one piezoelectric vibrator, the stroke can be the same, and the output power can be tripled. Since the piezoelectric vibrator 60*a*, piezoelectric vibrator 60*b*, and piezoelectric vibrator 60*c* can support the vibration speaker 11 at three points, the vibration speaker 11 can be supported stably without requiring another leg to prevent the vibration speaker 11 from falling over.

In Embodiment 6 and the modifications thereto, examples of two or three piezoelectric vibrators have been described, yet the sound generator of the present disclosure may include four or more piezoelectric vibrators.

REFERENCE SIGNS LIST

10: Mobile phone
11: Vibration speaker
20: Housing
20*a*: Bottom side
20*b*: Top side
21: Battery lid
22: Rotating stopper
23: Stand guide
24: Spring attaching portion
25: Spring
26: Shaft
27: Shaft collar
28: Holding unit

29: Guide
30: Panel
31: Battery pack
32: Camera unit
33*a*, 33*b*: Opening
34*a*, 34*b*: Stopper
35: Opening
36*a*, 36*b*: O-ring holding unit
37: Sliding plate holding unit
40: Input unit
50: Display unit
60, 60*a*, 60*b*, 60*c*: Piezoelectric vibrator
61, 66*a*, 66*b*: Laminated piezoelectric element (piezoelectric element)
62: O-ring
63: Cap
64*a*, 64*b*: Sealing member
67*a*, 67*b*: Cover member
70: Elastic member
71: Regulating unit
72: Cap
73: Flange
74: Sliding plate
75: Vibration unit
80: Battery
81: Rotating stopper
81*a*, 81*b*: Rotating stopper face
82: Stand guide
83: Shaft
84: Spring attaching portion
85: Spring
86: Shaft collar
90: Stand
91: Leg
92: Attaching portion
93: Pressing portion
93*a*: End face
94: Inclined portion
100: Holding unit
101: Slit
102: Adhesive
103: Filler
110: Wireless communication unit
120: Piezoelectric element drive unit
121: Signal processing circuit
122: Booster circuit
123: Low pass filter (LPF)
130: Control unit
150: Mounting surface (contact surface)
160: Loudspeaker
170: Detection switch

The invention claimed is:

1. A sound generator comprising:
a housing comprising first and second surfaces opposite to each other; and
a vibrator comprising:
at least one piezoelectric element configured to generate vibration, at least a part of the at least one piezoelectric element being inside of the housing; and
a contact portion on the at least one piezoelectric element, the contact portion being configured to transmit the vibration to an object outside of the sound generator,
wherein
at least a part of the first surface faces a third surface of the object while the contact portion is in contact with the object,
the first surface intersects a line that is perpendicular to the third surface and that passes through a center of gravity of the sound generator that is located closer to the first surface than the second surface, and
the at least one piezoelectric element generates vibration in response to a signal from outside the vibrator, and causes the third surface to vibrate and generate a sound to emit from the third surface.

2. The sound generator according to claim 1, wherein
the housing includes at least one battery therein, and
a center of gravity of the battery is positioned towards the first surface from an intermediate position between the first surface and the second surface.

3. The sound generator according to claim 1, wherein
the housing comprises a display unit, and
when the contact portion is in contact with the object, the display unit faces diagonally upward.

4. The sound generator according to claim 1, wherein the vibrator includes a cover member that vibrates the third surface by transmitting vibration due to deformation of the at least one piezoelectric element to the third surface.

5. A sound generator comprising:
a housing comprising a first surface;
a display; and
a vibrator comprising:
at least one piezoelectric element configured to generate vibration, at least a part of the at least one piezoelectric element being inside of the housing; and
a contact portion on the piezoelectric element, the contact portion being configured to transmit the vibration to an object outside of the sound generator,
wherein
the at least one piezoelectric element generates vibration in response to a signal from outside the vibrator, and causes the object to vibrate and generate a sound to emit from the object, and
when the contact portion is in contact with the object, the display faces diagonally upward.

6. The sound generator according to claim 5, wherein
at least a part of the first surface faces a second surface of the object while the contact portion is in contact with the object, and
the first surface intersects a line that is perpendicular to the second surface and that passes through a center of gravity of the sound generator.

* * * * *